US010815091B2

(12) United States Patent
Kaneko et al.

(10) Patent No.: US 10,815,091 B2
(45) Date of Patent: Oct. 27, 2020

(54) SHEET CONVEYANCE APPARATUS

(71) Applicant: CANON DENSHI KABUSHIKI KAISHA, Chichibu-shi (JP)

(72) Inventors: Sadayuki Kaneko, Tokyo (JP); Misato Nakayama, Tokyo (JP); Asako Chiba, Kanagawa-ken (JP); Ayumi Machida, Tokyo (JP); Tetsurou Ishikawa, Tokyo (JP); Yoshinori Kanaya, Tokyo (JP); Yoshihiro Taniike, Saitama-ken (JP); Masashi Yamaguchi, Kanagawa-ken (JP)

(73) Assignee: Canon Denshi Kabushiki Kaisha, Chichibu-shi (JP)

( * ) Notice: Subject to any disclaimer, the term of this patent is extended or adjusted under 35 U.S.C. 154(b) by 0 days.

(21) Appl. No.: 16/381,383

(22) Filed: Apr. 11, 2019

(65) Prior Publication Data

US 2019/0233241 A1 Aug. 1, 2019

Related U.S. Application Data

(63) Continuation of application No. 15/980,028, filed on May 15, 2018, now Pat. No. 10,301,139, which is a (Continued)

(30) Foreign Application Priority Data

Nov. 20, 2015 (JP) ..... 2015-228146
Nov. 20, 2015 (JP) ..... 2015-228149

(Continued)

(51) Int. Cl.
*B65H 31/00* (2006.01)
*B65H 31/20* (2006.01)

(Continued)

(52) U.S. Cl.
CPC ..... *B65H 31/20* (2013.01); *B65H 31/00* (2013.01); *B65H 31/02* (2013.01); *B65H 31/22* (2013.01);

(Continued)

(58) Field of Classification Search
CPC B65H 31/00; B65H 31/20; B65H 2405/1117; B65H 2405/1111; B65H 2405/324
See application file for complete search history.

(56) References Cited

U.S. PATENT DOCUMENTS 6,830,401 B1 12/2004 Hwang et al.
7,290,952 B2 * 11/2007 Kagami ..... B41J 13/106 271/144

(Continued)

FOREIGN PATENT DOCUMENTS

CN 101668101 A 3/2010
CN 103935814 A 7/2014

(Continued)

OTHER PUBLICATIONS

Office Action dated Apr. 2, 2019, in Chinese Patent Application No. 201680069303.6.

(Continued)

*Primary Examiner* — Howard J Sanders
(74) *Attorney, Agent, or Firm* — Venable LLP

(57) ABSTRACT

An apparatus includes a housing provided with a conveyance path, a conveyance unit which conveys a sheet along the conveyance path, a discharge port from which the sheet conveyed along the conveyance path is discharged, a discharge tray on which the sheet discharged from the discharge port is stacked, and an attitude change unit which changes an attitude of the discharge tray. The discharge tray includes a first sheet receiving surface which is a portion facing the discharge port in a discharge direction of the sheet (Continued)

and on which a leading edge of the sheet lands, and a second sheet receiving surface which is formed at a predetermined inclination with respect to the first sheet receiving surface. The attitude change unit changes the attitude of the discharge tray so that the first sheet receiving surface of the discharge tray is inclined toward the discharge port.

5 Claims, 61 Drawing Sheets

Related U.S. Application Data continuation of application No. PCT/JP2016/084366, filed on Nov. 18, 2016.

(30) Foreign Application Priority Data

Nov. 20, 2015 (JP) ..... 2015-228150
Nov. 20, 2015 (JP) ..... 2015-228155
Sep. 9, 2016 (JP) ..... 2016-177087

(51) Int. Cl.
*B65H 31/02* (2006.01)
*B65H 31/22* (2006.01)

(52) U.S. Cl.
CPC .. *B65H 2301/4212* (2013.01); *B65H 2402/46* (2013.01); *B65H 2405/111* (2013.01); *B65H 2405/1111* (2013.01); *B65H 2405/1117* (2013.01); *B65H 2405/11151* (2013.01); *B65H 2405/11164* (2013.01); *B65H 2405/324* (2013.01); *B65H 2511/10* (2013.01); *B65H 2511/214* (2013.01); *B65H 2513/10* (2013.01); *B65H 2801/12* (2013.01); *B65H 2801/39* (2013.01)

(56) References Cited

U.S. PATENT DOCUMENTS

| | | | | |
|---|---|---|---|---|
| 8,169,669 | B2 | 5/2012 | Yoshida et al. | |
| 8,602,410 | B2 | 12/2013 | Kuriki | |
| 8,823,995 | B2 | 9/2014 | Doumae et al. | |
| 9,598,257 | B2 | 3/2017 | Komuro | |
| 9,630,788 | B2 | 4/2017 | Horita et al. | |
| 10,301,139 | B2 * | 5/2019 | Kaneko | B65H 31/22 |
| 2006/0115059 | A1 | 6/2006 | Nobe | |
| 2008/0054554 | A1 | 3/2008 | Nishii et al. | |
| 2010/0053701 | A1 | 3/2010 | Yoshida et al. | |
| 2014/0085679 | A1 | 3/2014 | Doumae et al. | |
| 2014/0319760 | A1 * | 10/2014 | Komuro | B65H 31/20 271/223 |

FOREIGN PATENT DOCUMENTS

| | | | |
|---|---|---|---|
| CN | 104118744 | A | 10/2014 |
| JP | 61-169446 | A | 7/1986 |
| JP | 63-147768 | A | 6/1988 |
| JP | 02-135376 | A | 5/1990 |
| JP | 07-252004 | A | 10/1995 |
| JP | 2000-255872 | A | 9/2000 |
| JP | 2001-069280 | A | 3/2001 |
| JP | 2001-069281 | A | 3/2001 |
| JP | 2002-167107 | A | 6/2002 |
| JP | 2006-157724 | A | 6/2006 |
| JP | 2007-318523 | A | 12/2007 |
| JP | 2008-230716 | A | 10/2008 |
| JP | 2009-012868 | A | 1/2009 |
| JP | 2010-023932 | A | 2/2010 |
| JP | 2010-062839 | A | 3/2010 |
| JP | 2010-215309 | A | 9/2010 |
| JP | 2013-023307 | A | 2/2013 |
| JP | 2013-056723 | A | 3/2013 |
| JP | 2014-072564 | A | 4/2014 |
| JP | 2014-076896 | A | 5/2014 |
| JP | 5886468 | B2 | 3/2016 |

OTHER PUBLICATIONS

Extended European Search Report dated Jun. 17, 2019, in European Patent Application No. 16866478.7.
International Search Report and Written Opinion dated Dec. 13, 2016, in International Application No. PCT/JP2016/084366.
Office Action dated Feb. 3, 2020, in Japanese Patent Application No. 2015-228149.
Office Action dated Feb. 3, 2020, in Japanese Patent Application No. 2015-228155.

* cited by examiner

SHEET CONVEYANCE APPARATUS

This application is a continuation of U.S. patent application Ser. No. 15/980,028, filed May 15, 2018, which is a continuation of International Patent Application No. PCT/JP2016/084366 filed on Nov. 18, 2016, and claims priority to Japanese Patent Application Nos. 2015-228146, 2015-228149, 2015-228150, and 2015-228155, filed Nov. 20, 2015, and Japanese Patent Application No. 2016-177087, filed Sep. 9, 2016, the entire contents of which are incorporated herein by reference.

TECHNICAL FIELD

The present invention relates to a sheet conveyance apparatus.

BACKGROUND ART

There are known copying machines, scanners, printers, and the like each having a mechanism of conveying a plurality of sheets one by one. For example, as a scanner, there is known an image reading apparatus in which an original bundle of checks or documents is placed on an original table, and separated and conveyed by a feeding mechanism one by one to read an image of the original.

CITATION LIST

Patent Literature

PTL 1: Japanese Patent Laid-Open No. 2014-72564
PTL 2: Japanese Patent No. 5886468

SUMMARY OF INVENTION

Technical Problem

An apparatus disclosed in PTL 1 is provided with a discharge tray on the sheet discharge port side of a housing. This discharge tray receives a discharged sheet to improve an aligning property.

However, there is a problem that it is impossible to always receive a sheet with good aligning property depending on the type of sheet discharged to the discharge tray described in PTL 1.

In PTL 2, in a state (stored state) in which a discharge tray is folded to the housing side, a tray support portion abuts against the front surface of the housing. If, therefore, the surface of the discharge tray is scratched or contaminated due to friction with the tray support portion, the user can see it, thereby degrading the appearance in the stored state.

The present invention provides a technique that can improve the aligning property of discharged sheets by adjusting the angle of a sheet discharge tray without degrading the appearance in the stored state of the discharge tray, can perform fine adjustment at high accuracy, and is thus effective in downsizing an apparatus.

Solution to Problem

According to the present invention, there is provided a sheet conveyance apparatus comprising: a housing provided with a conveyance path; a conveyance unit configured to convey a sheet along the conveyance path; a discharge port from which the sheet conveyed along the conveyance path is discharged; a discharge tray on which the sheet discharged from the discharge port is stacked; and an attitude change unit configured to change an attitude of the discharge tray, the discharge tray including a first sheet receiving surface which is a portion facing the discharge port in a discharge direction of the sheet and on which a leading edge of the sheet lands, and a second sheet receiving surface which is formed at a predetermined inclination with respect to the first sheet receiving surface, wherein the attitude change unit changes the attitude of the discharge tray so that the first sheet receiving surface of the discharge tray is inclined toward the discharge port.

Advantageous Effects of Invention

According to the present invention, it is possible to provide sheet conveyance apparatus capable of adjusting the angle of a discharge tray with a simple configuration.

Other features and advantages of the present invention will be apparent from the following description taken in conjunction with the accompanying drawings. Note that the same reference numerals denote the same or like components throughout the accompanying drawings.

BRIEF DESCRIPTION OF DRAWINGS

The accompanying drawings, which are incorporated in and constitute a part of the specification, illustrate embodiments of the invention and, together with the description, serve to explain the principles of the invention.

DESCRIPTION OF EMBODIMENTS

Figure 1:
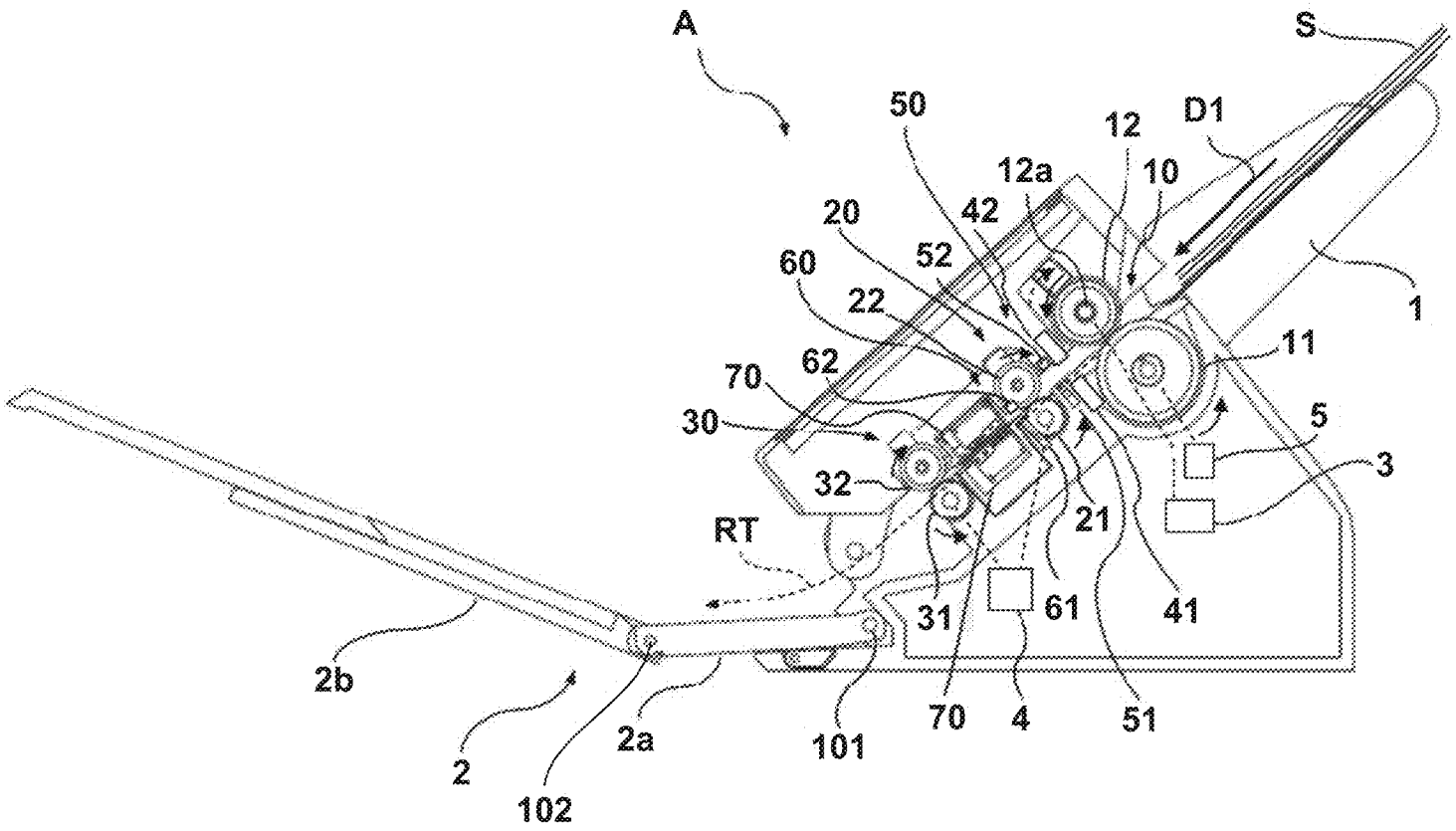
FIG. 1 is a schematic side sectional view showing an image reading apparatus according to an embodiment of the present invention.

FIG. 1 is a schematic view showing an image reading apparatus A according to an embodiment of the present invention.

<Apparatus Configuration>

The image reading apparatus A is an apparatus that conveys one or a plurality of conveyance media S stacked on a mounting table 1 into the apparatus through a path RT one by one, reads an image of the medium, and discharges the medium to a discharge tray 2. The read conveyance medium S may be, for example, a sheet such as an OA sheet, check, business card, or card, and may be a thick or thin sheet. Examples of cards are a health insurance card, license, and credit card. The conveyance medium S includes a book such as a passport. When a book is a target, a holder (to be described later) can be used. When a book in a double-page spread state is stored in the holder and placed on the mounting table 1, the book is conveyed together with the holder, and an image of the book can be read. When a book in a double-page spread state is stored in a transparent holder and placed on the mounting table 1, the book is conveyed together with the holder and an image of the book can be read.

<Sheet Feeding>

A first conveyance unit 10 serving as a feeding mechanism that feeds the conveyance medium S along the path RT is provided. In this embodiment, the first conveyance unit 10 includes a feed roller 11 and a separation roller 12 facing the feed roller 11, and sequentially conveys the conveyance media S on the mounting table 1 in a conveyance direction D1 one by one. A driving unit 3 such as a motor transfers a driving force to the feed roller 11 via a transfer unit 5, and the feed roller 11 is rotationally driven in the direction of an arrow in FIG. 1 (in a positive direction in which the conveyance medium S is conveyed along the path RT). The transfer unit 5 is, for example, an electromagnetic clutch, and interrupts the driving force transferred from the driving unit 3 to the feed roller 11.

<Driving Unit>

In this embodiment, the transfer unit 5 that connects the driving unit 3 and the feed roller 11 is normally set in a state in which the driving force is transferred, and interrupts the driving force when the conveyance medium S is conveyed in a backward direction or stops. If the transfer unit 5 interrupts the transfer of the driving force, the feed roller 11 is set in a freely rotatable state. Note that the transfer unit 5 need not be provided if the feed roller 11 is driven only in one direction.

<Separation Structure>

The separation roller 12 facing the feed roller 11 is a roller for separating the conveyance media S one by one, and is in press contact with the feed roller 11 with a constant pressure. To ensure this press contact state, the separation roller 12 is swingably provided and is configured to be biased against the feed roller 11. The driving unit 3 transfers a driving force to the separation roller 12 via a torque limiter 12*a*, and the separation roller 12 is rotationally driven in the direction of a solid-line arrow (in a direction opposite to the positive direction of the feed roller 11).

Since the transfer of the driving force to the separation roller 12 is regulated by the torque limiter 12*a*, when the separation roller 12 abuts against the feed roller 11, the separation roller 12 rotates together with the feed roller 11 (in the direction of a broken-line arrow). With this operation, if the plurality of conveyance media S are conveyed to a press-contact portion between the feed roller 11 and the separation roller 12, two or more conveyance media S except one conveyance medium S are dammed not to be conveyed.

Note that the separation mechanism is formed by the separation roller 12 and the feed roller 11 in this embodiment. However, such separation mechanism need not always be provided. Any feeding mechanism that sequentially feeds the conveyance media S to the path RT one by one can be used. If the separation mechanism is provided, a separation pad that applies a friction force to the conveyance media S may be brought into press contact with the feed roller 11 to perform the same separation operation, instead of the component such as the separation roller 12.

<Conveyance Structure>

A second conveyance unit 20 serving as a conveyance mechanism on the downstream side of the first conveyance unit 10 in the conveyance direction includes a driving roller 21 and a driven roller 22 driven by the driving roller 21, and conveys, to the downstream side, the conveyance medium S conveyed from the first conveyance unit 10. A driving unit 4 such as a motor transfers a driving force to the driving roller 21, and the driving roller 21 is rotationally driven in the direction of an arrow in FIG. 1. The driven roller 22 is in press contact with the driving roller 21 with a constant pressure, and rotates together with the driving roller 21. The driven roller 22 may be configured to be biased against the driving roller 21 by a biasing unit (not shown) such as a spring.

A third conveyance unit 30 on the downstream side of the second conveyance unit 20 in the conveyance direction includes a driving roller 31 and a driven roller 32 driven by the driving roller 31, and conveys the conveyance medium S conveyed from the second conveyance unit 20 to the discharge tray 2. That is, the third conveyance unit 30 functions as a discharge mechanism.

The driving unit 4 such as a motor transfers the driving force to the driving roller 31, and the driving roller 31 is rotationally driven in the direction of an arrow in FIG. 1. The driven roller 32 is in press contact with the driving roller 31 with a constant pressure, and rotates together with the driving roller 31. The driven roller 32 may be configured to be biased against the driving roller 31 by a biasing unit (not shown) such as a spring.

The discharge tray 2 is axially supported via a first hinge 101 provided in a lower portion of the image reading apparatus A so as to be pivotable with respect to the image reading apparatus A. The discharge tray 2 is formed from a first discharge tray 2*a* on the side of the first hinge 101 and a second discharge tray 2*b* connected to the distal end of the first discharge tray 2*a*. The second discharge tray 2*b* is axially supported to be pivotable about a second hinge 102 provided at the distal end of the first discharge tray 2*a*.

<Image Reading Structure, Control>

In the image reading apparatus A according to this embodiment, an image reading unit 70 arranged between the second conveyance unit 20 and the third conveyance unit 30 reads an image, and thus the second conveyance unit 20 and the third conveyance unit 30 convey the conveyance medium S at a constant speed. By always setting a conveyance speed to a speed equal to or higher than the conveyance speed of the first conveyance unit 10, it is possible to reliably avoid a situation in which the succeeding conveyance medium S catches up with the preceding conveyance medium S. For example, in this embodiment, speed control is performed so that the conveyance speed of the conveyance medium S by the second conveyance unit 20 and the third conveyance unit 30 is higher than that by the first conveyance unit 10.

Note that even if the conveyance speed of the conveyance medium S by the second conveyance unit 20 and the third conveyance unit 30 is set to be equal to that by the first conveyance unit 10, it is possible to form a minimum interval between the preceding conveyance medium S and the succeeding conveyance medium S by controlling the driving unit 3 to intermittently shift the feed start timing of the succeeding conveyance medium S.

<Double Feed Detection>

A double feed detection sensor 40 arranged between the first conveyance unit 10 and the second conveyance unit 20 is an example of a detection sensor (a sensor for detecting the behavior or state of a sheet) for detecting a state in which the conveyance media S such as sheets pass through the first conveyance unit 10 while being in tight contact with each other due to static electricity or the like (that is, a double feed state in which sheets overlapping each other are conveyed). Various kinds of sensors can be used as the double feed detection sensor 40. In this embodiment, an ultrasonic sensor is used, which includes an ultrasonic transmission unit 41 and an ultrasonic reception unit 42, and detects double feed on the principle that the attenuation amount of an ultrasonic wave passing through the conveyance medium S when the conveyance media S such as paper sheets are conveyed one by one is different from that of an ultrasonic wave passing through the conveyance media S when the conveyance media S are double-fed.

<Registration Sensor>

A medium detection sensor 50 arranged on the downstream side of the double feed detection sensor 40 in the conveyance direction D1 is an example of an upstream-side detection sensor (a sensor for detecting the behavior or state of a sheet) arranged on the upstream side of the second conveyance unit 20 and on the downstream side of the first conveyance unit 10, and detects the position of the conveyance medium S conveyed by the first conveyance unit 10, more specifically, whether the end portion of the conveyance medium S has reached or passed through the detection position of the medium detection sensor 50. Various kinds of sensors can be used as the medium detection sensor 50. In this embodiment, an optical sensor is used, which includes a light emitting unit 51 and a light receiving unit 52 and detects the conveyance medium S on the principle that a light reception intensity (light receiving amount) changes when the conveyance medium S reaches or passes through.

In this embodiment, the medium detection sensor 50 is provided near the double feed detection sensor 40 on the downstream side of it so that when the medium detection sensor 50 detects the leading edge of the conveyance medium S, the conveyance medium S reaches a position at which the double feed detection sensor 40 can detect double feed. Note that the medium detection sensor 50 is not limited to the above-described optical sensor. For example, a sensor (image sensor or the like) capable of detecting the end portion of the conveyance medium S or a lever type sensor protruding to the path RT may be used.

A medium detection sensor 60 different from the medium detection sensor 50 is arranged on the upstream side of the image reading units 70. The medium detection sensor 60 is an example of a downstream-side detection sensor arranged on the downstream side of the second conveyance unit 20, and detects the position of the conveyance medium S conveyed by the second conveyance unit 20. Various kinds of sensors can be used as the medium detection sensor 60. In this embodiment, an optical sensor is used, similarly to the medium detection sensor 50, which includes a light emitting unit 61 and a light receiving unit 62 and detects the conveyance medium S on the principle that a light reception intensity (light receiving amount) changes when the conveyance medium S reaches or passes through. Note that in this embodiment, the medium detection sensors 50 and 60 are respectively arranged on the upstream and downstream sides of the second conveyance unit 20 in the conveyance direction. However, only one of the medium detection sensors 50 and 60 may be arranged.

<Arrangement of CIS>

Each of the image reading units 70 on the downstream side of the medium detection sensor 60 is, for example, a unit for optically scanning, performing conversion into an electrical signal, and reading the signal as image data, and includes a light source such as an LED, an image sensor, and a lens array. In this embodiment, the image reading unit 70 is arranged on each side of the path RT, and these image reading units read the obverse and reverse surfaces of the conveyance medium S. However, one image reading unit 70 may be arranged on only one side of the path RT to read only one surface of the conveyance medium S. This embodiment adopts the structure in which the image reading units 70 are arranged to face each other on both sides of the path RT. However, for example, the image reading units 70 may be arranged at an interval in the direction of the path RT.

<Explanation of Block Diagram>

Figure 2:
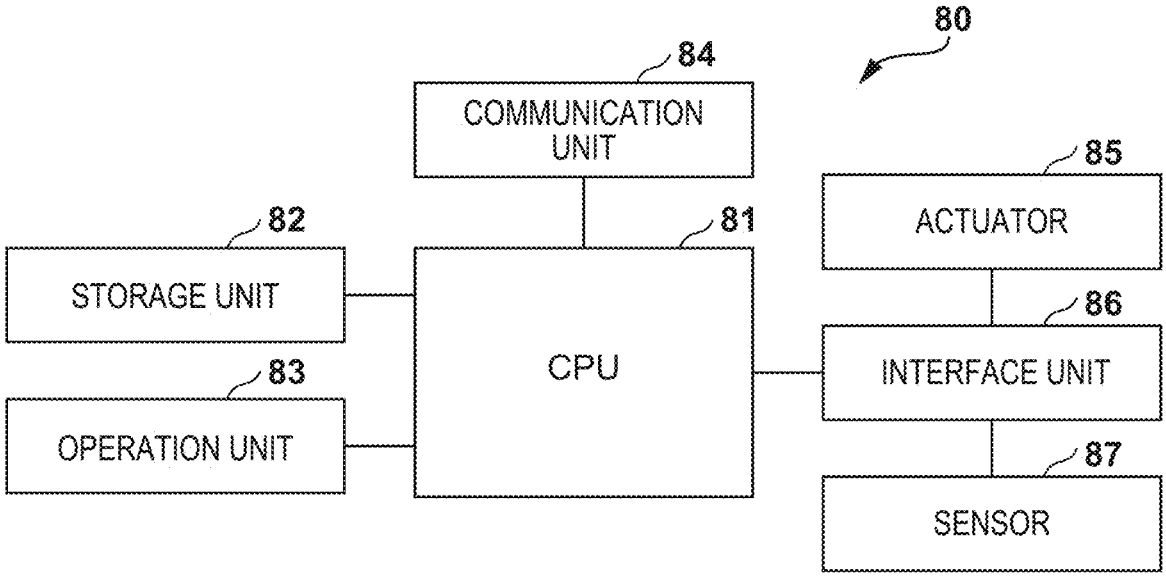
FIG. 2 is a block diagram showing a control unit of the image reading apparatus shown in FIG. 1.

A control unit 80 will be described with reference to FIG. 2. FIG. 2 is a block diagram showing the control unit 80 of the image reading apparatus A.

The control unit 80 includes a CPU 81, a storage unit 82, an operation unit 83, a communication unit 84, and an interface unit 86. The CPU 81 controls the overall image reading apparatus A by executing a program stored in the storage unit 82. The storage unit 82 is formed from, for example, a RAM or a ROM. The operation unit 83 is formed by, for example, a switch or a touch panel, and accepts an operation from an operator.

The communication unit 84 serves as an interface that communicates information with an external apparatus. Assuming a PC (Personal Computer) as an external apparatus, examples of the communication unit 84 are a USB interface and a SCSI interface. Instead of such a wired communication interface, a wireless communication interface may be used as the communication unit 84, or both a wired communication interface and a wireless communication interface may be provided.

The interface unit 86 is an I/O interface that inputs/outputs data to/from an actuator 85 and a sensor 87. The actuator 85 includes the driving units 3 and 4 and the transfer unit 5. The sensor 87 includes the double feed detection sensor 40, the medium detection sensors 50 and 60, and the image reading units 70.

<Driving by Receiving Start Instruction from PC>

The basic operation of the image reading apparatus A will be described. Upon receiving an image reading start instruction from, for example, an external PC connected to the image reading apparatus A, the control unit 80 starts to drive the first to third conveyance units 10 to 30. The conveyance media S stacked on the mounting table 1 are conveyed one by one from the conveyance medium S at the lowest position.

<Control at Time of Double Feed>

During conveyance of the conveyance medium S, the double feed detection sensor 40 determines the presence/absence of double feed. If the absence of double feed is determined, conveyance is continued; otherwise, conveyance is stopped or feed of the succeeding conveyance medium S by the first conveyance unit 10 is stopped to discharge the conveyance media S in a double feed state.

<Start of Reading Based on Output from Registration Sensor>

At a timing based on the detection result of the medium detection sensor 60, the control unit 80 starts to cause the image reading unit 70 to read an image of the conveyance medium S conveyed by the second conveyance unit 20, primarily stores the read image, and transmits it to the external PC. The conveyance medium S whose image has been read is discharged by the third conveyance unit 30 to the discharge tray 2, thereby ending the image reading processing of the conveyance medium S.

<Discharge Structure>

Figure 3:
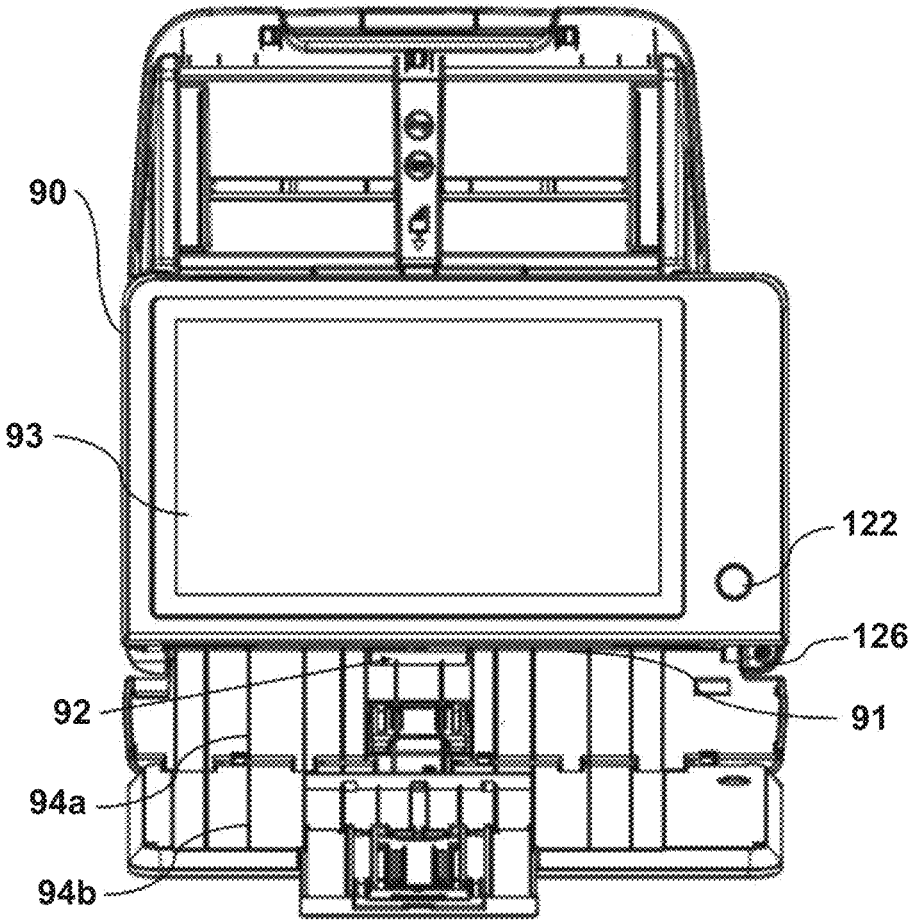
FIG. 3 is a front view showing the image reading apparatus according to the embodiment.
Figure 8:
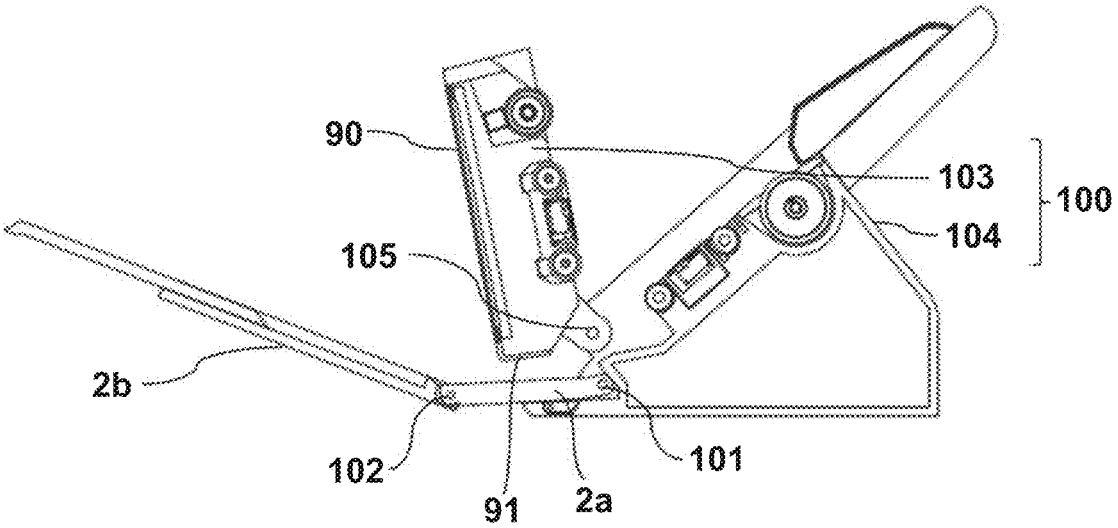
FIG. 8 is another schematic side sectional view showing the image reading apparatus according to the embodiment.

FIG. 3 is a front view showing a state in which the discharge tray 2 of the image reading apparatus A is opened according to the first embodiment of the present invention. FIG. 8 is a schematic sectional view showing a state in which the discharge tray 2 and an upper unit 103 of the image reading apparatus A are opened according to this embodiment.

A display screen 93 is provided on a display panel 90 in an upper front portion, and an operation key 122 is provided at an adjacent position.

A discharge opening 92 is provided as an example of the discharge port on a lower panel 91 in a lower front portion, to which the conveyance medium S conveyed by the third conveyance unit 30 is discharged.

Figure 4:
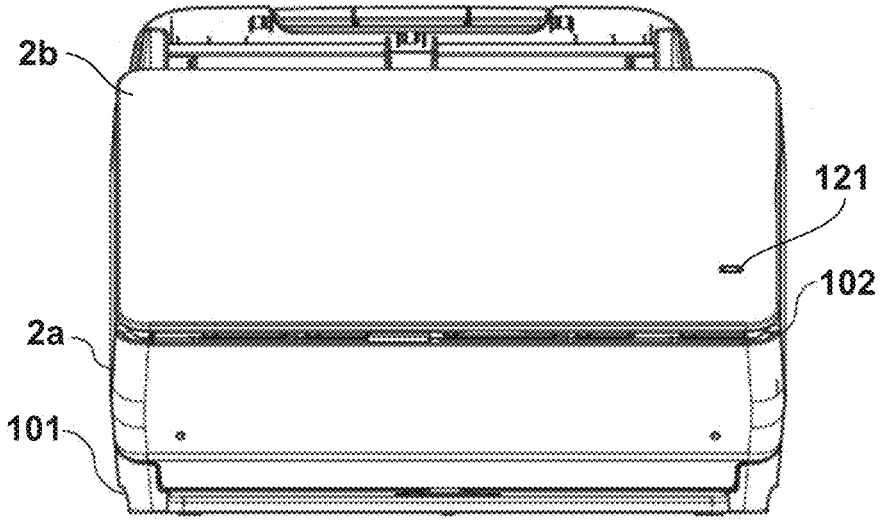
FIG. 4 is another front view showing the image reading apparatus according to the embodiment.
Figure 7:
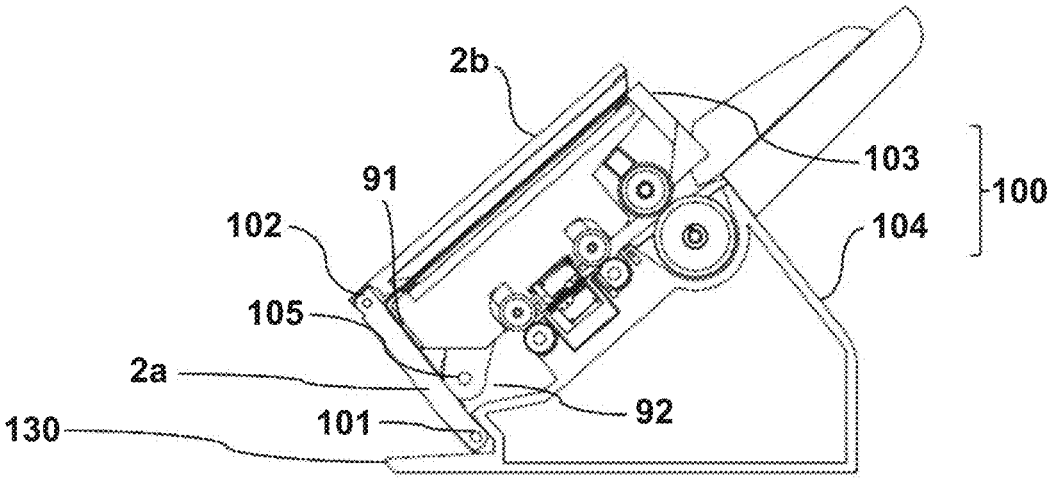
FIG. 7 is a schematic side sectional view showing the image reading apparatus according to the embodiment.

FIG. 4 is a front view showing a state in which the discharge tray 2 of the image reading apparatus A is stored according to this embodiment. FIG. 7 is a schematic sectional view showing a state in which the discharge tray 2 and the upper unit 103 of the image reading apparatus A are stored according to this embodiment.

The discharge tray 2 is axially supported via the first hinge 101 provided in the lower portion of the image reading apparatus A so as to be pivotable with respect to the image reading apparatus A, and is configured to cover the front surface of a main body 100 as an example of a housing with the first discharge tray 2*a* and the second discharge tray 2*b*.

The first discharge tray 2*a* is attached to the main body 100 of the image reading apparatus A to be pivotable about the first hinge 101. The first discharge tray 2*a* is formed in the same size as an area obtained by combining the lower panel 91 and the discharge opening 92, pivots about the first hinge 101 in the stored state of the discharge tray 2 shown in FIG. 4, and is folded to cover the lower panel 91 and the discharge opening 92.

The second discharge tray 2*b* is formed in the same size as that of the display panel 90, pivots about the second hinge 102 provided at the distal end of the first discharge tray 2*a* in the stored state of the discharge tray 2 shown in FIGS. 4 and 7, and is folded to overlap the display panel 90.

Figure 5A:
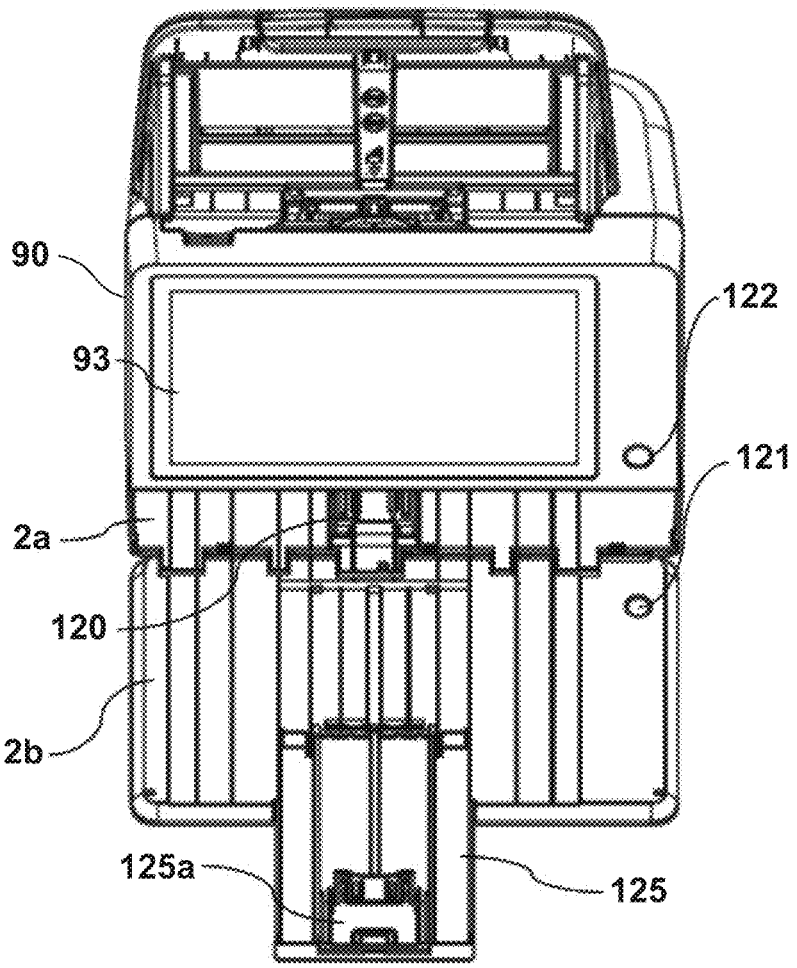
FIG. 5*a* is a plan view showing the image reading apparatus according to the embodiment.

FIG. 5*a* is a plan view showing a state in which the discharge tray 2 of the image reading apparatus A is opened according to this embodiment.

The conveyance medium S conveyed by the third conveyance unit 30 is discharged to the first discharge tray 2*a* via the discharge opening 92, and reaches and is guided to the second discharge tray 2*b* depending on the size of the conveyance medium S.

The first discharge tray 2*a* is provided with a discharge position adjustment member 120 to be pivotable. When, for example, the conveyance medium S of a small size with respect to the first discharge tray 2*a*, such as a business card, is discharged, the discharge position adjustment member 120 is made to pivot to an upright state to adjust a position at which the conveyance medium S stops, thereby making it possible to prevent the discharged conveyance media S from being scattered.

In addition, the second discharge tray 2*b* is provided with a translucent portion 121 that is arranged at a position overlapping the operation key 122 provided in the display panel. The operation key 122 is a power button that turns on/off the power of the main body, and is configured to be turned on in a power-on state. With the translucent portion 121 arranged at the position overlapping the operation key 122, it is possible to confirm whether the operation key 122 is in an ON state or an OFF state even in the stored state of the discharge tray 2, thereby confirming the power supply state of the image reading apparatus A.

With the above configuration, the discharge tray 2 functions as an exterior cover in the stored state, and the second discharge tray 2*b* functions as a protection cover that protects the display panel 90. Furthermore, when the discharge tray 2 is stored, the outer shape of the discharge tray 2 matches that of the main body 100, and the display screen 93 and the discharge opening 92 are hidden, thereby implementing a neat appearance of the overall apparatus in which flat surfaces are connected. This makes it easy to provide a design of colors and patterns on the flat surfaces.

An operation unit touched by the user, such as the operation key 122 and a touch panel attached to the display screen 93, the display screen 93 serving as a display unit seen by the user at the time of use of the apparatus, and the discharge opening 92 can be exposed/stored by one operation by opening/closing the discharge tray 2, and thus the apparatus is readily prepared/stored. In this embodiment, the operation key 122 is provided as a push-type power button in the apparatus main body. To further improve the user convenience, ON/OFF of the power of the apparatus main body may be switched by detecting the opening/closing operation of the discharge tray 2.

As shown in FIG. 3, the first discharge tray 2*a* and the second discharge tray 2*b* are provided with a plurality of linear ribs 94*a* and 94*b* parallel to the conveyance direction, respectively. When the leading edge of the discharged conveyance medium S reaches the first discharge tray 2*a*, the leading edge of the conveyance medium S is made to abut against the rib 94*a* provided in the first discharge tray 2*a*, thereby reducing friction between the conveyance medium S and the discharge tray 2. The discharge tray 2 according to this embodiment is configured so that the first discharge tray 2*a* and the second discharge tray 2*b* form a predetermined angle to align, as easily as possible, the trailing edge of the conveyance medium S which has reached the second discharge tray 2*b*. Even after the conveyance medium S abuts against the first discharge tray 2*a*, the conveyance medium S is conveyed by the second conveyance unit 20 and the third conveyance unit 30 to reach the boundary between the first discharge tray 2*a* and the second discharge tray 2*b*. However, Even if the predetermined angle is formed at the boundary between the first discharge tray 2*a* and the second discharge tray 2*b*, it is possible to convey the conveyance medium S smoothly by continuously providing the ribs 94*a* and 94*b* to overlap each other so that the conveyance medium S contacts the rib 94*b* while contacting the rib 94*a*.

The discharge tray 2 according to this embodiment is provided with a mechanism for allowing, when storing the discharge tray 2, the discharge tray 2 to be reliably stored without floating from the main body 100.

In a configuration in which an original table is bent in two, if the original table is stored while being placed on an inclined upper surface of the apparatus main body, the original table may float from the apparatus main body. This embodiment makes it difficult to keep the discharge tray floating from the apparatus main body in the stored state.

Figure 11A:
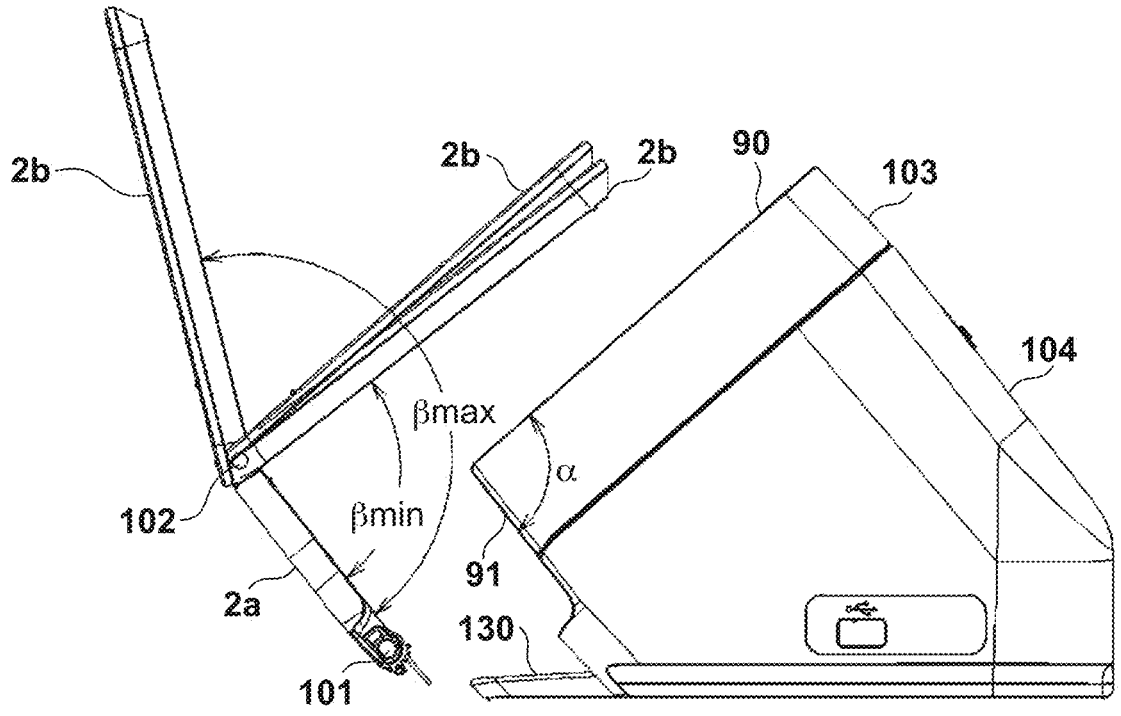
FIG. 11*a* is a side view showing the relationship between a main body angle and a bending angle of the discharge tray according to the embodiment.
Figure 11B:
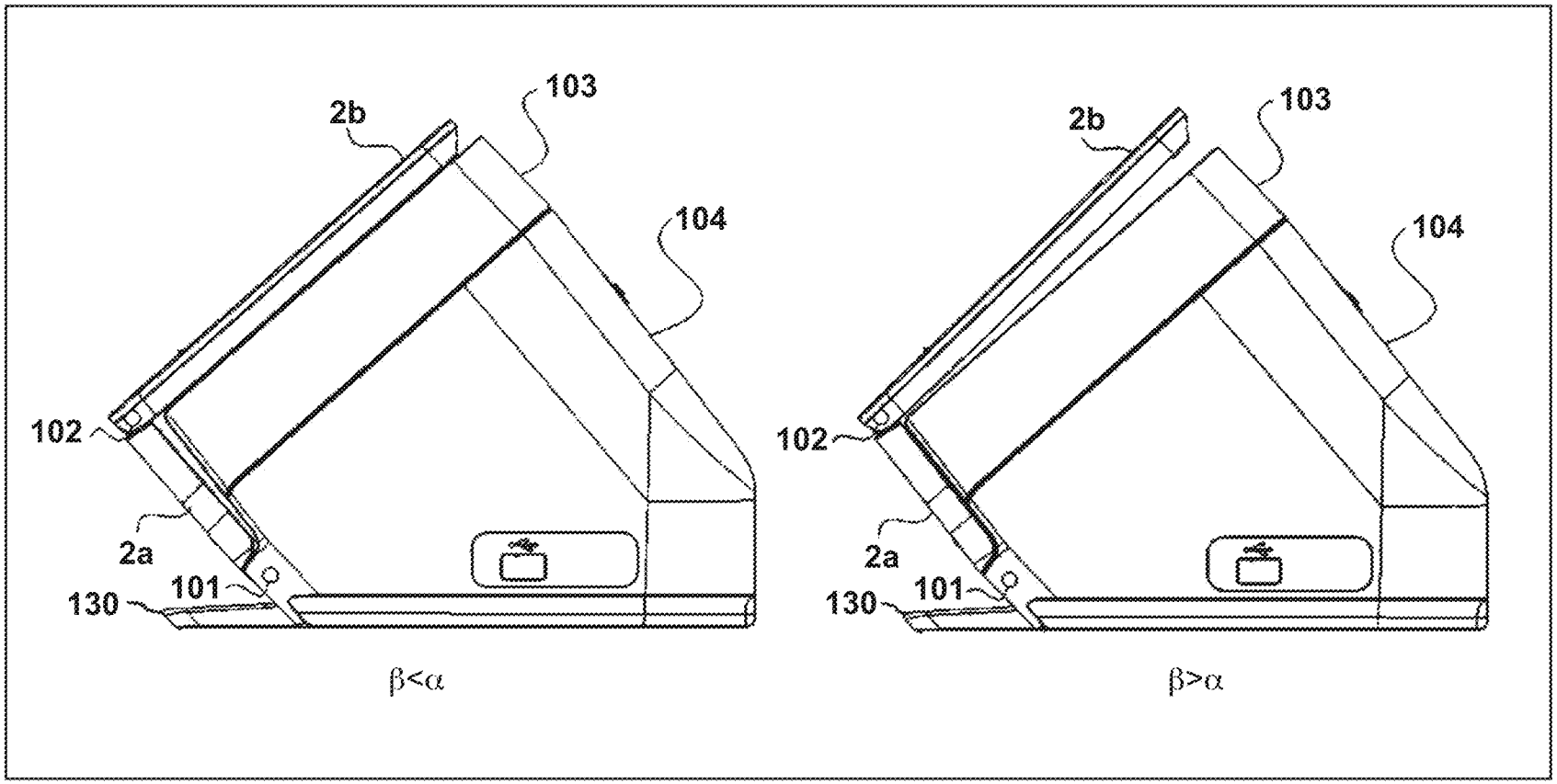
FIG. 11*b* is a side view showing the relationship between the bending angle of the discharge tray and the stored state of the discharge tray according to the embodiment.

FIGS. 11*a* and 11*b* are side views each showing the stored state of the discharge tray 2.

As described above, the discharge tray 2 is formed by the two, first and second discharge trays 2*a* and 2*b*, and is bent with the second hinge 102 as a center. A bending angle β formed by the conveyance surfaces of the first discharge tray 2*a* and the second discharge tray 2*b* changes within the range of βmin to βmax. The bending angle β in a state in which the discharge tray 2 is used as a discharge tray on which the conveyance medium S is placed is the maximum bending angle βmax. The bending angle β in a state in which the discharge tray 2 is stored is equal to a main body angle α conforming to the main body 100. If the bending angle β is larger than the main body angle α, the discharge tray floats from the main body at the time of storage. Thus, in consideration of a variation in dimensional tolerance, the minimum bending angle βmin is set to be smaller than the main body angle α.

In the image reading apparatus according to this embodiment, when the discharge tray 2 is stored, the barycenter of the second discharge tray 2*b* is on the rear side of the apparatus with respect to the second hinge 102, and the second discharge tray 2*b* receives a force in a direction, in which the bending angle β becomes small, by the weight of the second discharge tray 2*b* at the time of storing the discharge tray 2. The barycenter of the overall discharge tray 2 at the time of storage is on the front side of the apparatus with respect to the first hinge 101. Therefore, to store the discharge tray 2 without floating from the main body 100, it is necessary to apply a force in a direction in which the overall discharge tray 2 is closed until the bending angle β of the discharge tray 2 becomes equal to the main body angle α, thereby lifting up the second discharge tray 2*b*.

Figure 12A:
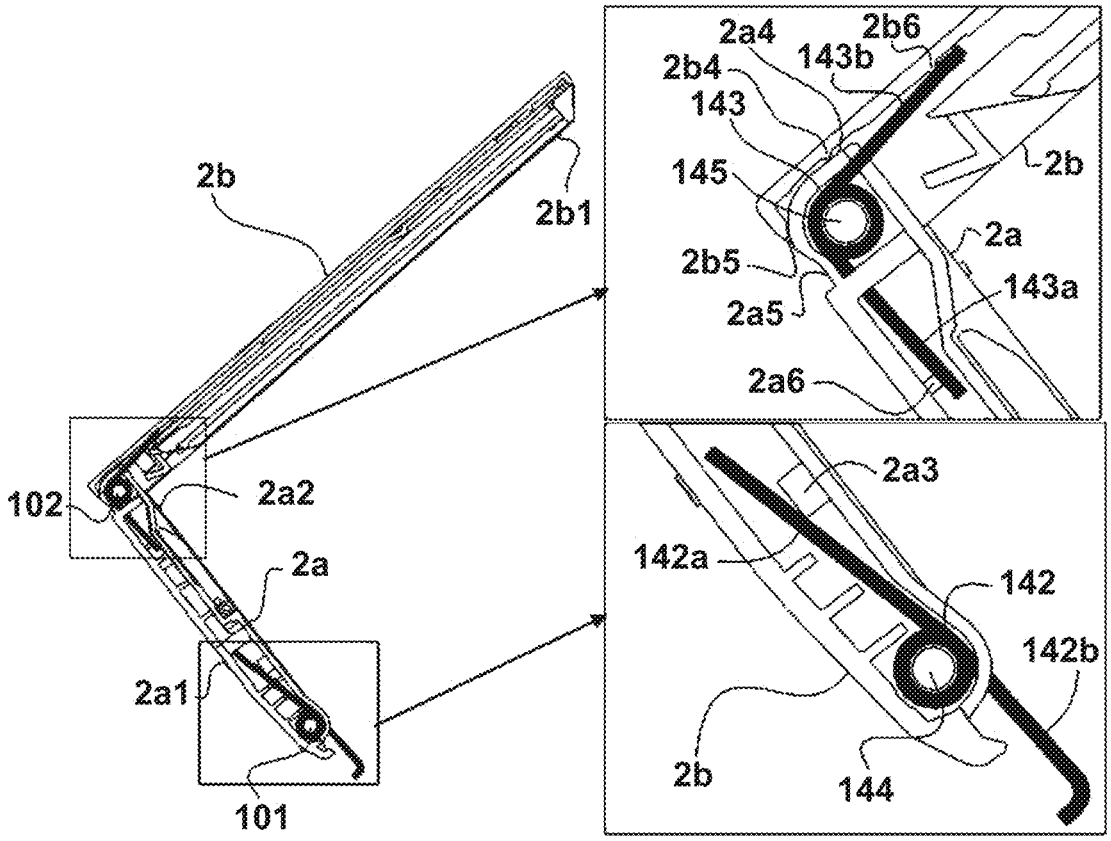
FIG. 12*a* is a schematic sectional view showing the stored state of the discharge tray according to the embodiment.
Figure 12B:
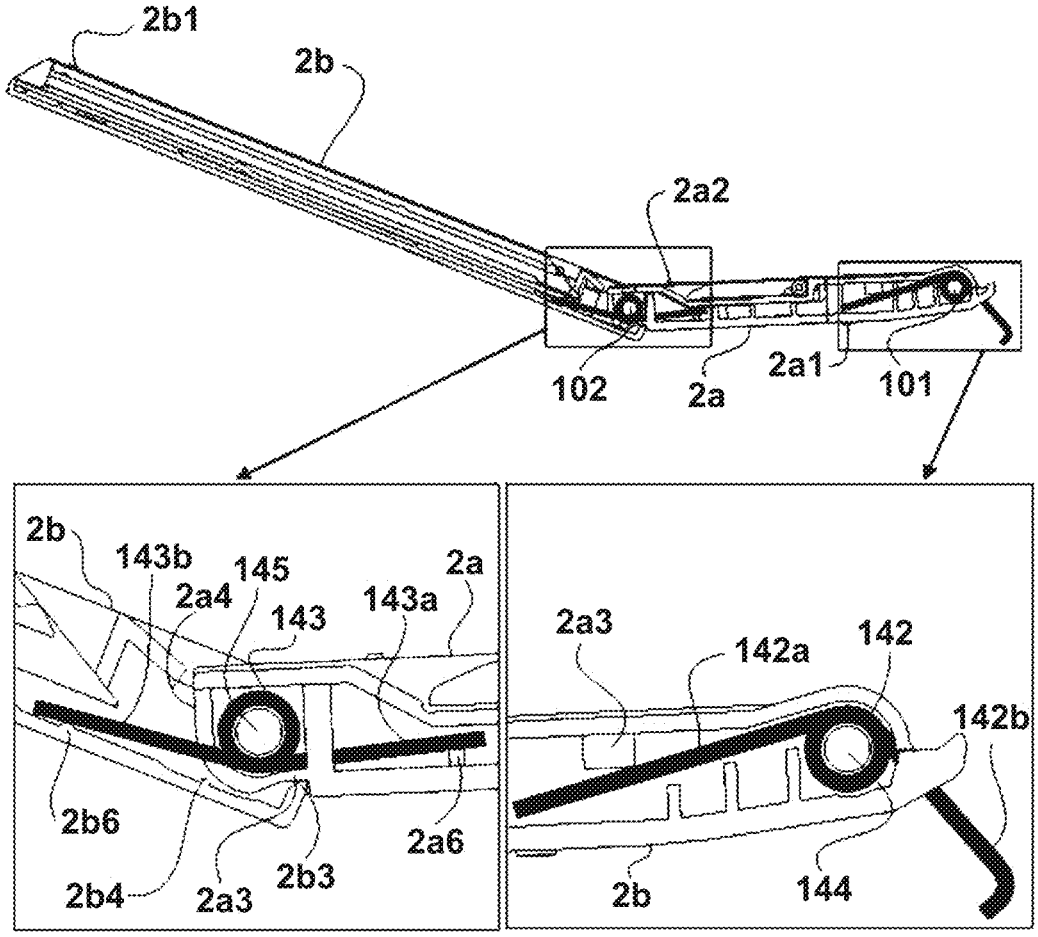
FIG. 12*b* is a schematic sectional view showing the use state of the discharge tray according to the embodiment.

FIGS. 12*a* and 12*b* are schematic sectional views each showing the discharge tray.

In this embodiment, a first torsion spring 142 is arranged at the center of rotation of the first hinge 101 to generate a force for drawing the overall discharge tray 2 into the stored state, and a second torsion spring 143 is arranged at the center of rotation of the second hinge 102 to reduce, by the weight of the first discharge tray 2*a*, a force acting in a direction in which the bending angle β becomes small.

The first discharge tray 2*a* is provided with a butting surface 2*a*1 that butts against a protruding portion 130 shown in FIG. 11*b* when the discharge tray 2 is opened and a butting surface 2*a*2 that butts against the lower panel 91 when the discharge tray 2 is stored, thereby limiting a pivoting range.

The first torsion spring 142 is fixed to the first discharge tray 2*a* via a first shaft 144 passing through the center of the first torsion spring 142. An arm 142*a* at one end of the first torsion spring 142 presses a biasing portion 2*a*3 provided in the first discharge tray 2*a*. An arm 142*b* provided on the opposite side of the arm 142*a* of the first torsion spring protrudes from the discharge tray 2, and presses a biasing portion (not shown) provided in the protruding portion 130. This always biases the discharge tray 2 to be stored. The first torsion spring 142 generates a drawing force for reliably drawing the discharge tray 2 into the main body 100 when the discharge tray 2 is stored. Furthermore, the first torsion spring 142 reduces momentum generated when the discharge tray 2 is opened. Since the deflection amount of the first torsion spring 142 changes depending on whether the discharge tray 2 is stored or opened, it is possible to select a spring having a pressing force appropriate for both the cases by adjusting a spring constant. The pressing force of the first torsion spring 142 is set so as to reliably draw the discharge tray 2 when the discharge tray 2 is stored and prevent the discharge tray 2 from floating when the discharge tray 2 is opened. The rotation torque of the first torsion spring 142 when the discharge tray 2 is opened is desirably set to 70% to 90% of a rotation moment generated around the first hinge 101 by the weight of the discharge tray 2 when the discharge tray 2 is opened.

The second discharge tray 2*b* is provided with a butting surface 2*b*1 that butts against the display panel 90 at the time of storage. When the bending angle β of the discharge tray 2 is βmin, a butting surface 2*a*4 of the first discharge tray 2*a* butts against a butting surface 2*b*4 of the second discharge tray 2*b*. When the discharge tray 2 is opened, a butting surface 2*a*5 of the first discharge tray 2*a* butts against a butting surface 2*b*5 of the second discharge tray 2*b*. The pivotable range of the bending angle β is limited to the range of βmin to βmax.

The second torsion spring 143 is fixed to the first discharge tray 2*a* via a second shaft 145 passing through the center of the second torsion spring 143. An arm 143*a* at one end of the second torsion spring 143 presses a biasing portion 2*a*6 provided in the first discharge tray 2*a*. An arm 143*b* provided on the opposite side of the arm 143*a* of the second torsion spring 143 protrudes from the first discharge tray 2*a*, and presses a biasing portion 2*b*6 provided in the second discharge tray 2*b* to bias it in a direction in which the bending angle β of the discharge tray 2 becomes large. This reduces a load when drawing the discharge tray 2 in the storing direction, and prevents the second discharge tray 2*b* from quickly falling to the display panel 90 when the discharge tray 2 is closed. Furthermore, since an operating force when the discharge tray 2 is opened is reduced, and the second discharge tray 2*b* is biased in the direction in which the bending angle β of the discharge tray 2 becomes large, the overall discharge tray 2 readily, integrally moves in a state in which it is extended to some extent or completely, thereby improving operational feeling. Since the deflection amount of the second torsion spring 143 changes depending on whether the discharge tray 2 is stored or opened, it is possible to select a spring having a pressing force appropriate for both the cases by adjusting a spring constant. The pressing force of the second torsion spring 143 is set to prevent the second discharge tray 2*b* from floating when the discharge tray 2 is stored.

According to this embodiment, a rotation moment in the storing direction by weight of the discharge tray 2*b* is smaller as the second discharge tray 2*b* is closer to an upright state, and becomes 0 in the upright state.

Note that if the rotation moment of the second torsion spring 143 when the discharge tray 2 is stored is set smaller than the rotation moment caused by the weight of the second discharge tray 2*b*, there is a portion where the second torsion spring 143 and the second discharge tray 2*b* are balanced, and the second discharge tray 2*b* can unwantedly be held in a state in which the second discharge tray 2*b* floats from the display panel 90 in the balance portion. If, however, the second discharge tray 2*b* pivots in the storing direction at a certain speed, the second discharge tray 2*b* passes through the balance portion before the speed attenuates to become 0. Thus, this situation never occurs as long as the user intentionally stops the second discharge tray 2*b* in the balance portion.

In this embodiment, to make it more difficult to cause this phenomenon, the balance portion is set at a position close to the stored state of the second discharge tray 2*b*. Thus, if the user takes his/her hand off the second discharge tray 2*b* during storage of the discharge tray 2, the pivoting speed of the second discharge tray 2*b* becomes high when the second discharge tray 2*b* is about to enter a balance state, thereby hardly causing a situation in which the second discharge tray 2*b* stops at the balance portion. The difference in angle of the second discharge tray 2*b* between the stored state and the balance portion is desirably set to less than 5°.

By setting the rotation moment of the second torsion spring 143 when the bending angle β of the discharge tray 2 is the maximum bending angle βmax so as to prevent the discharge tray 2 from bending by its own weight when the distal end of the discharge tray 2 in the open state is lifted up from below, the discharge tray 2 moves integrally at the time of an operation, thereby making it possible to improve operational feeling.

Note that according to this embodiment, one first torsion springs 142 may be provided in the discharge tray 2 or a plurality of springs may be coaxially arranged. Similarly, one second torsion spring 143 may be provided or a plurality of springs may be coaxially arranged. The first torsion spring 142 and the second torsion spring 143 may be leaf springs, wire springs, or coil springs, instead of the torsion springs.

In this embodiment, one torsion spring is arranged on each side of the discharge tray 2 to sandwich the conveyance path RT.

With the above-described configuration, the operational feeling and storage property of the discharge tray 2 are improved with a simple configuration without using any strong spring or damper.

To reduce an impact when the discharge tray 2 is opened/closed, an oil damper or torque limiter can be added to one or both of the first hinge 101 and the second hinge 102, thereby improving the operational feeling. In this embodiment, an oil damper is provided in the first hinge 101. However, it is possible to improve the operability without using the oil damper. Furthermore, even if the damper is used, it is possible to reduce the necessary torque of the damper by using a spring, thereby implementing downsizing and reducing the cost.

The conveyance medium S conveyed by the third conveyance unit 30 is discharged to the first discharge tray 2*a* via the discharge opening 92, and reaches and is guided to the second discharge tray 2*b* depending on the size of the conveyance medium S.

The second discharge tray 2*b* has a configuration in which the downstream side is lifted up so as to prevent the sequentially discharged conveyance media S from being pushed out of the tray. Since the conveyance path RT of the conveyance medium S in the apparatus main body is arranged to be low on the downstream side, the conveyance medium S is discharged while bending. If the traveling direction of the conveyance medium S suddenly changes, the conveyance medium S may become rounded at a bending point or at the time of discharge since the conveyance medium S is caught due to friction between the conveyance media S. To reliably receive the leading edge of the discharged conveyance medium S and smoothly transfer it to the second discharge tray 2*b*, the first discharge tray 2*a* has a shape and an angle obtained by gradually joining the conveyance path of the conveyance medium S.

As described above, the discharge tray 2 provided in the apparatus according to this embodiment is configured to bend about the first hinge 101. Therefore, the bending angle β of the discharge tray 2 can be differently set for each of a case in which the discharge tray is stored and a case in which the discharge tray is in use, thereby achieving both the discharge aligning property and the outer appearance at the time of storage. As described above, in the apparatus according to this embodiment, the discharged conveyance medium S collides against the first discharge tray 2*a*, and is guided to the second discharge tray 2*b* held at an angle different from that of the first discharge tray 2*a*. When the conveyance medium S moves from the first discharge tray 2*a* to the second discharge tray 2*b*, the traveling direction is changed to reduce momentum, thereby improving the alignment property.

Furthermore, when the first discharge tray 2*a* has the same size as that of the combination of the lower panel 91 and the discharge opening 92, and is stored to cover the entire surface of the lower panel 91 and the discharge opening 92 in the stored state of the discharge tray 2, the fine appearance in the stored state is not degraded. In addition, in the state in which the discharge tray 2 is opened, the conveyance medium S discharged from the discharge opening 92 can be reliably received by the first discharge tray 2*a*. Therefore, it is possible to more effectively produce the effect that the speed of the conveyance medium S can be decreased to improve the alignment property of the conveyance medium S by receiving the conveyance medium S by the first discharge tray 2*a* and changing the traveling direction of the discharged first discharge tray 2*a* when moving to the second discharge tray 2*b*.

The second discharge tray 2*b* has a length of 178 mm in the conveyance direction and a width of 300 mm to cover the entire surface of the display panel 90. The first discharge tray 2*a* has a length of 84 mm in the conveyance direction and a width of 301 mm to cover the entire surface of the lower panel 91 and the discharge opening 92 below the inclined upper surface portion (display panel 90). The width of the first discharge tray 2*a* is almost equal to that of the second discharge tray 2*b* and the length of the first discharge tray 2*a* in the conveyance direction is shorter than that of the second discharge tray 2*b*. Thus, if the short conveyance medium S is conveyed, the leading edge of the discharged conveyance medium S readily collides against the second discharge tray 2*b* steeper than the first discharge tray 2*a* to reduce the speed, thereby preventing the discharged conveyance medium S from jumping out to the downstream side in the conveyance direction. The first discharge position adjustment member 120 is provided at almost the center of the first discharge tray 2*a* in the width direction with respect to the conveyance path RT to pivot to be upright. When, for example, the conveyance medium S of a small size, such as a business card, is discharged to the first discharge tray 2*a*, the first discharge position adjustment member 120 is made to pivot to an upright state to adjust a position at which the conveyance medium S stops, thereby making it possible to prevent the discharged conveyance media S from being scattered.

An extension portion 125 is provided at almost the center of the second discharge tray 2*b* in the width direction with respect to the path RT, and a second discharge position adjustment member 125*a* is provided at almost the center of the extension portion 125 to be movable in a direction along the conveyance path RT and to pivot to be upright from the extension portion 125. The second discharge position adjustment member 125*a* can adjust a position at which the discharged conveyance medium S stops, thereby improving the aligning property of the conveyance medium S.

The discharge tray needs to have a size to the extent that a sheet discharged from the apparatus is stacked stably. Especially, a discharge tray provided in a sheet conveyance apparatus for conveying a sheet from the upper rear side to the lower front side of the apparatus protrudes to the front side of the apparatus, thereby increasing the placement area of the apparatus. To the contrary, in this embodiment, it is possible to improve the stackability of the discharge tray and reduce the placement area, and also improve the discharge alignment property of the discharge tray.

The second discharge tray 2*b* will now be described.

Figure 9A:
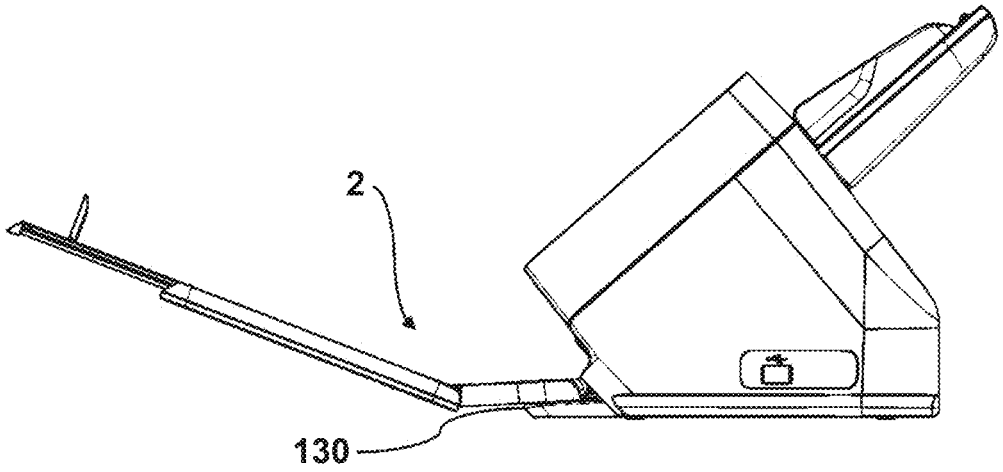
FIG. 9*a* is a side view showing the image reading apparatus according to the embodiment.
Figure 9B:
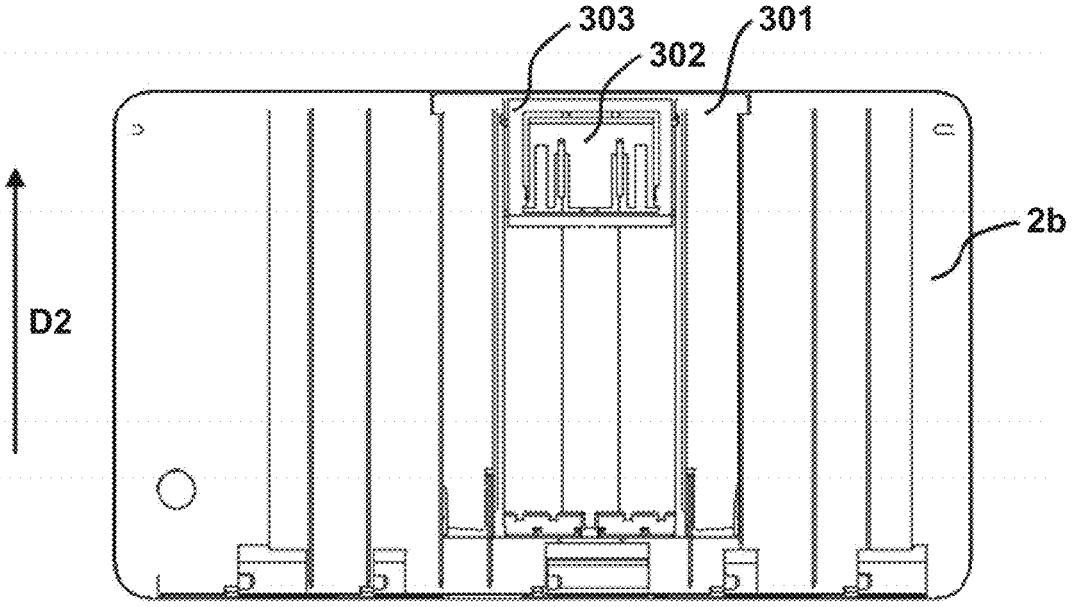
FIG. 9*b* is a partial plan view showing the discharge tray according to the embodiment.

FIG. 9*b* is a plan view showing a state in which the second discharge tray 2*b* of the image reading apparatus A is opened according to this embodiment.

The second discharge tray 2*b* includes an extension tray 301, a medium stopper 302, and a stopper base 303.

When the image reading apparatus A is not in use, the discharge tray 2 is closed, as shown in FIG. 7. At the time of sheet conveyance, the image reading apparatus A is used in the state in which the discharge tray 2 is opened, as shown in FIG. 8.

The extension tray 301 is incorporated in the second discharge tray 2*b*, and is attached to be movable in parallel to a discharge direction D2 by a rail member (not shown). The moving amount of the extension tray 301 can be adjusted in accordance with the length of the discharged conveyance medium S.

The medium stopper 302 receives the leading edge of the conveyance medium S discharged by the feeding mechanism to align the conveyance medium S. The stopper base 303 is incorporated in the extension tray 301, as shown in FIG. 9*b*, and can move in parallel to the discharge direction D2 by a rail member (not shown) to adjust the position of itself in accordance with the length of the conveyance medium S.

The configuration of the medium stopper 302 will be described next.

Figure 9C:
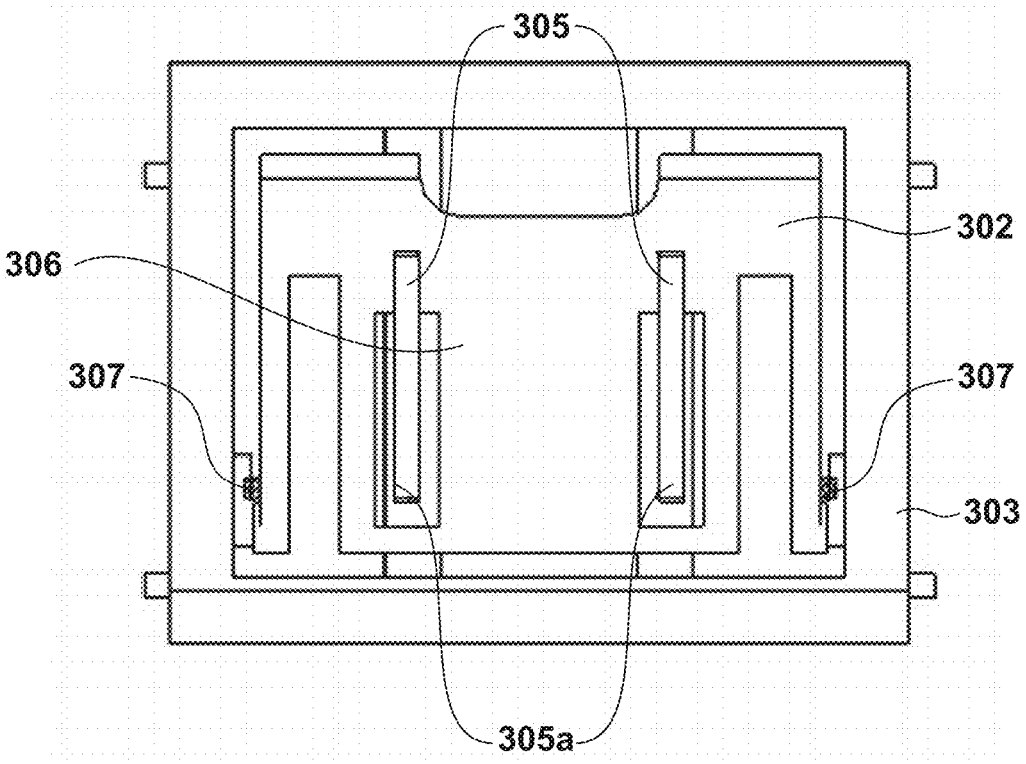
FIG. 9*c* is a plan view showing a medium stopper according to the embodiment.

FIG. 9*c* is a partial plan view showing the second discharge tray 2*b* according to this embodiment.

Figure 9D:
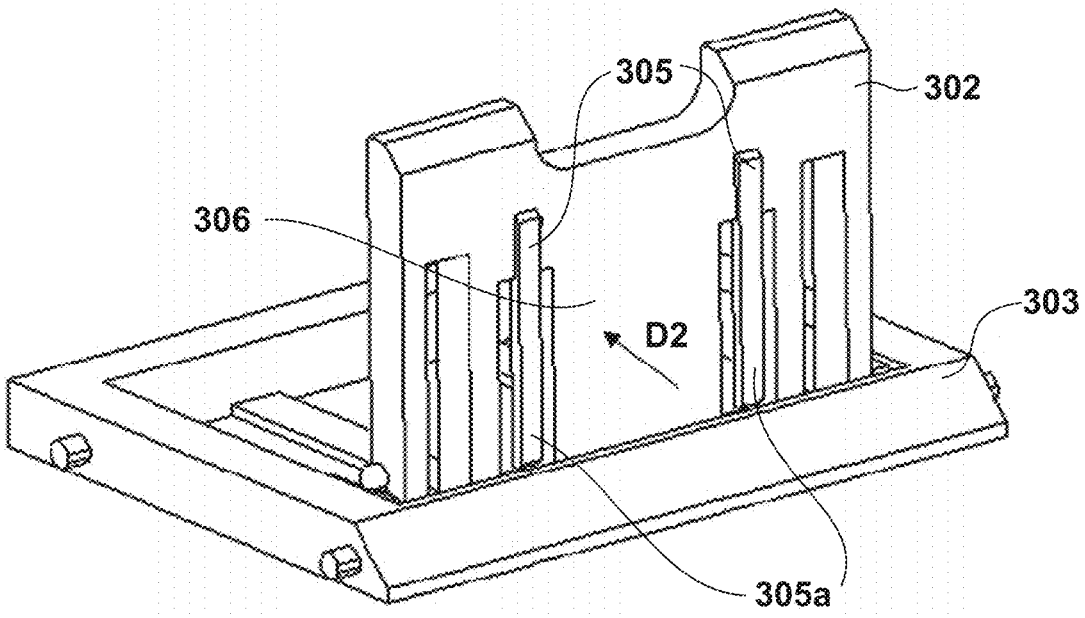
FIG. 9*d* is a perspective view showing the medium stopper according to the embodiment.

FIG. 9*d* is a partial perspective view showing the second discharge tray 2*b* according to this embodiment.

Figure 9E:
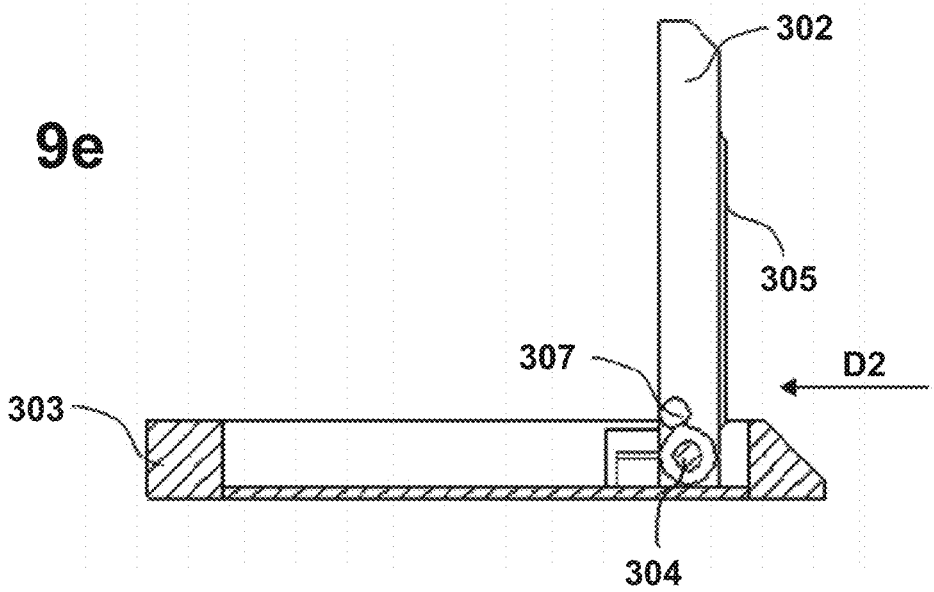
FIG. 9*e* is a sectional view showing the medium stopper according to the embodiment.

FIG. 9*e* is a sectional view showing a state in which the medium stopper 302 of the second discharge tray 2*b* is upright according to this embodiment.

Figure 9F:
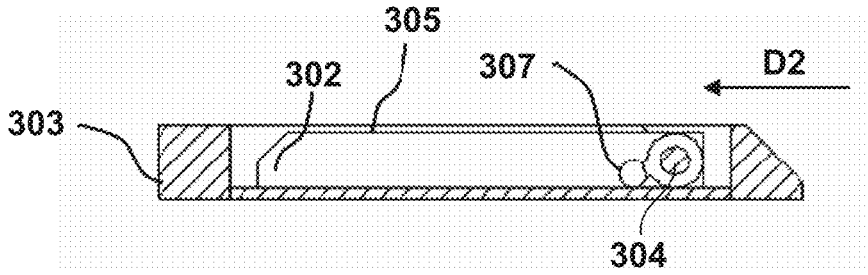
FIG. 9*f* is a sectional view showing the medium stopper according to the embodiment.

FIG. 9*f* is a sectional view showing a state in which the medium stopper 302 of the second discharge tray 2*b* is stored according to this embodiment.

As shown in FIGS. 9*c* and 9*d*, the medium stopper 302 is incorporated in the stopper base 303, and attached to be rotatable about a rotating shaft 304 of the medium stopper 302. If the medium stopper 302 is used, the apparatus is used in a state in which the medium stopper 302 stands upright, as shown in FIG. 9*e*. If no medium stopper 302 is used, the apparatus is used in a state in which the medium stopper 302 is stored to be flush with the stopper base 303, as shown in FIG. 9*f*. The medium stopper 302 is provided with a click portion 307 near the rotating shaft 304, and the click portion 307 can keep the upright state by crossing the convex portion (not shown) of the stopper base 303.

The medium stopper 302 is made of a synthetic resin such as acrylonitrile butadiene styrene (ABS), polystyrene (PS), or polycarbonate (PC). By forming a structure (to be described later) with the material, it is possible to reduce the impact of the conveyance medium S caused by excessive elastic deformation.

The shape of the medium stopper 302 will be described next.

Figure 9G:
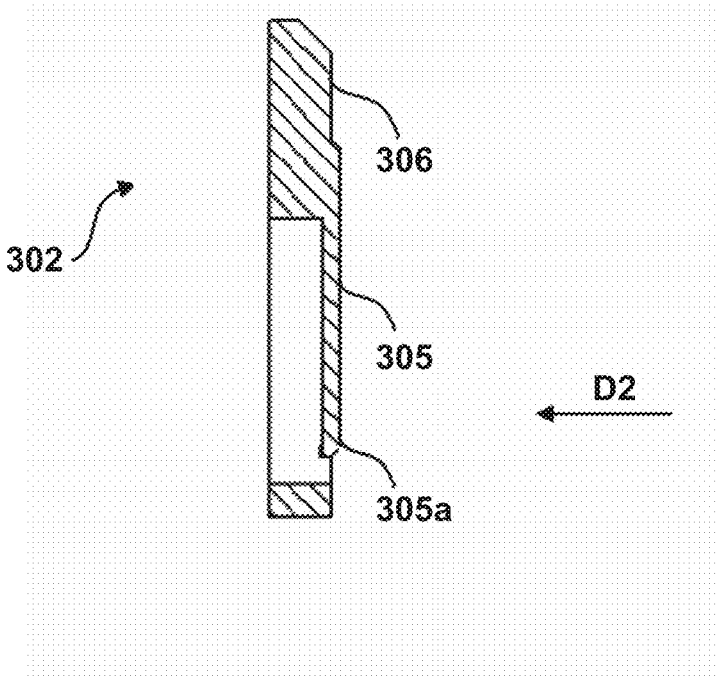
FIG. 9*g* is a sectional view showing the medium stopper according to the embodiment.

FIG. 9*g* is a sectional view showing the medium stopper 302 according to this embodiment.

Figure 9H:
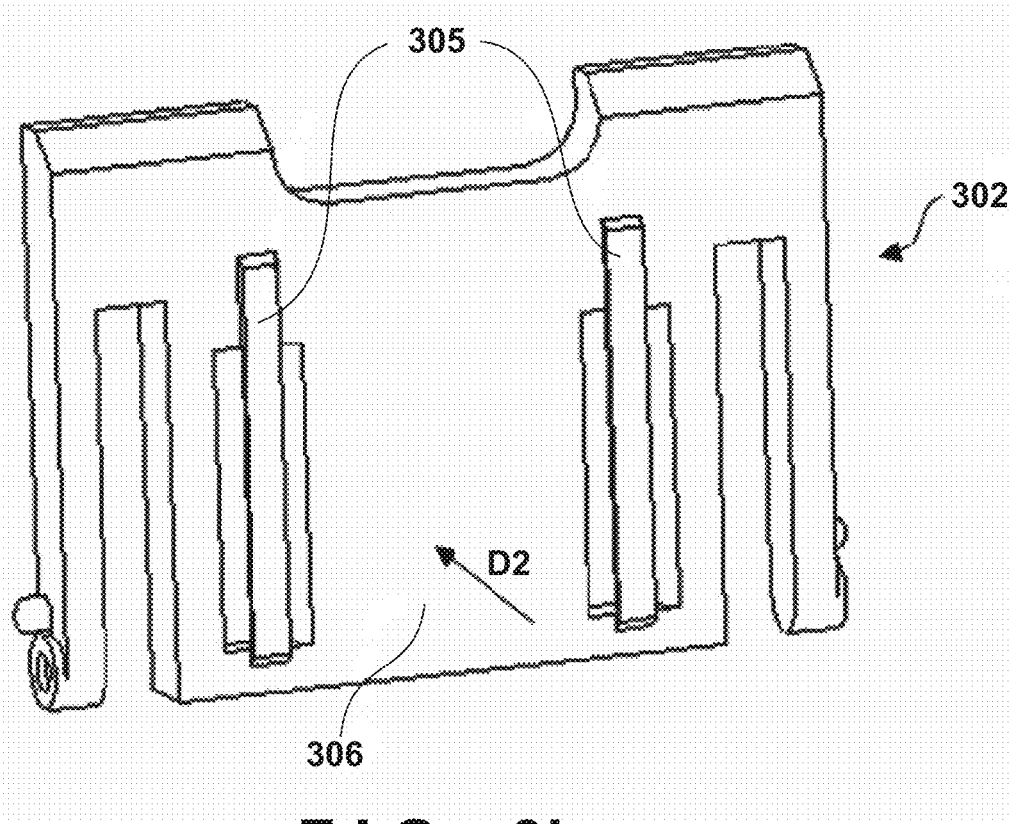
FIG. 9*h* is a perspective view showing the medium stopper according to the embodiment.

FIG. 9*h* is a perspective view showing the medium stopper 302 according to this embodiment.

The medium stopper 302 includes a pair of left and right medium abutting portions 305 that receive the conveyance medium S discharged and arriving from the discharge direction D2. The medium abutting portions 305 are higher than a stopper surface (a surface other than the medium abutting portions) 306 by one stage, and are arranged at positions against which the discharged conveyance medium abuts first. The upright medium abutting portions 305 are linear portions extending toward the stopper base 303 on the stopper surface 306, and are configured to extensively receive the leading edge of the conveyance medium S. That is, since the medium abutting portions 305 extend in the vertical direction as linear portions, they readily absorb an impact even if the discharged conveyance medium S collides against the medium stopper 302 at any height.

A lower end portion 305*a* of each medium abutting portion 305 is provided to be displaceable by elastically deforming in the discharge direction D2, and absorbs collision energy when the leading edge of the discharged conveyance medium S collides against the lower end portion 305*a*. The medium abutting portion 305 need only be provided at at least one position, and a plurality of medium abutting portions 305 can be arranged. If a plurality of medium abutting portions 305 are arranged, they are preferably, bilaterally symmetrically arranged. As for the displacement position of the medium abutting portion 305, the left, right, upper, or lower end portion of the medium abutting portion may be displaced in accordance with the position of the discharged conveyance medium.

As an example of the arrangement of the medium abutting portions 305, as shown in FIG. 9*d*, the plurality of medium abutting portions 305 are preferably provided at a predetermined distance in the width direction in the discharge direction D2.

Note that the discharged conveyance medium S abuts against the medium stopper 302 in the upright state. However, in the abutting state, the medium stopper 302 is preferably upright with slight play about the rotating shaft 304.

By adopting the configuration of the medium stopper according to this embodiment in which the medium stopper is set in the upright state by pivoting in the discharge direction D2, the medium stopper 302 is configured to have room to pivot after the medium abuts against it. However, even if the medium stopper is configured to pivot in a direction opposite to that in this embodiment, the medium stopper 302 biased by the discharged conveyance medium S need only slightly pivot. This can reduce damage to the discharged conveyance medium S and an impulsive sound.

As shown in FIG. 9*a*, the second discharge tray 2*b* has a downstream-side end that faces upward. After the leading edge of the discharged conveyance medium S butts against the medium abutting portions 305, the conveyance medium S returns to the conveyance upstream side. Thus, when the subsequently discharged conveyance medium S abuts against the medium stopper 302, the previously discharged conveyance medium S does not remain near the medium abutting portion 305, and the discharged conveyance medium S can be made to abut against the medium abutting portions 305. Therefore, even if the plurality of conveyance media S are stacked on the discharge tray 2, collision energy can always be absorbed.

With the above-described configuration, when the leading edge of the discharged conveyance medium S passes through the discharge tray 2, and collides against the medium abutting portions 305 of the medium stopper 302, the lower end portions 305*a* of the medium abutting portions 305 shown in FIG. 9*g* can be made to abut against the conveyance medium S, and the lower end portions 305*a* can be displaced in the discharge direction D2 to absorb collision energy, thereby reducing a collision sound. Furthermore, the medium stopper 302 is made rotatable, and is arranged to flush with the stopper base 303 when the medium stopper is not in use. Thus, even if a long sheet out of a medium stopper use range is conveyed, it can be conveyed without any jam or damage to the conveyance medium S.

Figure 9I:
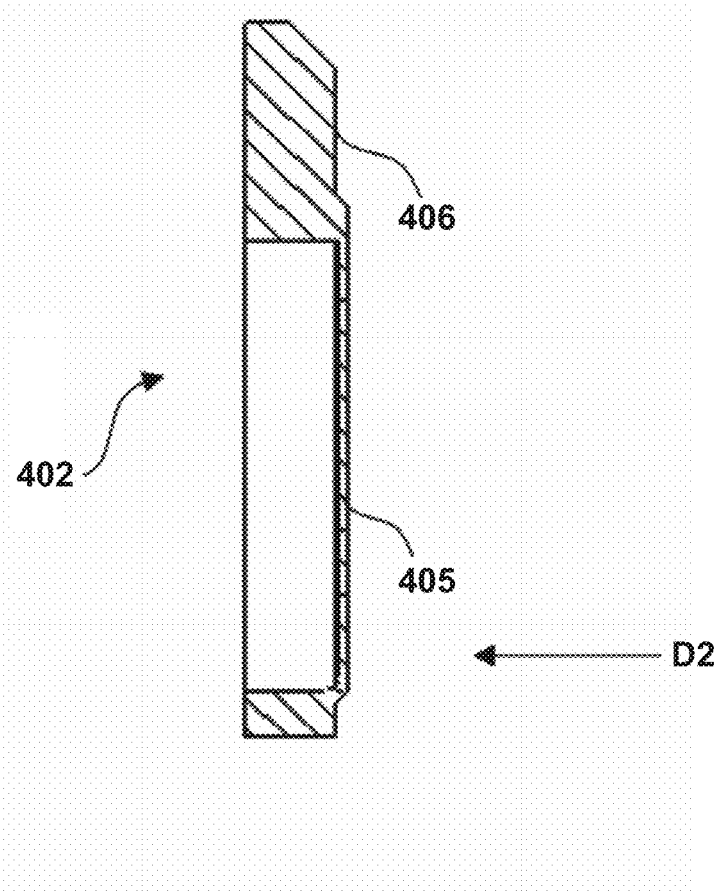
FIG. 9*i* is a sectional view showing a medium stopper according to a modification of the embodiment.

FIG. 9*i* is a sectional view showing a medium stopper 402 according to a modification of this embodiment.

The medium stopper 402 includes a medium abutting portion 405 that receives the discharged conveyance medium S. The medium abutting portion 405 is higher than a medium stopper surface (a surface other than the medium abutting portion) 406 by one stage, and is arranged at a position where the discharged conveyance medium S contacts first. The medium abutting portion 405 is provided to be displaceable in the discharge direction D2 by elastically deforming, and absorbs collision energy when the leading edge of the discharged conveyance medium S collides against the medium abutting portion 405. In this embodiment, a collision sound is absorbed by displacing the upper or lower ends of the medium abutting portions 305. In the modification, however, since a collision sound is absorbed by the entire surface of the medium abutting portion 405, it is possible to equally reduce a collision sound regardless of a position where the discharged conveyance medium S abuts against the medium abutting portion 405, thereby facilitating design. In addition, the lower end portions 305*a* of the medium abutting portions 305 can be eliminated. Thus, it is possible to prevent damage caused when something gets caught in the medium abutting portion 405.

Figure 9J:
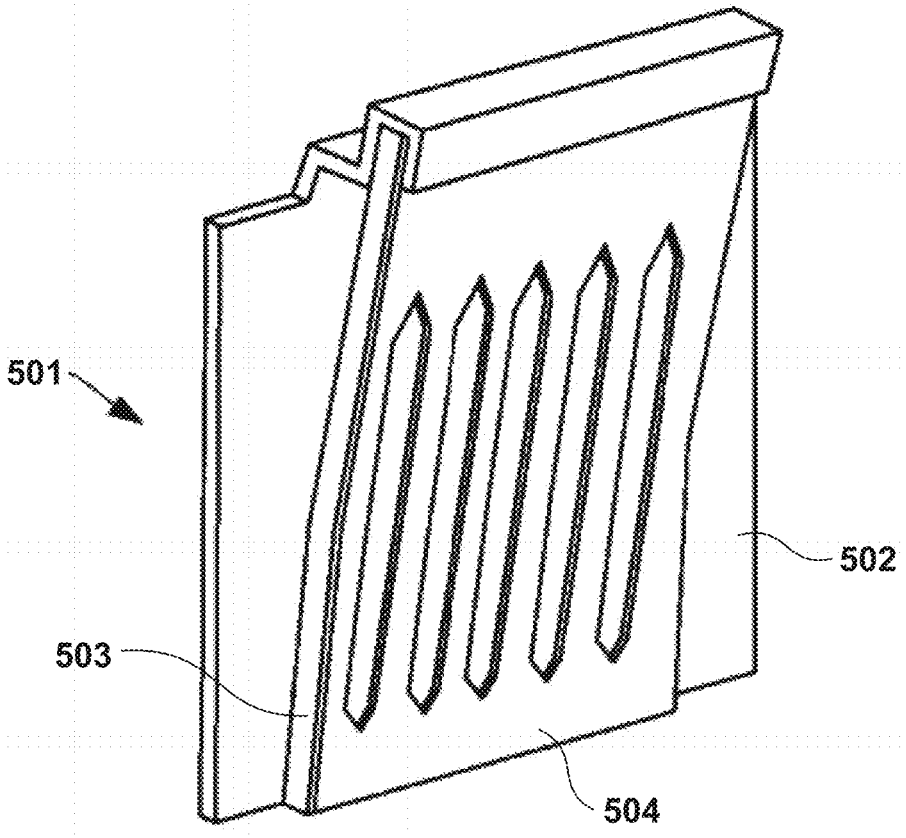
FIG. 9*j* is a perspective view showing a medium stopper according to related art PTL 1.

FIG. 9*j* is a perspective view showing a medium stopper according to related art PTL 1.

A sponge member 503 bent by its own weight to have a gap with respect to a medium stopper 501 is provided on the side of a medium abutting portion 502 of the medium stopper 501, and a thin plate elastic member 504 is arranged on the side of the medium abutting portion 502 of the sponge member 503. When the medium stopper 501 receives a discharged conveyance medium after the conveyance medium is made to contact the sponge member 503 with the thin plate elastic member 504, the collision force of the discharged conveyance medium is relaxed in an air layer between the sponge member 503 and the medium stopper, thereby suppressing a collision sound.

Figure 9K:
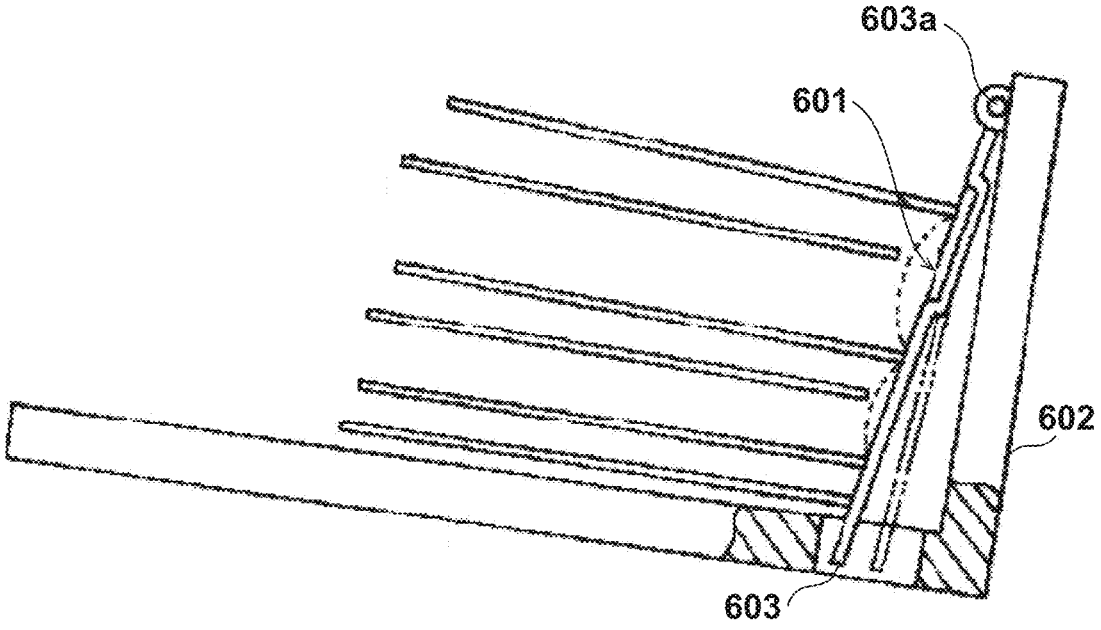
FIG. 9*k* is a sectional view showing a medium stopper according to related art PTL 2.

FIG. 9*k* is a sectional view showing a medium stopper according to related art PTL 2.

A medium stopper 601 includes an upper end portion 603*a* of a medium abutting portion 603 supported by a support member 602. If a conveyance medium sent from an apparatus collides against the medium stopper 601, the medium abutting portion 603 vibrates about the upper end portion 603*a* with respect to the support member 602, thereby suppressing a collision sound.

In FIG. 9*j*, the sponge member 503 attached via the gap with respect to the medium abutting portion 502 absorbs an impact and reduces noise when the discharged conveyance medium collides against the medium stopper 501. However, since the sponge member 503 and the thin plate elastic member 504 are used, the number of components increases, thereby increasing the cost. Furthermore, assembly processes of attaching the sponge member 503 and the thin plate elastic member 504 are added, thereby complicating the operation and increasing the labor cost.

In FIG. 9*k*, the medium abutting portion 603 is made to pivot about the upper end portion 603*a* of the medium stopper 601 to absorb a vibration caused by a collision and reduce noise. However, since the support member 602 for keeping the medium stopper 601 in the upright state is required, the number of components increases, thereby increasing the cost.

To the contrary, according to this embodiment, it is possible to reduce a collision sound generated when the discharged conveyance medium collides against the discharge stopper.

<Arrangement of Display Panel>

In the stored state of the second discharge tray 2*b*, the display screen 93 and the operation key 122 are arranged on the display panel 90 provided at a position overlapping the second discharge tray 2*b*.

In general, a user operation unit is often arranged in the right portion of the apparatus. This is because the population of right-handed users is higher than that of left-handed users in the world. In this embodiment as well, the operation key is arranged in a lower right portion of the display panel 90 to be readily used by a right-handed user.

On the other hand, a conveyance path range W and the display screen 93 are arranged on the left side in the apparatus. The display screen 93 is arranged to have a center line X at the same position as that of the center line of a feeding tray 110 and the conveyance path width W. Note that a maximum conveyance path width Wmax of the image reading apparatus A according to this embodiment is set so as to feed a sheet of a A4 letter size, and is Wmax=216 mm. The width of the display screen 93 is 224 mm that exceeds Wmax.

This makes it possible to display, for example, a read image in actual size on the display screen 93, and a finishing state can be readily confirmed, thereby improving the user convenience.

Figure 5B:
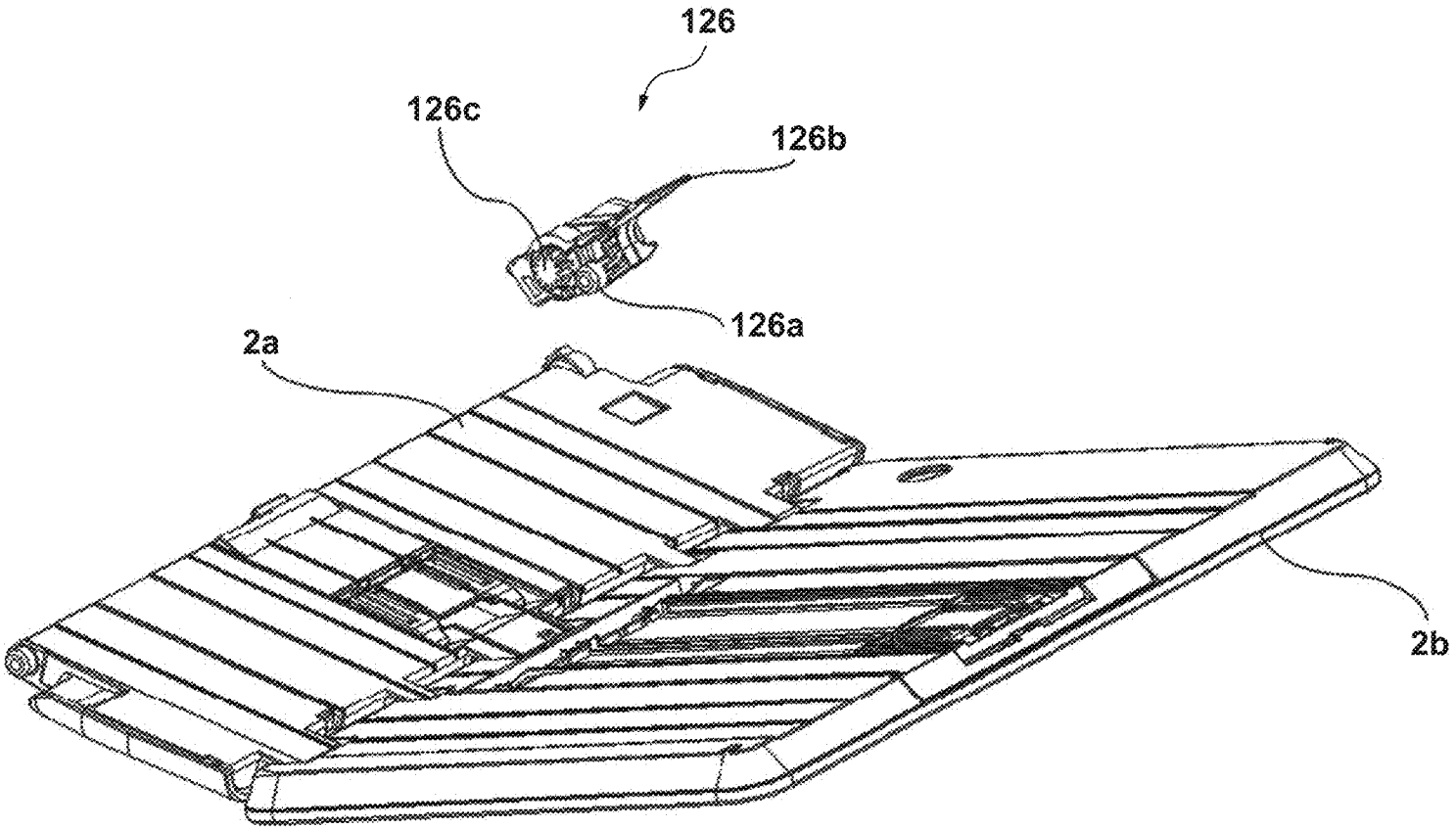
FIG. 5*b* is a perspective view showing a discharge tray according to the embodiment.

FIG. 5*b* is an exploded perspective view showing the discharge tray 2 of the image reading apparatus A according to this embodiment.

The discharge tray 2 is connected to a lower unit 104 via the first hinge 101 of the first discharge tray 2*a*. If the discharge tray 2 has a flexible connecting portion, it can be incorporated relatively easily by, for example, bending the connecting portion to engage with the main body. In this embodiment, however, since the first discharge tray 2*a* is formed to cover the lower panel 91, it is difficult to provide flexibility.

To cope with this, in this embodiment, an engaging portion for engaging with an engaged portion of the lower unit 104 is provided in one end portion of the first discharge tray 2*a* on the side of the first hinge 101, and an engaged portion with which a fixing member 126 engages is provided in the other end portion. An example of the engaging portion is a boss formed in a circular shape to be pivotable. An example of the engaged portion has a hole shape for receiving the circular boss. However, the engaging portion need only be pivotable and is not limited to the above structure. For example, the engaging portion may have a hole shape and the engaged portion may have a boss shape.

The fixing member 126 includes a tray engaging portion 126*a* for engaging with the engaging portion of the first discharge tray 2*a*, and a main body engaging portion 126*b* for engaging with the lower unit 104.

When the fixing member 126 is inserted into the lower unit 104 while engaging with the engaging portion of the first discharge tray 2*a*, and the main body engaging portion 126*b* engages with the lower unit 104, the discharge tray 2 can be fixed.

Thus, the engaging structure cannot be seen from outside the image reading apparatus A, thereby enhancing the fine appearance. For example, it is possible to incorporate the discharge tray 2 by sandwiching the first hinge 101 of the discharge tray 2 by the lower unit 104 or the like. In this case, however, it is necessary to divide the member for sandwiching the first hinge 101, such as the lower unit 104, and the boundary between the divided members can be confirmed from the outside, thereby degrading the fine appearance. In this embodiment, the engaging structure or the boundary between the sandwiching members cannot be seen from outside the image reading apparatus A, thereby enhancing the fine appearance. In the fixing structure of the discharge tray 2 according to this embodiment, the front surface of the main body 100 is covered with the discharge tray 2. However, it is unnecessary to provide a structure for engaging by providing legs in the main body 100 to lift it up and thus forming a space under the main body, and the bottom surface of the image reading apparatus A can be made adjacent to the placement plane, thereby implementing downsizing.

The fixing member 126 includes a damper structure 126*c* adjacent to the tray engaging portion 126*a*. This regulates the pivoting speed of the discharge tray 2 to reduce an impact applied on the discharge tray 2 or the main body 100. A general-purpose damper such as an oil damper can be used as the damper structure 126*c*. However, the present invention is not limited to this.

The fixing member 126 has a surface almost parallel to the lower panel 91, and this surface is arranged at a position slightly recessed with respect to the lower panel 91. This causes the butting surface 2*a*2 of the first discharge tray 2*a* to butt against the fixing member 126, thereby reliably butting against the lower panel 91 without floating from the lower panel 91.

<Details of Feed Structure>

Figure 6:
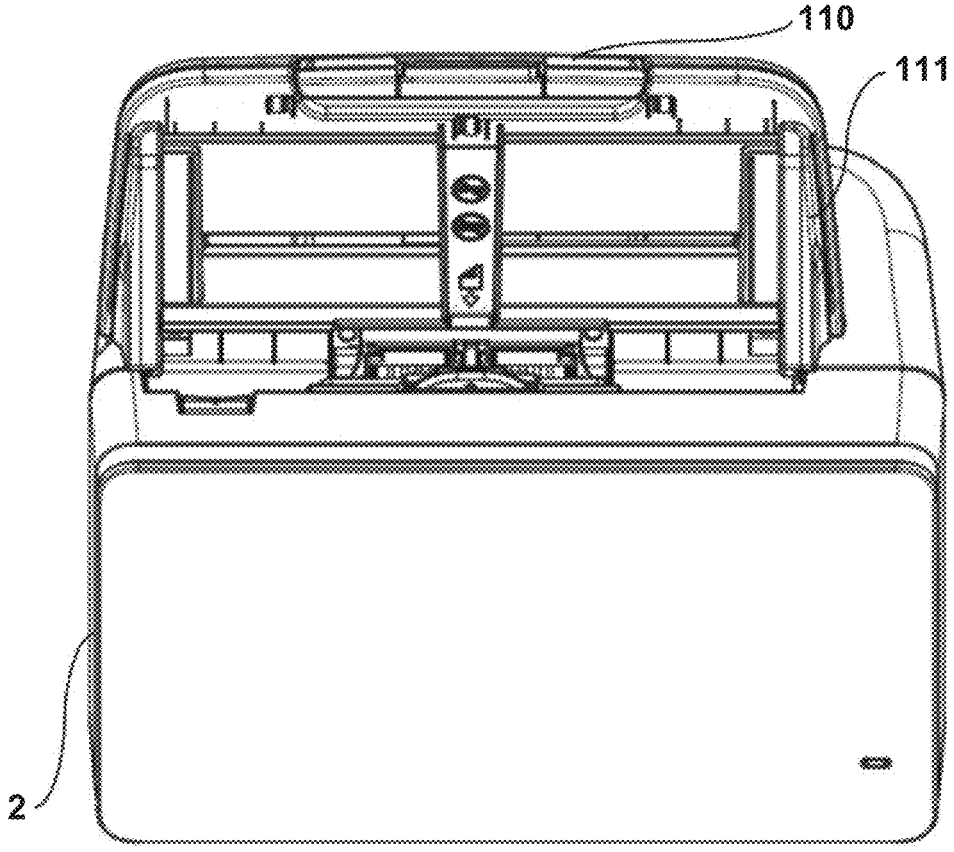
FIG. 6 is another plan view showing the image reading apparatus according to the embodiment.

FIG. 6 is a plan view showing the state in which the discharge tray 2 of the image reading apparatus A is stored according to this embodiment.

A regulating member 111 attached to be slidable in a direction perpendicular to the conveyance direction in accordance with the size of the arranged conveyance medium S is provided in the feeding tray 110.

<Details of Upper Unit>

As shown in FIG. 7, the main body 100 is formed from the upper unit 103 and the lower unit 104, and the upper unit 103 is attached to be pivotable about a main body hinge 105 with respect to the lower unit 104.

Since the upper unit 103 includes, in the display panel 90, the display screen 93 having a width exceeding the maximum conveyance path width Wmax and the support frame metal plate of the display screen 93, the barycenter in a state in which the upper unit 103 is opened, as shown in FIG. 8, largely shifts toward the front side in the conveyance direction with respect to the stored state of the upper unit 103 shown in FIG. 1.

Therefore, the image reading apparatus A may fall if the upper unit is opened quickly. However, by providing the protruding portion 130 in the image reading apparatus A according to this embodiment, it is possible to prevent the image reading apparatus A from falling even if the barycenter moves along with opening of the upper unit 103. The protrusion amount of the protruding portion 130 is a protrusion amount that is accommodated under the discharge tray 2 in the stored state of the upper unit 103 and the discharge tray 2 shown in FIG. 7, and protrudes to a position on the front side in the conveyance direction with respect to the barycenter of the upper unit 103 in the open state of the upper unit 103 shown in FIG. 8, at which a rotation moment generated by the image reading apparatus A around the distal end portion of the protruding portion 130 acts in a direction in which the image reading apparatus A does not fall. This can prevent the image reading apparatus A from falling due to opening of the upper unit 103, and prevent the protruding portion from protruding more than necessary, in the stored state in which the discharge tray 2 is stored, not to impede the user.

<Discharge Tray Angle Adjustment Mechanism 1>

A tray support portion 131 that abuts against the lower surface of the discharge tray 2 when the discharge tray 2 is opened is pivotably provided on the upper surface of the protruding portion 130.

Figure 10A:
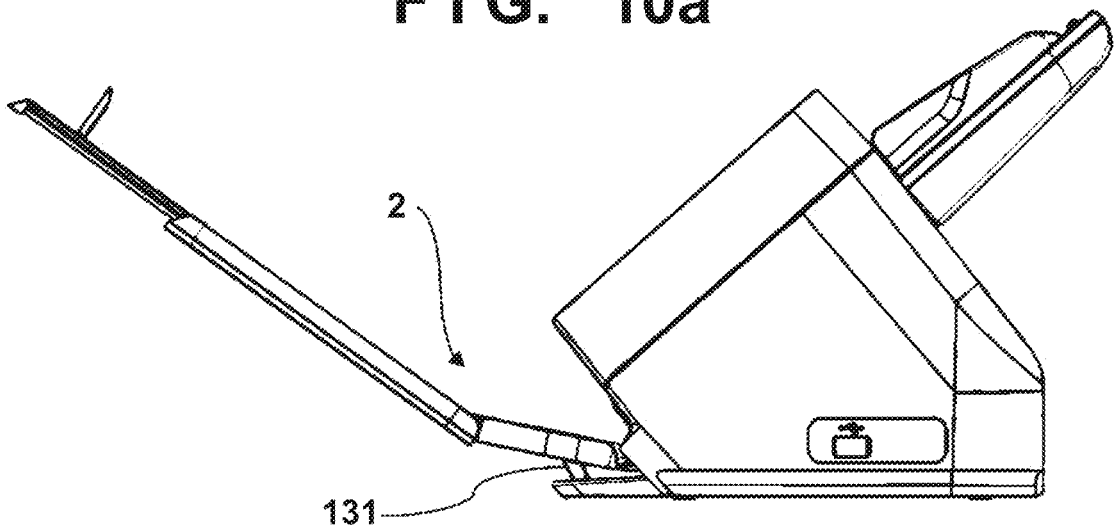
FIG. 10*a* is a side view showing the image reading apparatus according to the embodiment.

As shown in FIG. 9*a*, in the open state, the discharge tray 2 is supported by the protruding portion 130 so as to receive the discharged conveyance medium S. As shown in FIG. 10*a*, if the tray support portion 131 is made to pivot to protrude upward from the upper surface of the protruding portion 130, the tray support portion 131 abuts against the lower surface of the discharge tray 2 to support the discharge tray 2, thereby making it possible to adjust the angle of the discharge tray 2 from the state shown in FIG. 9*a* in which the discharge tray 2 is supported by the protruding portion 130. The discharge tray 2 is supported on the upper side in the vertical direction, as compared with a case in which the discharge tray 2 is supported by the protruding portion 130 at a stored position, thereby increasing the angle formed by the discharge tray and the placement plane of the image reading apparatus A.

For example, in the state shown in FIG. 10*a*, the discharge tray 2 is lifted up in the vertical direction, as compared with the state shown in FIG. 9*a*, thereby making it possible to change a position where the leading edge of the conveyance medium S lands on the upper surface of the discharge tray 2. Thus, in the state shown in FIG. 9*a*, if the leading edge of the conveyance medium S to be discharged abuts against the trailing edge of the already discharged conveyance medium S to push it, it is possible to make the leading edge of the succeeding conveyance medium S reliably land on the upper surface of the already discharged conveyance medium S in addition to the effect of shifting the trailing edge of the already discharged conveyance medium S toward the lower unit 104 by changing the angle of the discharge tray 2, as shown in FIG. 10*a*. With this configuration, it is possible to significantly improve the aligning property of the discharged conveyance media S on the discharge tray 2.

Figure 10B:
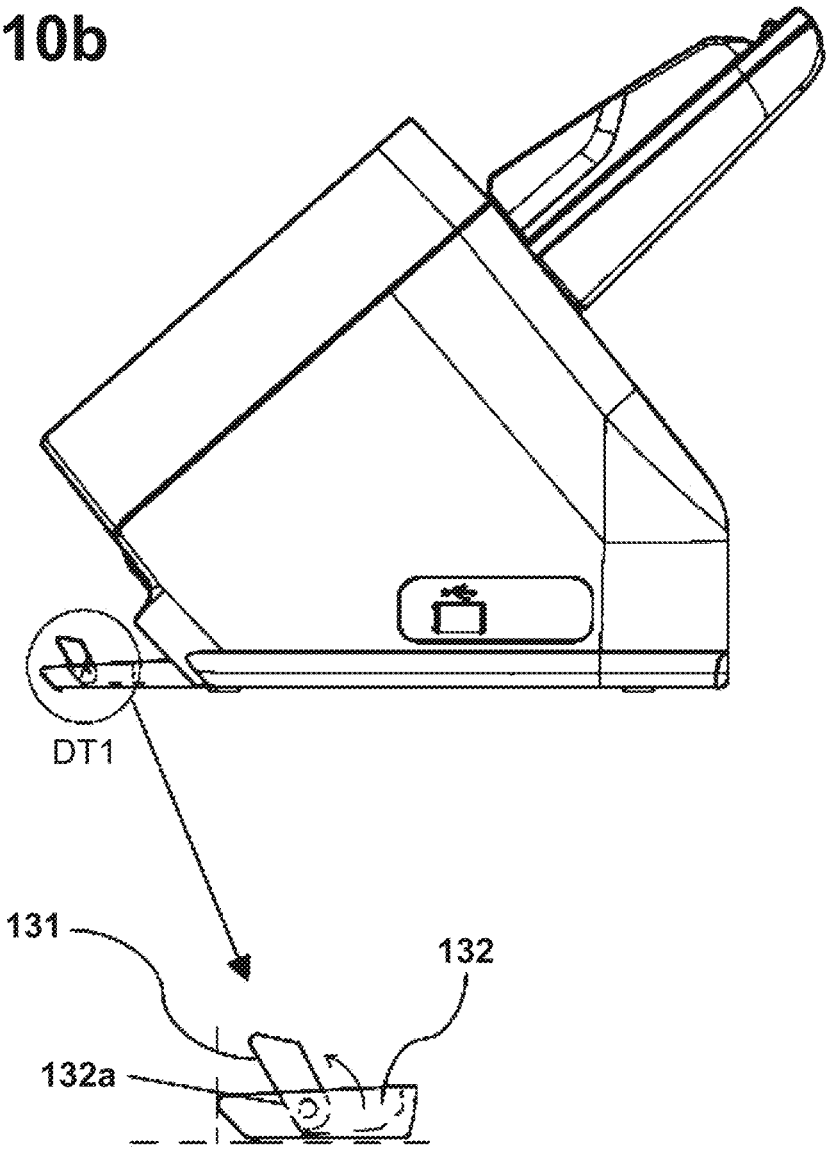
FIG. 10*b* shows another side view of the image reading apparatus and an enlarged view of a tray support portion according to the embodiment.

FIG. 10*b* is a side view showing a state in which the discharge tray 2 of the image reading apparatus A is detached. A lower view shows a portion surrounded by a circle DT1 in an upper view.

The tray support portion 131 is arranged so that a pivot shaft is provided in the protruding portion 130 provided in the lower portion of the main body 100. The pivot shaft of the tray support portion 131 is arranged on the distal end side of the protruding portion 130. When the tray support portion 131 pivots from a position where the tray support portion 131 is stored in the protruding portion 130 to a position where the tray support portion 131 is drawn out of the protruding portion 130, it is possible to support the discharge tray 2.

At a position where the tray support portion 131 is drawn out of the protruding portion 130 to the maximum, the tray support portion 131 pivots by 90° or more from the position where the tray support portion 131 is stored in the protruding portion 130. When the discharge tray 2 is supported by the tray support portion 131, the tray support portion 131 receives no load in a direction, in which the tray support portion 131 is stored in the protruding portion 130, by the load from the discharge tray 2. In addition, when the tray support portion 131 abuts against an abutting portion 132*a* of a tray support portion storing hole 132, the tray support portion 131 receives a reaction in a direction toward the discharge opening 92, and the pivot in the direction in which the tray support portion 131 is drawn out of the protruding portion 130 is regulated, thereby making it possible to support the discharge tray 2 stably.

Figure 10C:
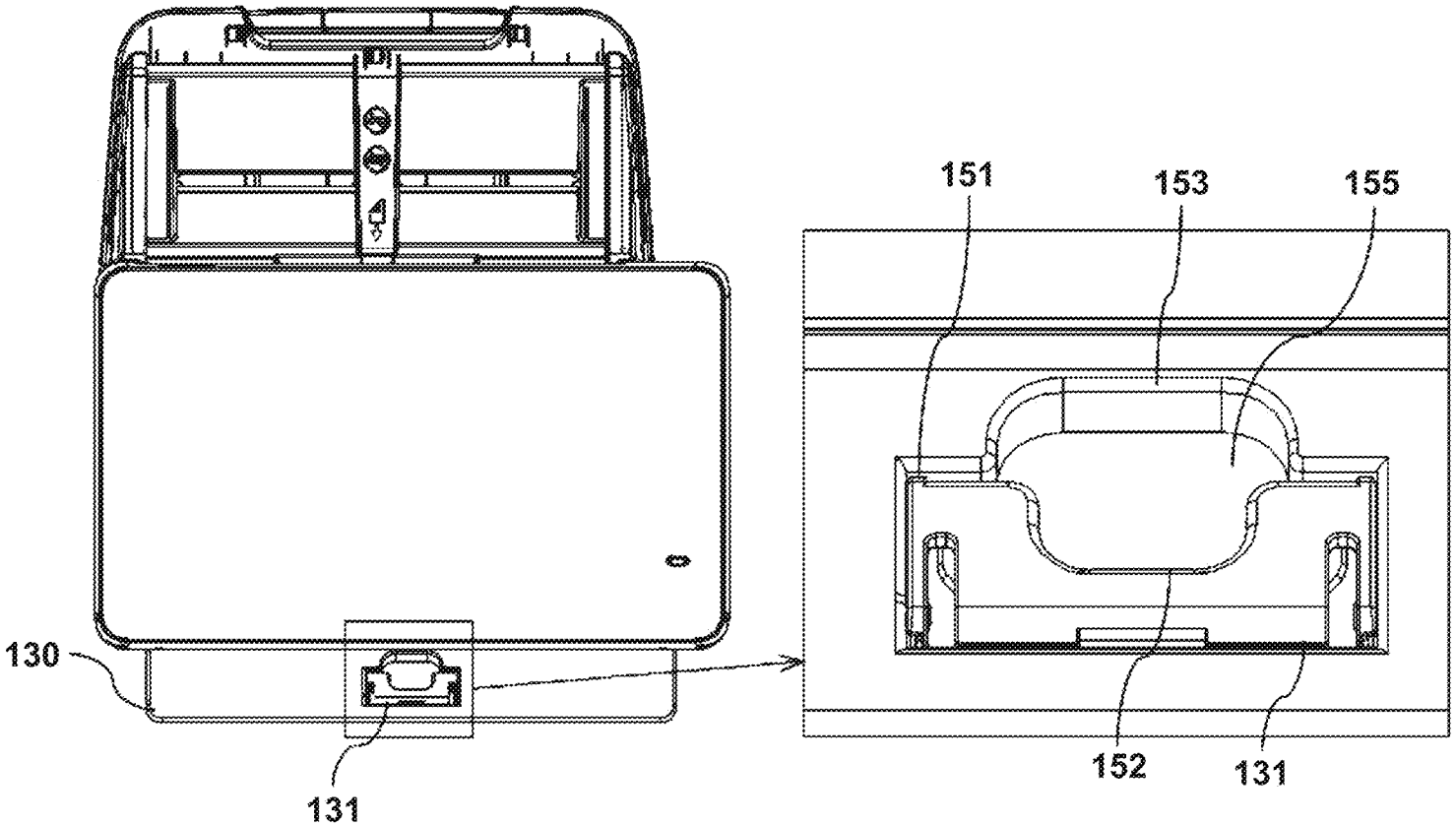
FIG. 10*c* shows a plan view and an enlarged view of the image reading apparatus according to the embodiment.

FIG. 10*c* shows a plan view and an enlarged view when viewed from a direction perpendicular to the display panel 90 of the image reading apparatus A according to this embodiment.

The tray support portion 131 is arranged to be accommodated, as a whole, in a recess 155 formed in the protruding portion 130, and provided with a pivot shaft on the distal end side of the protruding portion 130. When the tray support portion 131 is provided to be accommodated, as a whole, in the protruding portion 130, the protruding portion 130 can reliably abut against the discharge tray 2 in a state in which the tray support portion 131 is stored in the protruding portion 130.

The tray support portion 131 has a pivot shaft on the distal end side of the protruding portion 130, and is provided with a concave portion 152 for hooking a finger at the center and convex portions 151 abutting against the discharge tray 2 in two end portions on a side opposite to the pivot shaft.

A retraction portion 153 is provided at a position, in the recess 155, opposite to the concave portion 152 of the tray support portion 131, so that a finger of the user readily touches the concave portion 152.

In a state in which the tray support portion 131 pivots to protrude from the protruding portion 130, the convex portions 151 provided in the two end portions of the tray support portion 131 abut against the discharge tray 2. This can suppress the influence of a tolerance or a variation on the angle of the discharge tray 2.

Note that the tray support portion 131 may be configured to support the discharge tray 2 even in the middle of the pivoting range, thereby adjusting the angle of the discharge tray 2 in a plurality of stages. In this case, each conveyance medium S can be received at an angle at which the aligning property on the discharge tray 2 is best, thereby improving convenience.

In this embodiment, the abutting portion 132*a* of the protruding portion 130 supports the tray support portion 131. However, it is only necessary to adopt a configuration in which a reaction acts on the tray support portion 131 to adjust the angle of the discharge tray 2 with respect to the discharge opening 92. For example, the width of the tray support portion 131 may be made almost equal to that of the lower unit 104, support members of the tray support portion 131 may be arranged in the two end portions of the lower unit 104, and abutting portions provided in the support members may support the tray support portion 131, thereby adjusting the angle of the discharge tray 2.

In this embodiment, the tray support portion storing hole 132 for storing the tray support portion 131 in the protruding portion 130 has an opened bottom portion, and the tray support portion 131 may be configured to be accommodated in the protruding portion 130 by a regulating portion. With this configuration, even if a foreign substance is caught in the tray support portion storing hole 132, it can be discharged from the bottom portion, thereby preventing the aligning property from deteriorating when the tray support portion 131 cannot be stored in the protruding portion 130 completely due to the foreign substance and thus hinders a discharged original.

<Configuration 1 for Detecting State of Angle of Discharge Tray>

Figure 13:
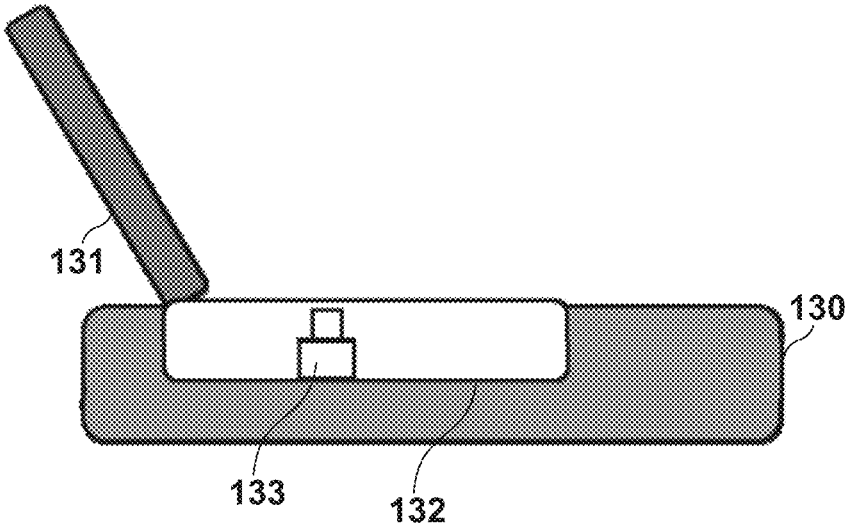
FIG. 13 is a view showing a configuration (when a switch is OFF) of detecting the state of the angle of the discharge tray of the image reading apparatus according to the embodiment.
Figure 14:
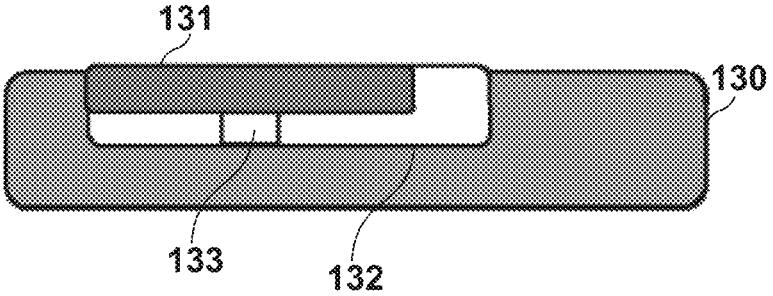
FIG. 14 is a view showing the configuration (when the switch is ON) of detecting the state of the angle of the discharge tray of the image reading apparatus according to the embodiment.

FIGS. 13 and 14 are schematic views each showing the configuration of a mechanism of monitoring the state of the tray support portion 131 of the image reading apparatus A according to this embodiment.

In the configuration, a tray support portion opening/closing monitoring sensor 133 is arranged in the tray support portion storing hole 132 to store the tray support portion 131 mounted on the upper surface of the protruding portion 130. The tray support portion opening/closing monitoring sensor 133 detects a state in which the tray support portion 131 is stored and a state in which the tray support portion 131 is drawn out, and notifies, via the interface unit 86 of the control unit 80, the CPU 81 of the state of the tray support portion 131. The CPU 81 can call user's attention so as to adjust the angle of the discharge tray 2 based on the information.

Examples of the tray support portion opening/closing monitoring sensor 133 are a physical switch such as a push switch, an optical sensor such as a transmission sensor, and a Hall element. A method of detecting the open/closed state of the tray support portion will be explained by exemplifying the push switch. FIG. 13 shows the state in which the tray support portion 131 is drawn out and thus the switch of the tray support portion opening/closing monitoring sensor 133 is OFF. FIG. 14 shows the state in which the tray support portion 131 covers the tray support portion opening/closing monitoring sensor 133 and thus the switch is ON. In this way, it is possible to detect the open/closed state of the tray support portion 131.

An original conveyance speed may be changed in accordance with the adjusted angle. More specifically, when selecting a mode in which it is assumed that the aligning property of the conveyance medium S is poor, if the discharge tray 2 is not supported by the tray support portion 131 at an angle at which the aligning property is good (in a state in which the angle formed by the discharge tray 2 and the placement plane of the image reading apparatus A is large), it is possible to improve the aligning property of the conveyance medium S by decreasing the conveyance speed. In this case, even if the angle of the discharge tray 2 is set by the tray support portion 131 to an angle corresponding to the aligning property of the conveyance medium S assumed for each selected conveyance mode, if the angle of the discharge tray 2 is changed using the tray support portion 131, the aligning property of the conveyance medium S may be improved by decreasing the conveyance speed.

<Optimum State Display Control Procedure by Detecting State of Discharge Tray>

Figure 15:
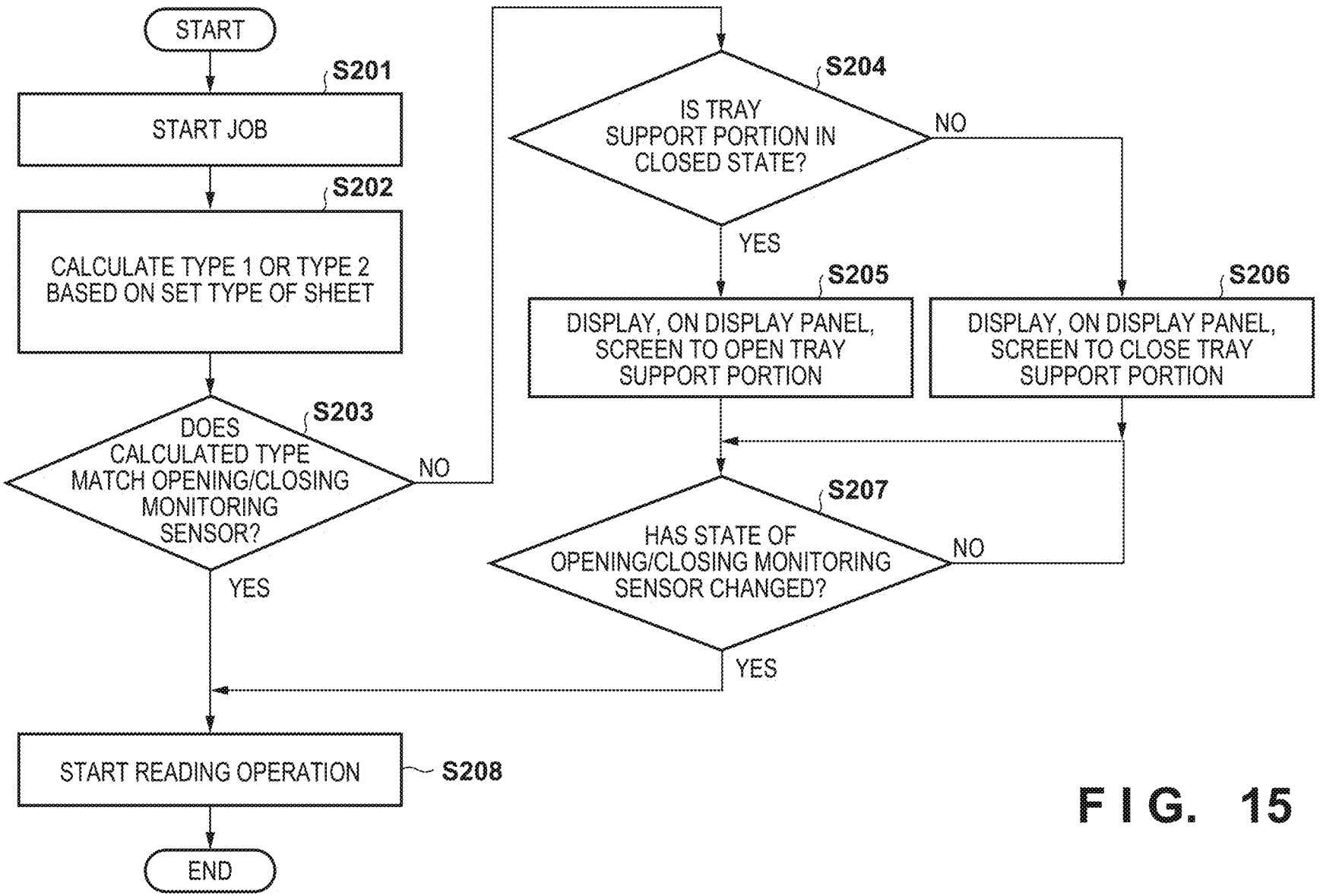
FIG. 15 is a flowchart illustrating an optimum state display control procedure by detecting the state of the discharge tray of the image reading apparatus according to the embodiment.

FIG. 15 shows an example of a control procedure of notifying the user of the optimum state of the discharge tray 2 based on the opening/closing information of the tray support portion opening/closing monitoring sensor 133 of the image reading apparatus A according to this embodiment.

In step S201, upon the pressing of a start button (not shown) provided in the operation unit 83 of the image reading apparatus A, a job starts.

In step S202, a table for dividing types of sheets into type 1 and type 2 in accordance with the angle of the discharge tray 2 is prepared in advance, and the type of sheet set by the user in the current job is compared with the table, thereby determining the type of sheet of the current job.

In step S203, it is determined whether the state of the tray support portion opening/closing monitoring sensor 133 matches the type of sheet calculated in step S202. If "YES" is determined, the process advances to step S208 to start a reading operation. If "NO" is determined, the process advances to step S204.

In step S204, it is determined whether the state of the tray support portion is "closed state". If "YES" is determined, the process advances to step S205 to display, on the display panel 90, an instruction to open the tray support portion 131, and then advances to step S207. If "NO" is determined, the process advances to step S206 to display, on the display panel 90, an instruction to close the tray support portion 131, and then advances to step S207.

In step S207, it is determined whether the state of the tray support portion opening/closing monitoring sensor 133 has changed. If "YES" is determined, the process advances to step S208 to start a reading operation. If "NO" is determined, the process continues monitoring until the state of the tray support portion opening/closing monitoring sensor 133 changes.

This control procedure can prompt the user to set an optimum discharge tray state for a sheet to be conveyed. Since this control procedure is merely an example, after displaying attention, a reading operation may start in a state in which the discharge tray 2 is not set in the optimum state. That is, a reading operation may start without waiting for a user operation.

<Configuration for Detecting State of Tray Support Portion of Second Embodiment>

Figure 16:
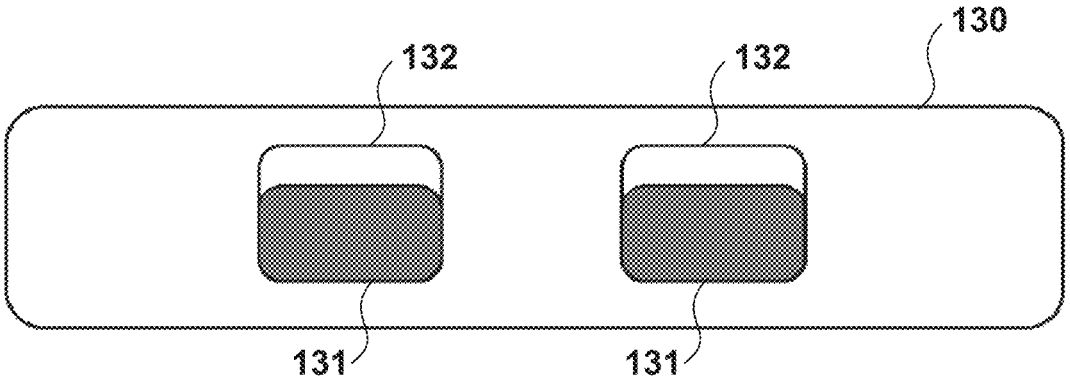
FIG. 16 is a view showing the configuration of a mechanism of monitoring the state of a tray support portion of an image reading apparatus according to the second embodiment.

FIG. 16 is a schematic view showing a configuration including the mechanism of a tray support portion 131 of an image reading apparatus A according to this embodiment.

In FIGS. 9*a* and 10*a* to 12*b*, one tray support portion 131 is provided at the center on the upper surface of the protruding portion 130 of the main body 100. However, FIG. 16 shows a configuration in which one tray support portion 131 is arranged on each of the left and right sides from the center of a protruding portion 130. By adopting this configuration, a discharge tray 2 can be supported more firmly. It is possible to implement a plurality of angle adjustment stages depending on the type of sheet by changing the angle between a case in which the right tray support portion 131 is opened and a case in which the left tray support portion 131 is opened. FIG. 16 shows the arrangement in which one tray support portion is arranged on each of the left and right sides. However, two or more tray support portions may be arranged on each of the left and right sides or one tray support portion may be arranged on only one of the left and right sides. A tray support portion opening/closing monitoring sensor 133 may be provided in each of the left and right tray support portions 131, and the angle of the discharge tray 2 may be detected based on the states of the respective sensors.

<Optimum State Display Control Procedure by Detecting State of Discharge Tray of Second Embodiment>

Figure 17:
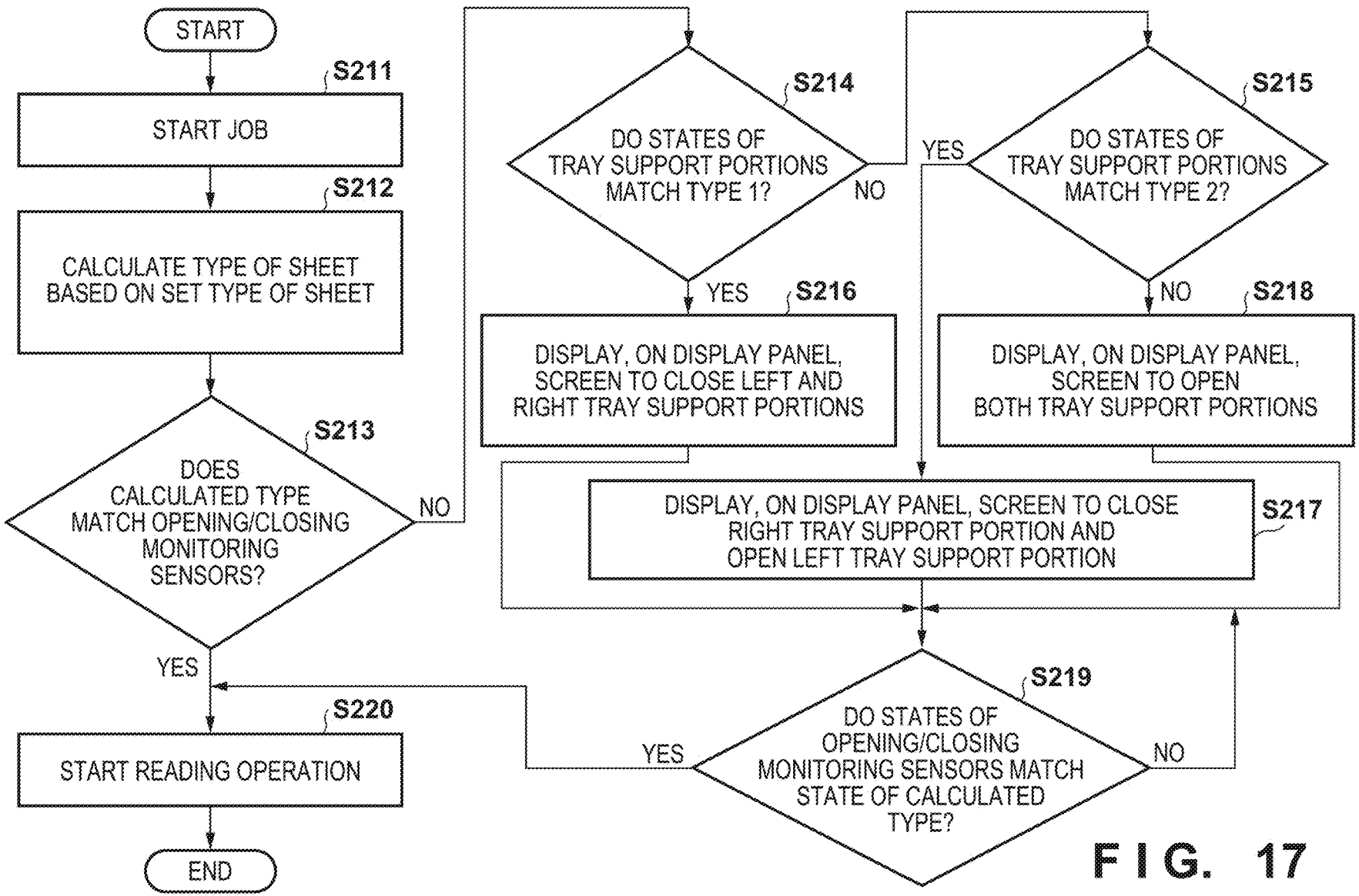
FIG. 17 is a flowchart illustrating an optimum state display control procedure for the tray support portion of the image reading apparatus by detecting the state of a discharge tray according to the second embodiment.

FIG. 17 is an example of a control procedure of notifying the user of the optimum state of the discharge tray 2 based on the pieces of opening/closing information of the tray support portion opening/closing monitoring sensors 133 about the tray support portions of the image reading apparatus A according to the second embodiment.

In step S211, upon the pressing of a start button (not shown) provided in an operation unit 83 of the image reading apparatus A, a job starts.

In step S212, a table for dividing types of sheets in accordance with the angle of the discharge tray 2 is prepared in advance, and the type of sheet set by the user in the current job is compared with the table, thereby determining the type of sheet of the current job. In this example, type 1 represents a state in which the discharge tray 2 is horizontal (a state in which the left and right tray support portions 131 are closed), type 2 represents a state in which the discharge tray 2 is slightly inclined (a state in which the left tray support portion 131 is open and the right tray support portion 131 is closed), and type 3 represents a state in which the discharge tray 2 is further inclined (a state in which the right tray support portion 131 is open, that is, at least the right tray support portion 131 need only be open and the left tray support portion 131 may be at any position since it is at a position where the discharge tray 2 is not supported in this state but more preferably, the left tray support portion 131 is also open).

In step S213, it is determined whether the states of the left and right tray support portion opening/closing monitoring sensors 133 match the type of sheet calculated in step S212. If "YES" is determined, the process advances to step S220 to start a reading operation. If "NO" is determined, the process advances to step S214.

In step S214, it is determined whether the calculated type of sheet is "type 1". If "YES" is determined, the process advances to step S216 to display, on a display panel 90, an instruction to close the left and right tray support portions 131, and then advances to step S219. If "NO" is determined, the process advances to step S215.

In step S215, it is determined whether the calculated type of sheet is "type 2". If "YES" is determined, the process advances to step S217 to display, on the display panel 90, an instruction to close the right tray support portion 131 and open the left tray support portion 131, and then advances to step S219. If "NO" is determined, the process advances to step S218 to display, on the display panel 90, an instruction to open the right tray support portion 131, and then advances to step S219. In consideration of user's understandability, an instruction to open both the tray support portions 131 may be displayed on the display panel 90.

In step S219, it is determined whether the states of the tray support portion opening/closing monitoring sensors 133 match the state of the type of sheet of the current job. If "YES" is determined, the process advances to step S220 to start a reading operation. If "NO" is determined, the process continues monitoring until the states of the tray support portion opening/closing monitoring sensors 133 match the state of the type of sheet of the current job.

This control procedure can prompt the user to set an optimum discharge tray state. Since this control procedure is merely an example, after displaying attention, a reading operation may start in a state in which the discharge tray 2 is not set in the optimum state. As for the setting of the angle of the discharge tray 2, four or more settings may be used.

<Configuration for Detecting State of Tray Support Portion of Modification>

Figure 18A:
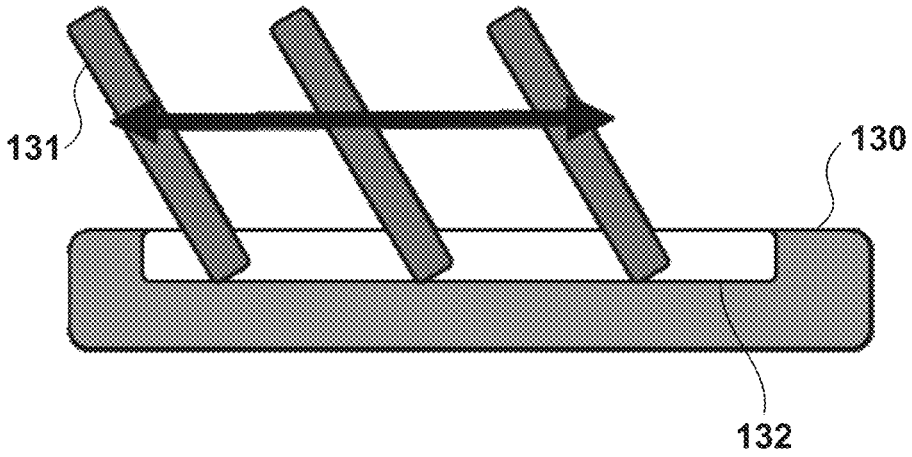
FIG. 18*a* is a view showing the configuration of the mechanism of monitoring the state of the tray support portion of the image reading apparatus according to a modification of the embodiment.

FIG. 18*a* is a schematic view showing a configuration including the mechanism of the tray support portion 131 of the image reading apparatus A according to a modification of this embodiment.

In FIGS. 9*a* and 10*a* to 12*b*, the tray support portion 131 can move only in a rotation direction on the upper surface of the protruding portion 130 of the main body 100. FIG. 18*a* shows a configuration in which the tray support portion 131 can move in the rotation direction and also perform a sliding operation in a direction parallel to a conveyance direction D1. It is possible to set a plurality of adjustment stages for the angle of the discharge tray 2 by changing the position of the tray support portion 131 in the conveyance direction.

Figure 18B:
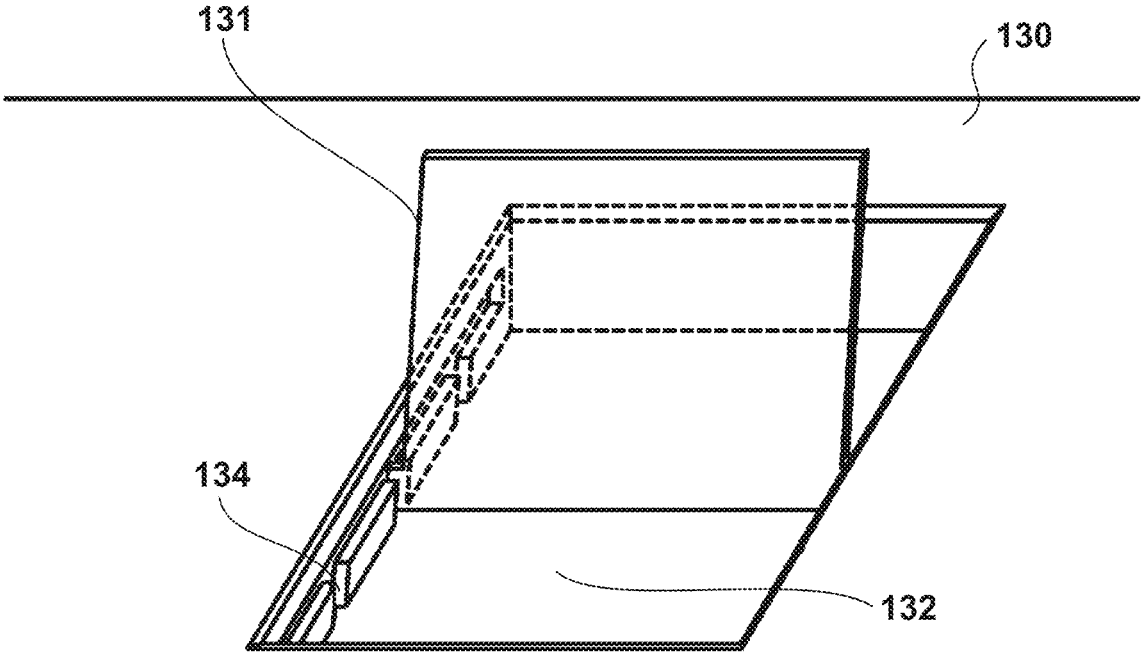
FIG. 18*b* is a view showing the configuration of the mechanism of monitoring the state of the tray support portion of the image reading apparatus according to the modification of the embodiment.

For example, as shown in FIG. 18*b*, there is provided a configuration in which the tray support portion 131 is provided in a tray support portion storing hole 132 having a rail shape, and grooves 134 are arranged at a regular interval at each end of the tray support portion storing hole 132, and then the tray support portion 131 is caused to slide in the conveyance direction to be caught in the grooves 134 and fixed. The present invention, however, is not limited to this, and another configuration may be adopted. The tray support portion opening/closing monitoring sensor 133 may be provided at each fixing position of the tray support portion 131, and the angle of the discharge tray 2 may be detected based on the state of each sensor.

<Optimum State Display Control Procedure by Detecting State of Discharge Tray of Modification>

Figure 19:
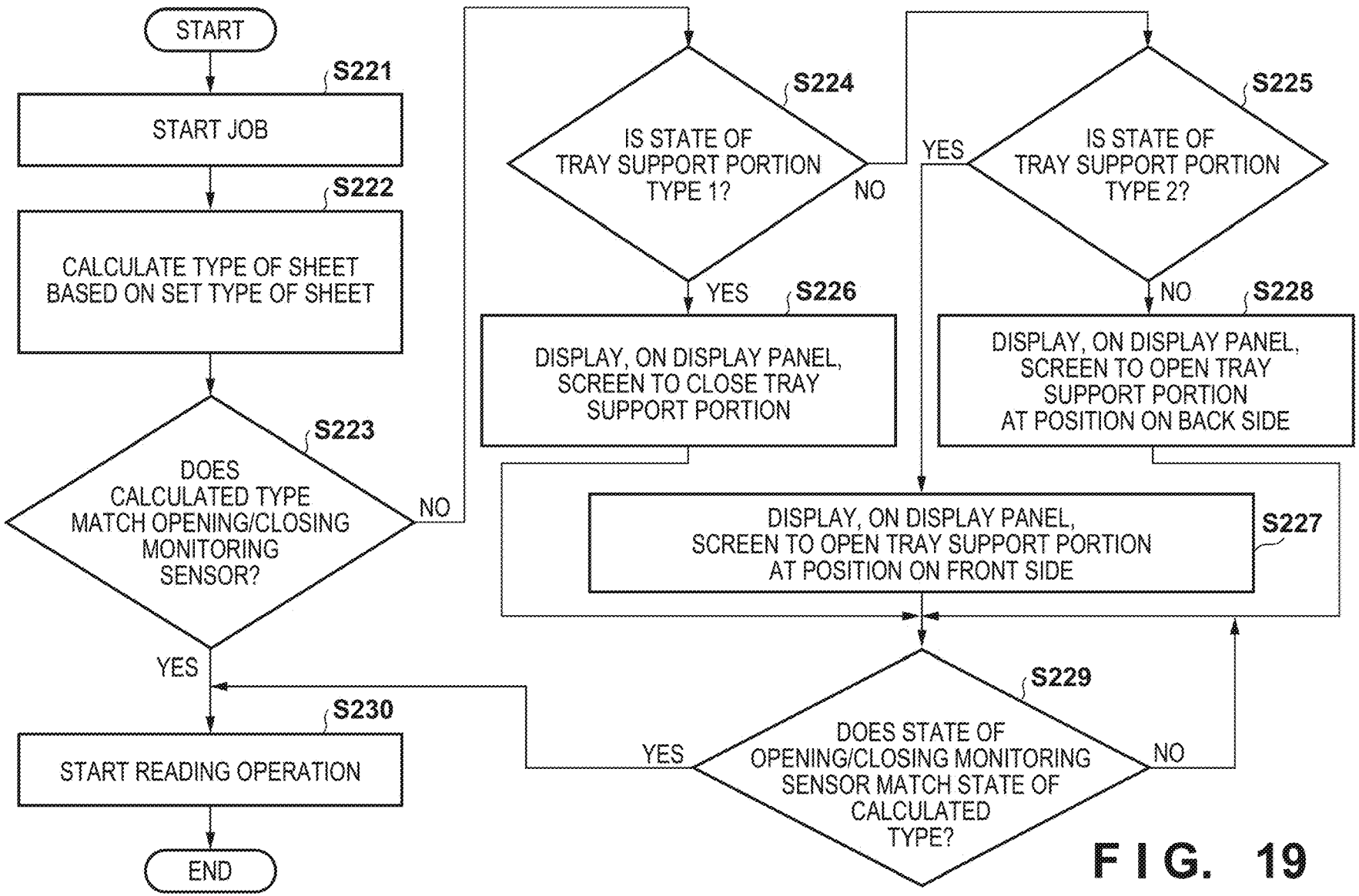
FIG. 19 is a flowchart illustrating an optimum state display control procedure for the tray support portion of the image reading apparatus by detecting the state of the discharge tray according to the modification of the embodiment.

FIG. 19 is an example of a control procedure of notifying the user of the optimum state of the discharge tray 2 based on the opening/closing information of the tray support portion opening/closing monitoring sensor 133 about the tray support portion of the image reading apparatus A according to the modification of this embodiment.

In step S221, upon the pressing of the start button (not shown) provided in the operation unit 83 of the image reading apparatus A, a job starts.

In step S222, a table for dividing types of sheets in accordance with the angle of the discharge tray 2 is prepared in advance, and the type of sheet set by the user in the current job is compared with the table, thereby determining the type of sheet of the current job. In this embodiment, type 1 represents a state in which the discharge tray 2 is horizontal (a state in which the tray support portion 131 is closed), type 2 represents a state in which the discharge tray is slightly inclined (a state in which the tray support portion is open at a position on the front side (a position close to the main body 100)), and type 3 represents a state in which the discharge tray 2 is further inclined (a state in which the tray support portion is open at a position on the back side (a position separated from the main body 100)).

In step S223, it is determined whether the state of the tray support portion opening/closing monitoring sensor 133 matches the type of sheet calculated in step S222. If "YES" is determined, the process advances to step S230 to start a reading operation. If "NO" is determined, the process advances to step S224.

In step S224, it is determined whether the state of the tray support portion opening/closing monitoring sensor 133 is "type 1". If "YES" is determined, the process advances to step S226 to display, on the display panel 90, an instruction to close the tray support portion 131, and then advances to step S229. If "NO" is determined, the process advances to step S225.

In step S225, it is determined whether the state of the tray support portion opening/closing monitoring sensor 133 is "type 2". If "YES" is determined, the process advances to step S227 to display, on the display panel 90, an instruction to open the tray support portion 131 at a position on the front side, and then advances to step S229. If "NO" is determined, the process advances to step S228 to display, on the display panel 90, an instruction to open the tray support portion 131 at a position on the back side, and then advances to step S229.

In step S229, it is determined whether the state of the tray support portion opening/closing monitoring sensor 133 matches the state of the type of sheet of the current job. If "YES" is determined, the process advances to step S230 to start a reading operation. If "NO" is determined, the process continues monitoring until the state of the tray support portion opening/closing monitoring sensor 133 matches the state of the type of sheet of the current job.

This control procedure can prompt the user to set an optimum discharge state. Since this control procedure is merely an example, after displaying attention, a reading operation may start in a state in which the discharge tray 2 is not set in the optimum state. As for the setting of the angle, four or more settings may be used.

<Detection of Angle of Discharge Tray>

Figure 20:
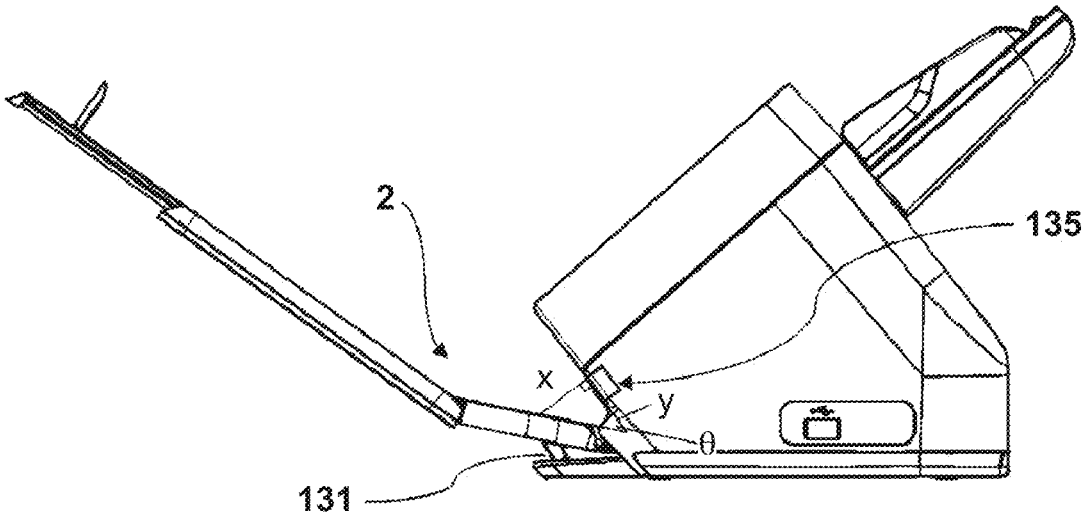
FIG. 20 is a view showing the configuration of a mechanism of detecting the angle of the discharge tray of the image reading apparatus according to the embodiment.

FIG. 20 is a schematic view showing a configuration including a mechanism of detecting the angle of the discharge tray of the image reading apparatus A according to the embodiment.

As shown in FIG. 20, a ranging sensor 135 is arranged in a lower panel 91 of the main body 100. In this case, the ranging sensor 135 is provided at a distance y from the fulcrum of the discharge tray 2 in parallel to the lower panel 91 of the main body 100. Examples of the ranging sensor 135 are an optical sensor, an ultrasonic sensor, and a Hall element. If a Hall element is used, a magnet (not shown) needs to be provided at an opposite position on the side of the discharge tray 2. In this case, the tray support portion 131 may have the configuration shown in FIGS. 9*a* and 10*a* to 14, that shown in FIG. 16, or that shown in FIG. 18. Alternatively, the tray support portion 131 may have another configuration. Another angle adjustment mechanism including no tray support portion 131 may be adopted.

A method of detecting the angle of the discharge tray 2 using an optical sensor as the ranging sensor 135 will be described as an example. When the discharge tray 2 is opened, a distance to the lower panel 91 of the main body 100 is represented by x. The ranging sensor 135 measures the distance x. The distance between the placement position of the ranging sensor 135 and the fulcrum of the discharge tray 2 is stored in advance in a storage unit 82 of a control unit 80. An angle θ of the discharge tray is calculated using the distance x measured by the ranging sensor 135 and the distance y stored in advance in the storage unit 82 by:

$$\theta=\arctan(x/y) \quad (1)$$

The present invention is not limited to the above configuration, and another configuration may be adopted. For example, the ranging sensor 135 may be arranged on the side of the discharge tray 2 to calculate the angle θ based on the distance to the lower portion of the main body 100.

[Third Embodiment] A discharge tray angle adjustment mechanism of an image reading apparatus A according to the third embodiment of the present invention will be described next.

Note that the configurations and functions of the image reading apparatus A according to this embodiment are the same as in the above-described embodiments. In PTL 2, a tray support portion cannot be drawn out while a conveyance medium is placed on a discharge tray, and if an abnormality occurs in the aligning property during conveyance, conveyance needs to be stopped. In this embodiment, such problem can be solved.

<Discharge Tray Angle Adjustment Mechanism 3>

Figure 21:
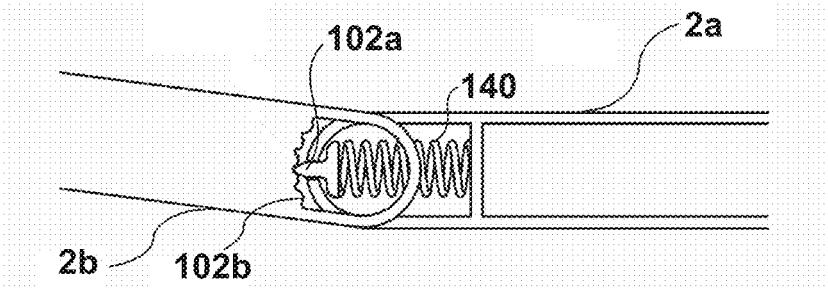
FIG. 21 is a sectional view schematically showing a second hinge of a discharge tray according to the embodiment.

FIG. 21 is a view showing the internal structure of a second hinge 102 provided at the distal end of a first discharge tray 2*a*. The second hinge 102 is formed from a convex portion 102*a* formed in the first discharge tray 2*a* and grooves 102*b* formed in a second discharge tray 2*b*. The angle of the second discharge tray 2*b* can be fixed when the convex portion 102*a* is fitted in the groove 102*b*. FIGS. 22*a* to 22*d* are views schematically showing the state of the second hinge 102 when the second discharge tray 2*b* is made to pivot. The convex portion 102*a* is supported by a spring 140, and can retract in the direction of an arrow in FIG. 22*a*. If the second discharge tray 2*b* is made to pivot, the convex portion 102*a* fitted in the groove 102*b* retracts, as shown in FIG. 22*b*. If the second discharge tray 2*b* is made to further pivot, the convex portion 102*a* finally moves to the adjacent groove to release the retraction (FIG. 22*d*), and the second discharge tray 2*b* is fixed at an angle different from that in FIG. 22*a*. As described above, the second discharge tray 102*b* can be adjusted at a plurality of angles with respect to the first discharge tray 2*a*, thereby increasing the angle formed by the discharge tray and the placement plane of the image reading apparatus A.

Figure 22A:
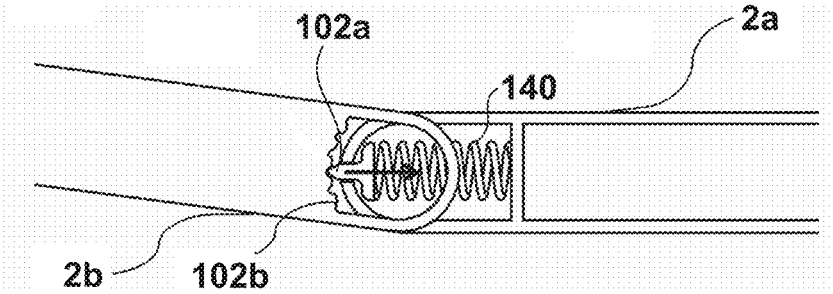
FIG. 22*a* is a sectional view schematically showing the operation of the second hinge when causing a second discharge tray to pivot according to the embodiment.
Figure 22B:
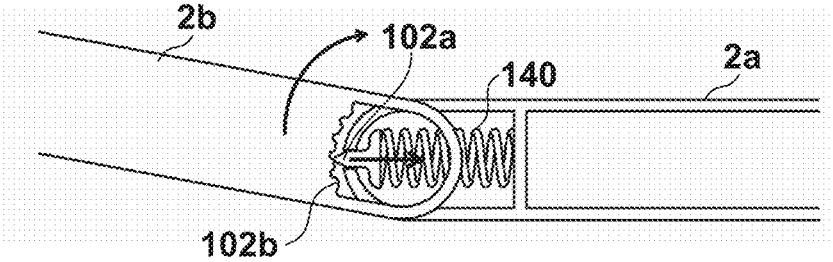
FIG. 22*b* is a sectional view schematically showing the operation of the second hinge when causing the second discharge tray to pivot according to the embodiment.
Figure 22C:
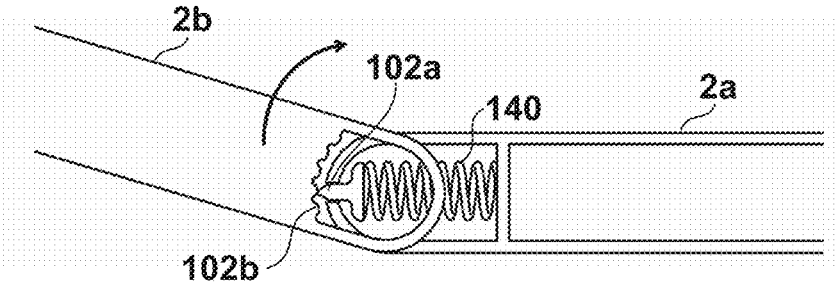
FIG. 22*c* is a sectional view schematically showing the operation of the second hinge when causing the second discharge tray to pivot according to the embodiment.
Figure 22D:
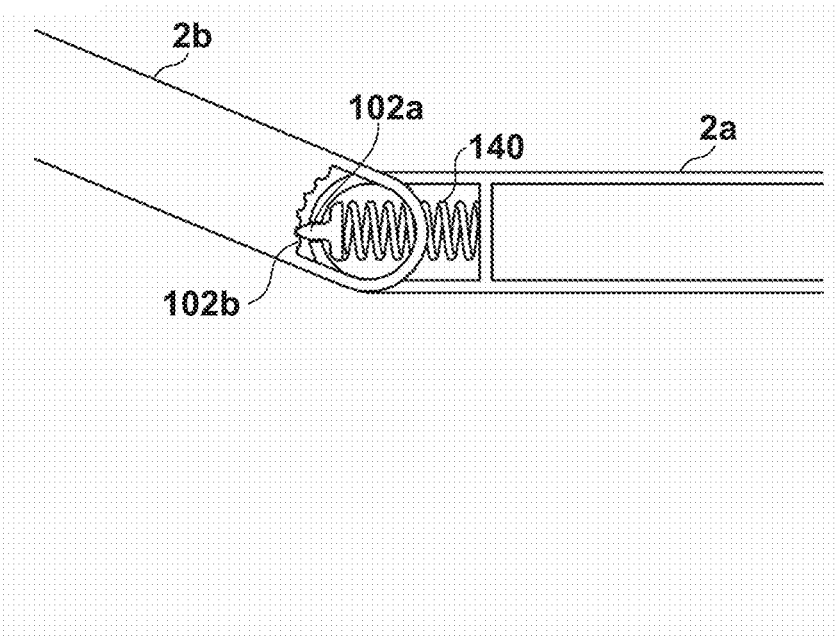
FIG. 22*d* is a sectional view schematically showing the operation of the second hinge when causing the second discharge tray to pivot according to the embodiment.
Figure 23A:
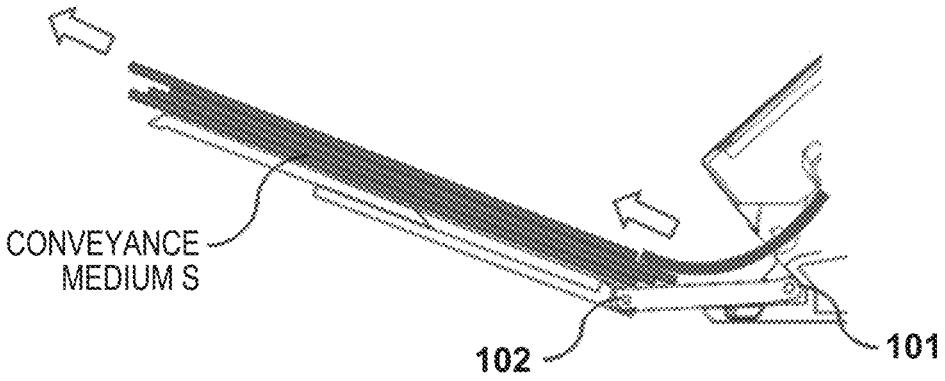
FIG. 23*a* is a side view showing the use state of the discharge tray according to the embodiment.
Figure 23B:
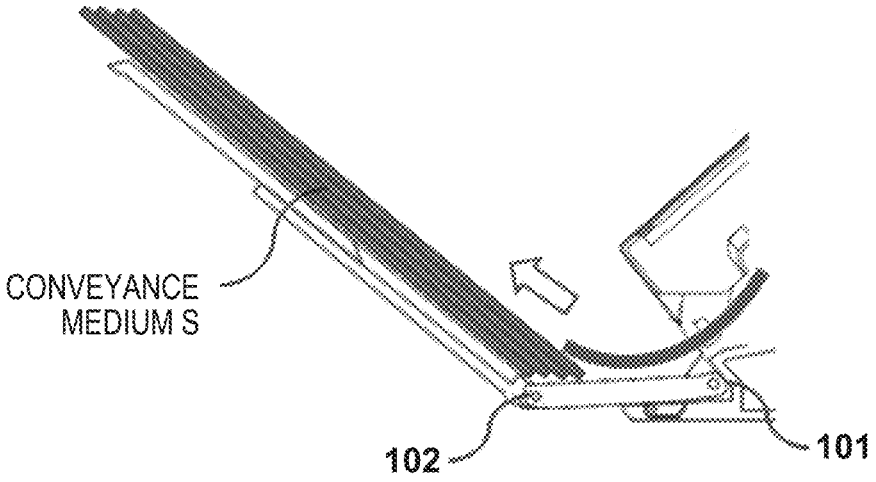
FIG. 23*b* is a side view showing the use state of the discharge tray according to the embodiment.

For example, in the state shown in FIG. 22*d*, a discharge tray 2 is lifted up in the vertical direction, as compared with the state shown in FIG. 22*a*, thereby making it possible to change a position at which the leading edge of a conveyance medium S lands on the upper surface of the discharge tray 2. Thus, as shown in FIG. 23, if the leading edge of the conveyance medium S to be discharged abuts against the trailing edge of the already discharged conveyance medium S to push it, it is possible to make the leading edge of the succeeding conveyance medium S reliably land on the upper surface of the already discharged conveyance medium S in addition to the effect of shifting the trailing edge of the already discharged conveyance medium S toward the lower unit 104 by changing the discharge tray 2 in a direction in which the angle formed by the discharge tray and the placement plane of the image reading apparatus A increases. By providing an angle adjustment function in the second hinge 102, it is possible to adjust the angle of the discharge tray even if the discharged conveyance medium S is placed on the discharge tray 2. Therefore, even if an abnormality occurs in the aligning property of the conveyance medium S, in which the leading edge of the conveyance medium S to be discharged abuts against the trailing edge of the already discharged conveyance medium S to push it during conveyance, it is possible to improve the aligning property by adjusting the angle. This configuration can significantly improve the aligning property of the discharged conveyance media S on the discharge tray 2.

Note that in this embodiment, the angle is adjusted using the convex portion 102*a* formed in the first discharge tray 2*a* and the grooves 102*b* formed in the second discharge tray 2*b*. However, it is only necessary to adopt a configuration capable of adjusting the angle of the second discharge tray 2*b* with respect to the first discharge tray 2*a*. For example, grooves may be formed in the first discharge tray 2*a* and a convex portion may be formed in the second discharge tray 2*b*. A torque limiter may be attached to the second hinge 102 to adjust the angle of the second discharge tray 2*b*. Alternatively, a latch may be attached to the second hinge 102, and a lever, a switch, or the like capable of releasing fixing may be provided, thereby making it possible to adjust the angle.

Figure 24:
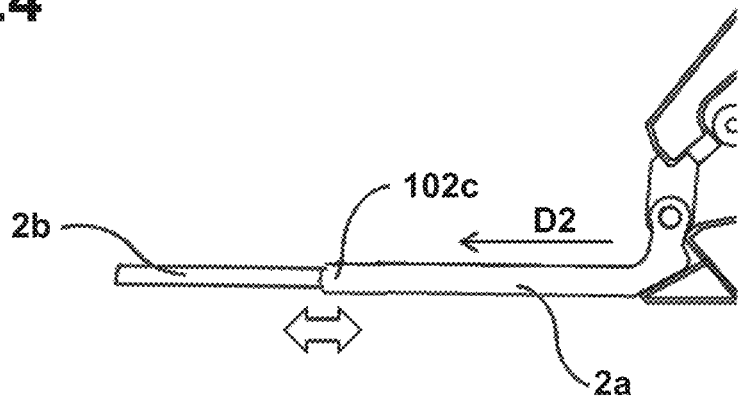
FIG. 24 is a side view showing a discharge tray according to another embodiment.
Figure 25A:
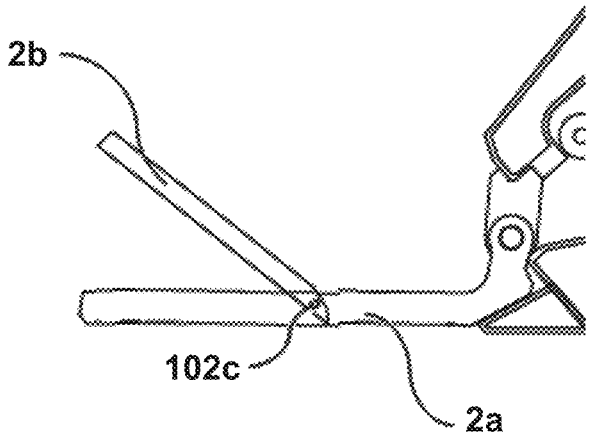
FIG. 25*a* is a side view showing the use state of the discharge tray according to the other embodiment.
Figure 25B:
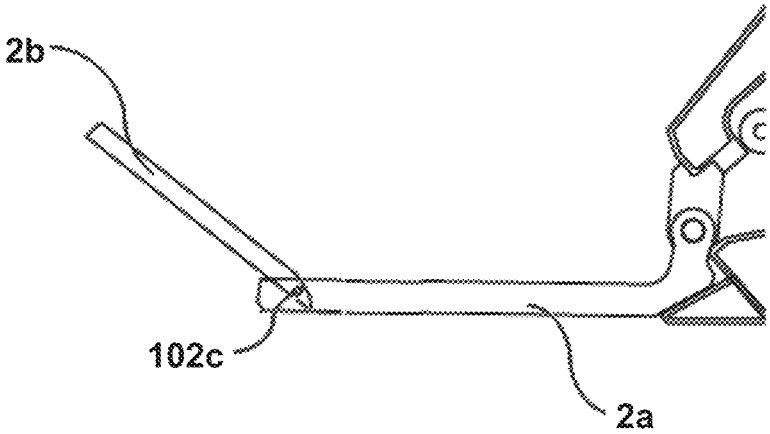
FIG. 25*b* is a side view showing the use state of the discharge tray according to the other embodiment.

In this embodiment, the discharge tray 2 is formed by the first discharge tray 2*a* and the second discharge tray 2*b*. However, the second discharge tray 2*b* may be provided to be pivotable or drawn out of the first discharge tray 2*a*, and may be extended and used, as needed. FIG. 24 is a schematic view showing the image reading apparatus attached with an extension discharge tray. The second discharge tray 2*b* is incorporated in the first discharge tray 2*a*, and attached to be movable in parallel to a discharge direction D2 by a rail member (not shown). Furthermore, the angle adjustment function shown in FIG. 21 is provided in a second hinge 102*c*. With this configuration, the moving amount of the second discharge tray 2*b* can be adjusted in accordance with the sheet size in addition to the angle, thereby improving the aligning property. For example, the moving amount of the second discharge tray 2*b* can be decreased when a sheet of a relatively small size is discharged, as shown in FIG. 25*a*, and can be increased when a sheet of a relatively large size is discharged, as shown in FIG. 25*b*, thereby adjusting the aligning property. Furthermore, since the second discharge tray 2*b* can be stored in the first discharge tray 2*a* when it is unnecessary, the apparatus can be made compact. Note that in this example, the angle adjustment function shown in FIG. 21 is provided in the second hinge 102*c* shown in FIG. 24. However, it is only necessary to adopt a configuration capable of adjusting the angle of the second discharge tray 2*b*. For example, a torque limiter may be attached to the second hinge 102*c*, thereby adjusting the angle of the second discharge tray 2*b*.

[Fourth Embodiment] A discharge tray angle adjustment mechanism of an image reading apparatus A according to the fourth embodiment of the present invention will be described next.

Note that the configurations and functions of the image reading apparatus A according to this embodiment are the same as in the above-described embodiments. In PTL 2, a movable butting member for adjusting the angle of the discharge tray is provided in the apparatus main body to support a portion around the rotation hinge of the discharge tray. Therefore, when the butting member slightly moves, the angle of the discharge tray largely changes. However, to support a portion around the distal end of the discharge tray, the placement area of the apparatus itself becomes large. In this embodiment, this problem can be solved.

<Discharge Tray Angle Adjustment Mechanism 4>

Figure 26:
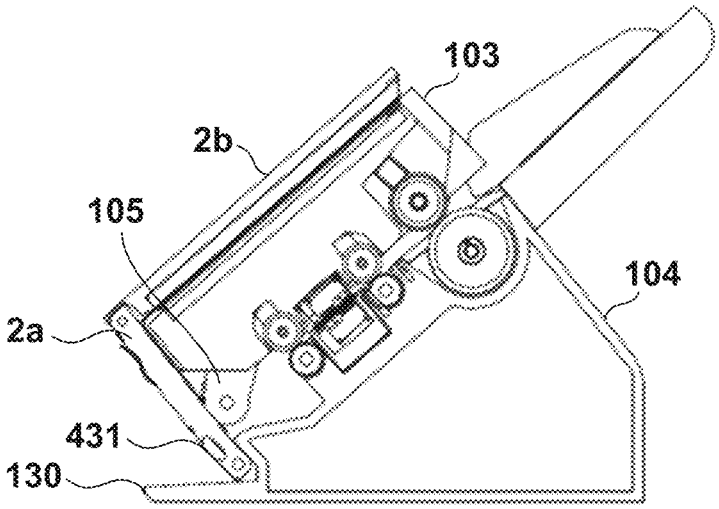
FIG. 26 is a schematic side sectional view showing an image reading apparatus according to the embodiment.
Figure 27:
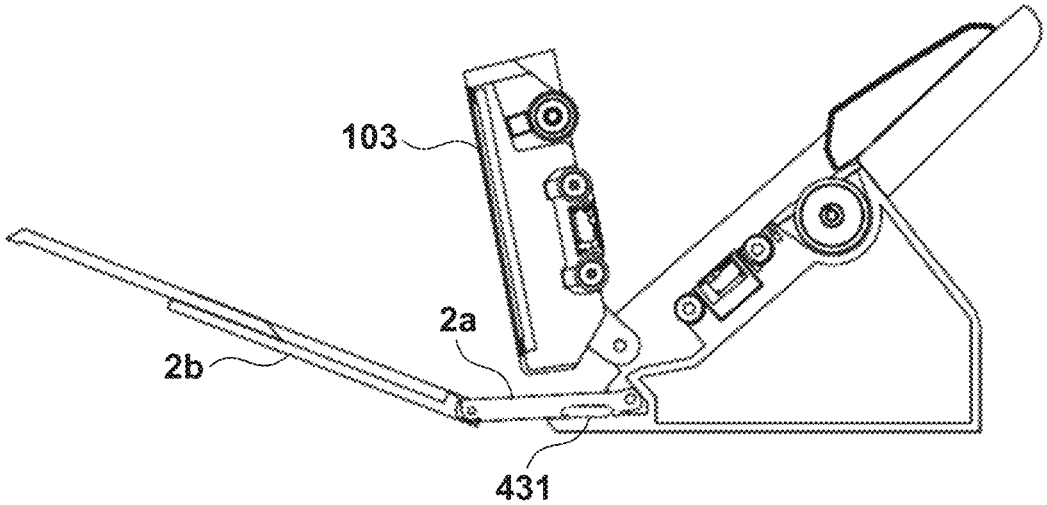
FIG. 27 is another schematic side sectional view showing the image reading apparatus according to the embodiment.
Figure 28:
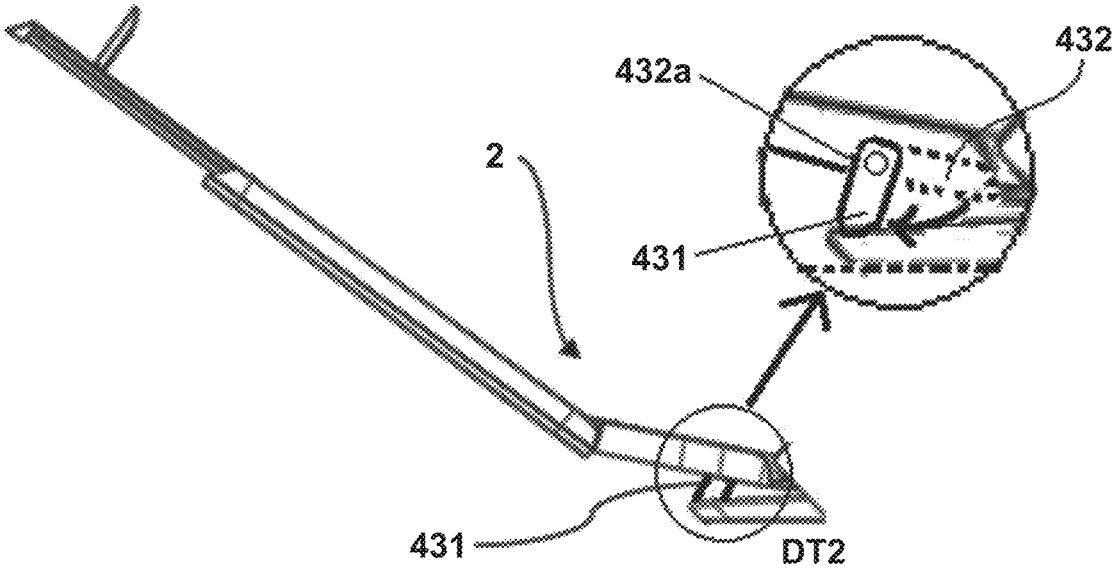
FIG. 28 is a schematic side view showing a discharge tray according to the embodiment.

As shown in FIGS. 26 to 28, a tray support portion 431 that abuts against the apparatus main body or the placement plane of the apparatus main body when a discharge tray 2 is opened is pivotably provided on the lower surface of a first discharge tray 2*a*. In the open state, the discharge tray 2 is supported by a protruding portion 130, and can receive a discharged conveyance medium S.

If the tray support portion 431 is made to pivot from a standby position to an operation position on the surface of the discharge tray 2, the tray support portion 431 abuts against the discharge tray 2 to support it, and the angle of the discharge tray 2 can be adjusted from the state shown in FIG. 9*a* in which the protruding portion 130 directly supports the discharge tray 2. Thus, since the discharge tray 2 is supported on the upper side in the vertical direction, as compared with a case in which the discharge tray 2 is supported without using the tray support portion 431, the angle formed by the discharge tray and the placement plane of the image reading apparatus A can be increased.

For example, in the state shown in FIG. 10*a*, the discharge tray 2 is lifted up in the vertical direction, as compared with the state shown in FIG. 9*a*, thereby making it possible to change a position at which the leading edge of the conveyance medium S lands on the upper surface of the discharge tray 2. Thus, in the state shown in FIG. 9*a*, if the leading edge of the conveyance medium S to be discharged abuts against the trailing edge of the already discharged conveyance medium S to push it, it is possible to make the leading edge of the succeeding conveyance medium S reliably land on the upper surface of the already discharged conveyance medium S in addition to the effect of shifting the trailing edge of the already discharged conveyance medium S toward the lower unit 104 by changing the angle of the discharge tray 2, as shown in FIG. 10*a*. With this configuration, it is possible to significantly improve the aligning property of the discharged conveyance media S on the discharge tray 2.

FIGS. 26 to 28 are side views each showing only a portion around the discharge tray 2 and the tray support portion 431 of the image reading apparatus A and an enlarged view showing a portion DT2 in FIG. 28.

The tray support portion 431 is arranged so that a pivot shaft is provided in the discharge tray 2. The pivot shaft of the tray support portion 431 is arranged on the downstream side in the sheet conveyance direction with respect to the position of the rotation hinge of the discharge tray 2, and can support the discharge tray 2 by pivoting from a position where the tray support portion 431 is stored in the discharge tray 2 to a position in which the tray support portion 431 is drawn out of the discharge tray 2.

Figure 29:
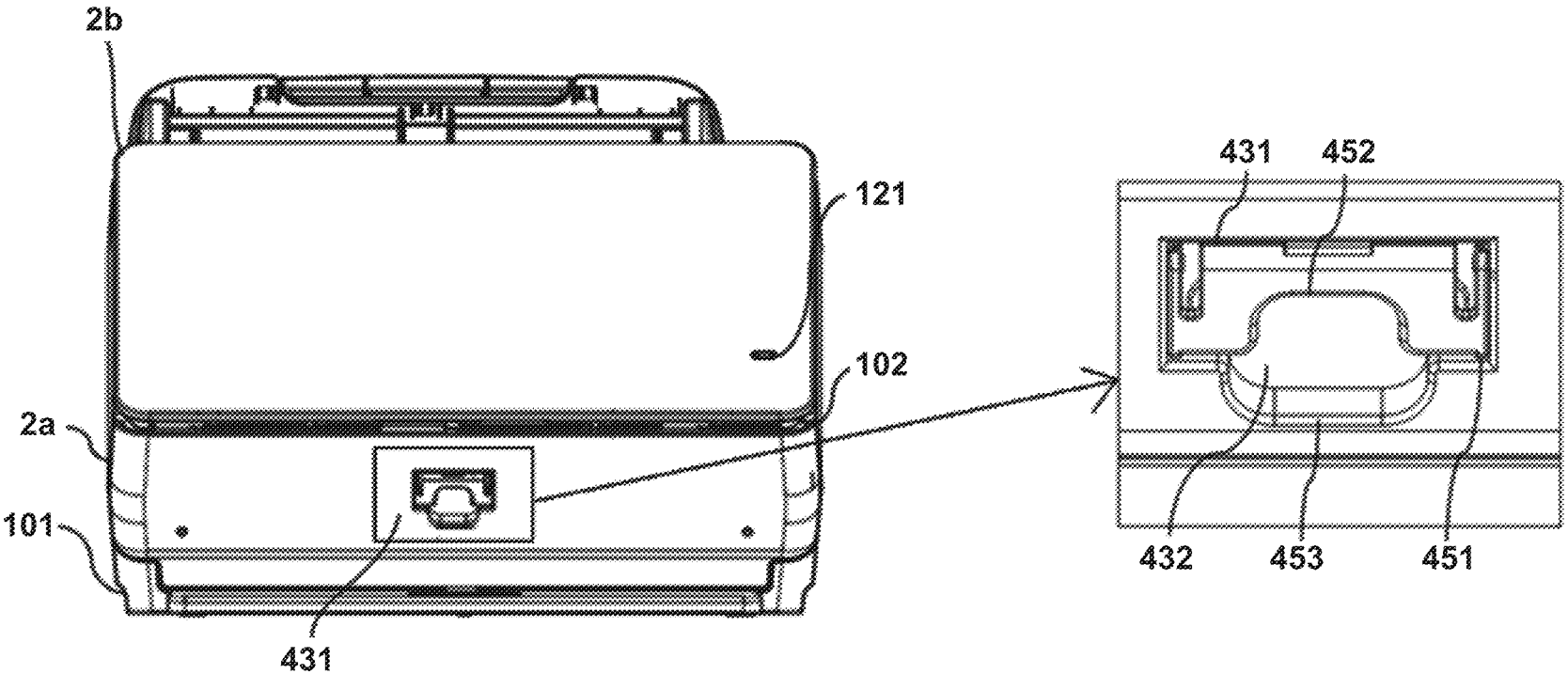
FIG. 29 shows a plan view and an enlarged view of the image reading apparatus according to the embodiment.

FIG. 29 shows a front view and a partially enlarged view each showing a state in which the discharge tray 2 of the image reading apparatus A is stored according to this embodiment.

The tray support portion 431 is arranged to be accommodated, as a whole, in a storing portion 432 provided in the discharge tray 2, and provided with a pivot shaft on the downstream side in the sheet conveyance direction with respect to the position of the rotation hinge of the discharge tray 2. When the tray support portion 431 is provided to be accommodated, as a whole, in the discharge tray 2, the protruding portion 130 can reliably abut against the discharge tray 2 in a state in which the tray support portion 431 is stored in the discharge tray 2. On a side of the tray support portion 431 opposite to the pivot shaft, a storing portion 452 for hooking a finger is provided at the center and convex portions 451 abutting against the protruding portion 130 are provided in two end portions.

A retraction portion 453 is provided at a position, in the storing portion 432, opposite to the concave portion 452 of the tray support portion 431, so that a finger of the user readily touches the concave portion 452.

In a state in which the tray support portion 431 pivots to protrude from the discharge tray 2, the convex portions 451 provided in the two end portions of the tray support portion 431 abut against the protruding portion 130. Since the important dimensions of components can be readily managed by limiting a portion against which the tray support portion 431 is made to butt, it is possible to suppress the influence of a tolerance or a variation on the angle of the discharge tray 2.

Figure 30:
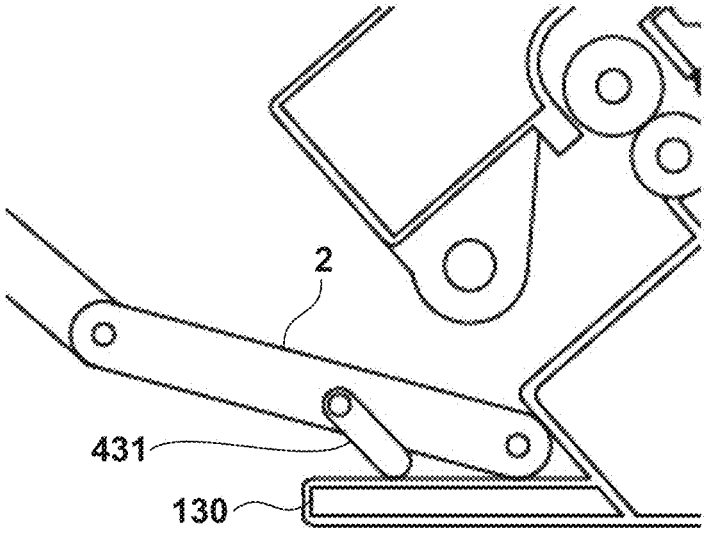
FIG. 30 is a side view showing a tray support portion according to the embodiment.

Note that as shown in FIG. 30, the tray support portion 431 may be configured to support the discharge tray 2 in the middle of the pivoting range by providing a sufficient sliding resistance to the hinge portion and distal end, thereby making it possible to adjust the angle of the discharge tray 2 in a plurality of stages. In this case, each conveyance medium S can be received at an angle at which the aligning property on the discharge tray 2 is best, thereby coping with various kinds of conveyance media S. Note that as a practical method of providing a sliding resistance to the discharge tray 2, there is a method of adhering a highly slidable material such as a rubber member to the rotation hinge and the distal end portion.

Figure 31:
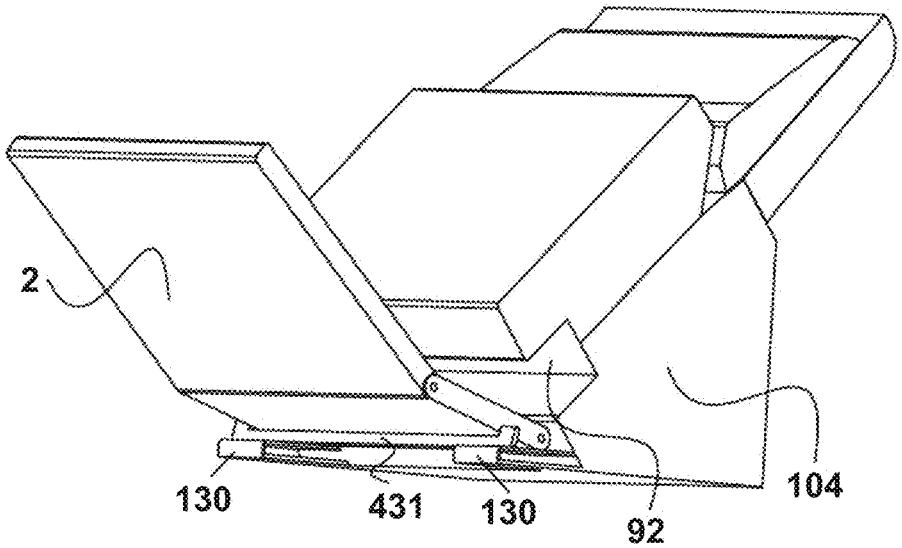
FIG. 31 is a perspective view showing the tray support portion according to the embodiment.

In this embodiment, the tray support portion 431 is supported by an abutting portion 432*a* of the discharge tray 2. However, it is only necessary to adopt a configuration in which a reaction acts on the tray support portion 431 to adjust the angle of the discharge tray 2 with respect to the discharge opening 92. For example, as shown in FIG. 31, the width of the tray support portion 431 may be made almost equal to that of the lower unit 104, the protruding portions 130 may be arranged in the two end portions of the lower unit 104, and the protruding portions 130 may support the tray support portion 431, thereby adjusting the angle of the discharge tray 2.

[Fifth Embodiment] A discharge tray angle adjustment mechanism of an image reading apparatus A according to the fifth embodiment of the present invention will be described next.

Note that the configurations and functions of the image reading apparatus A according to this embodiment are the same as in the above-described embodiments.

<Discharge Tray Angle Adjustment Mechanism 5>

Figure 33:
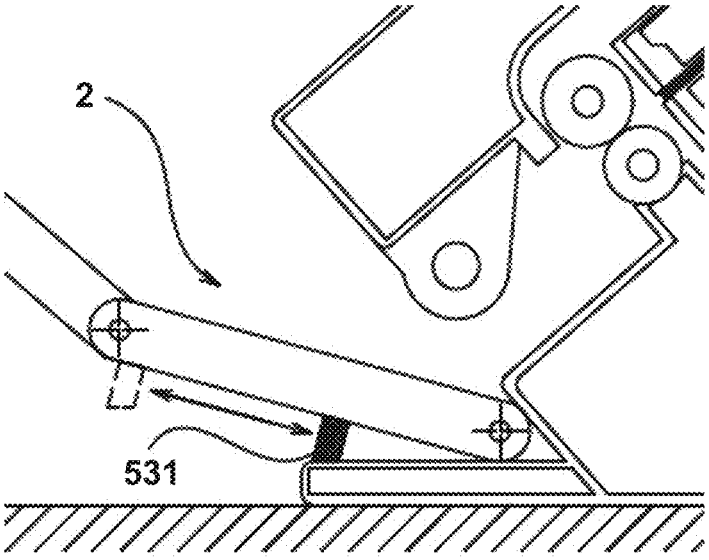
FIG. 33 is a side view showing a tray support portion according to the embodiment.

FIG. 33 is a side view showing a portion around a discharge tray 2 and a tray support portion 531 of the image reading apparatus A.

As shown in FIG. 33, the tray support portion 531 that abuts against an apparatus main body or the placement plane of the apparatus main body when the discharge tray 2 is opened is movably provided on the lower surface of a first discharge tray 2*a*. In the open state, the discharge tray 2 is supported by a protruding portion 130, and can receive a discharged conveyance medium S. If the tray support portion 531 is moved from a standby position to an operation position on the surface of the discharge tray 2, the tray support portion 531 abuts against the protruding portion 130 to support the discharge tray 2, and the angle of the discharge tray 2 can be adjusted from the state in which the protruding portion 130 directly supports the discharge tray 2. Thus, since the discharge tray 2 is supported on the upper side in the vertical direction, as compared with a case in which the discharge tray 2 is supported without using the tray support portion 531, the angle formed by the discharge tray 2 and the placement plane of the image reading apparatus A can be increased.

The tray support portion 531 is arranged to be movable in a direction almost parallel to the surface of the discharge tray 2. The moving region of the tray support portion 531 is almost linearly arranged from the distal end side to the rear end side of the discharge tray 2. When the tray support portion 531 moves from a distal end position where the tray support portion 531 does not butt against the protruding portion 130 to a rear end position where the tray support portion 531 butts against the protruding portion 130, the discharge tray 2 can be supported.

Within a region where the tray support portion 531 butts against the protruding portion 130, as the tray support portion 531 is closer to the distal end of the discharge tray 2, the angle formed by the discharge tray 2 and the placement plane of the image reading apparatus A is smaller. As the tray support portion 531 is farther away from the distal end of the discharge tray 2, that is, as the tray support portion 531 is closer to the apparatus main body, the angle formed by the discharge tray 2 and the placement plane of the image reading apparatus A is larger.

Figure 34:
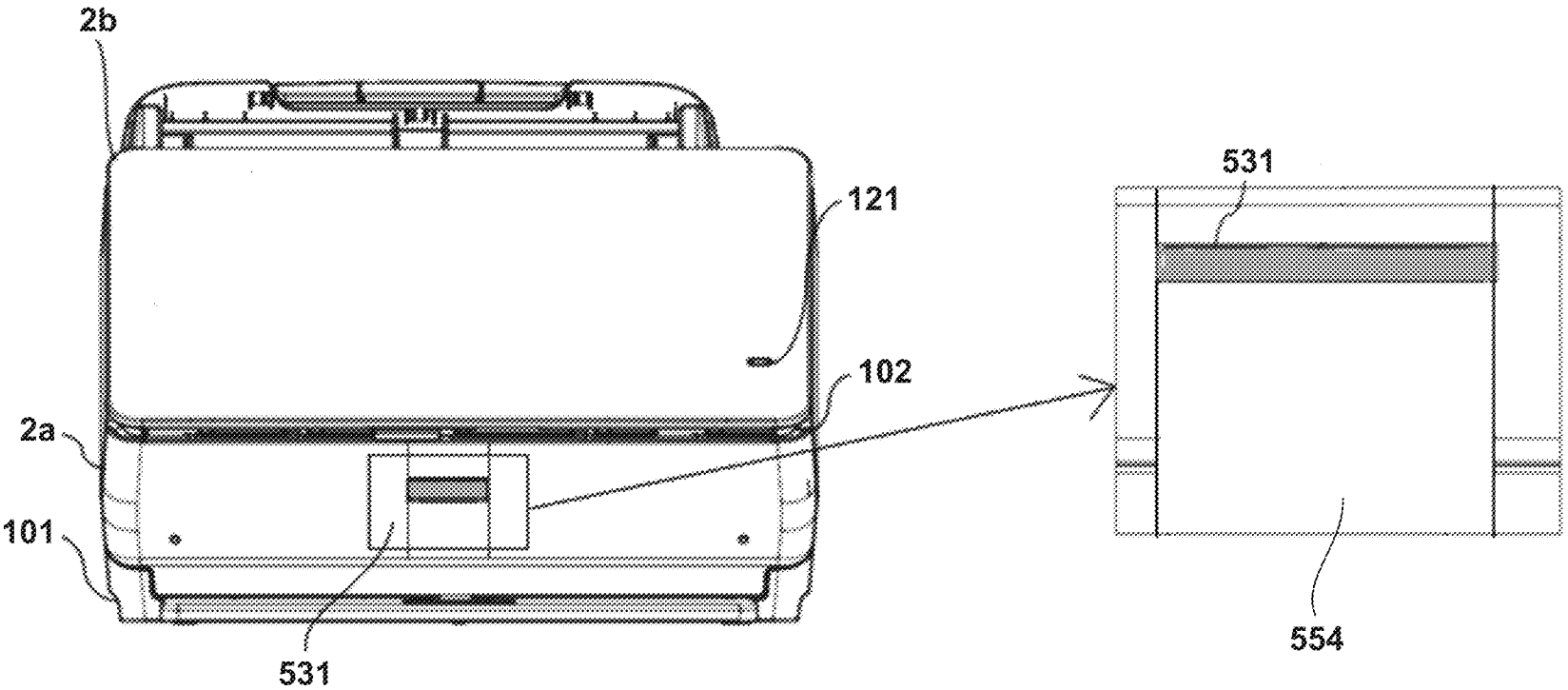
FIG. 34 shows a plan view and an enlarged view of an image reading apparatus according to the embodiment.

FIG. 34 shows a front view and a partially enlarged view each showing a state in which the discharge tray 2 of the image reading apparatus A is stored according to this embodiment.

The tray support portion 531 is arranged in a slide groove 554 formed in the discharge tray 2 to be movable along the groove, and a sliding frictional resistance is generated between the slide groove 554 and the tray support portion 531. On a side of the tray support portion 531 opposite to the slide groove 554, convex portions that abut against the protruding portion 130 are provided in two end portions, similarly to mechanism 2 described above.

[Sixth Embodiment] A discharge tray angle adjustment mechanism of an image reading apparatus A according to the sixth embodiment of the present invention will be described next.

Note that the configurations and functions of the image reading apparatus A according to this embodiment are the same as in the above-described embodiments.

<Discharge Tray Angle Adjustment Mechanism 6>

Figure 35:
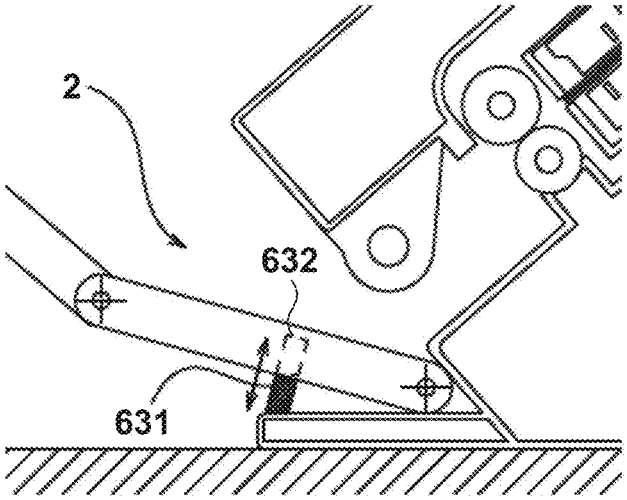
FIG. 35 is a side view showing a tray support portion according to the embodiment.

FIG. 35 is a side view showing a portion around a discharge tray 2 and a tray support portion 631 of the image reading apparatus A.

As shown in FIG. 35, the tray support portion 631 that abuts against an apparatus main body or the placement plane of the apparatus main body when the discharge tray 2 is opened is movably provided on the lower surface of a first discharge tray 2*a*. In the open state, the discharge tray 2 is supported by a protruding portion 130, and can receive a discharged conveyance medium S. If the tray support portion 631 is moved from a standby position to an operation position on the surface of the discharge tray 2, the tray support portion 631 abuts against the protruding portion 130 to support the discharge tray 2, and the angle of the discharge tray 2 can be adjusted from the state in which the protruding portion 130 directly supports the discharge tray 2. Thus, since the discharge tray 2 is supported on the upper side in the vertical direction, as compared with a case in which the discharge tray 2 is supported without using the tray support portion 631, the angle formed by the discharge tray and the placement plane of the image reading apparatus A can be increased.

The tray support portion 631 is arranged to be movable in a direction almost perpendicular to the surface of the discharge tray 2. The moving region of the tray support portion 631 includes a position where the tray support portion 631 is almost stored in the discharge tray 2 without butting against the protruding portion 130. When the tray support portion 631 moves to a position where it butts against the protruding portion 130, the discharge tray 2 can be supported. Since the moving amount of the tray support portion 631 is arbitrary, as the tray support portion 631 protrudes from the discharge tray 2 more, the angle formed by the discharge tray 2 and the placement plane of the image reading apparatus A is larger.

Figure 36:
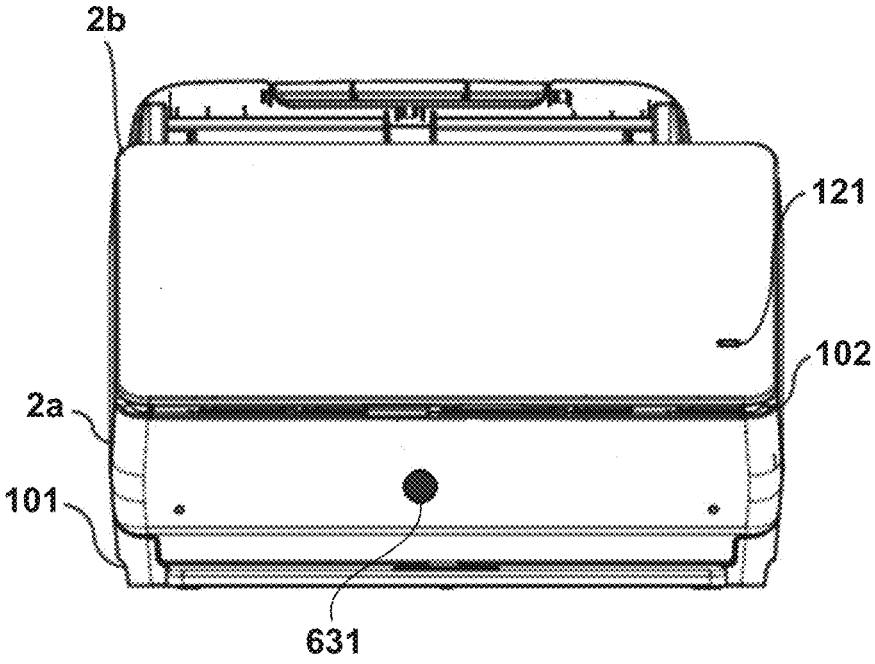
FIG. 36 is a plan view showing an image reading apparatus according to the embodiment.

FIG. 36 is a front view showing a state in which the discharge tray 2 of the image reading apparatus A is stored according to this embodiment.

The tray support portion 631 is a columnar member having a thread groove, and is rotated and inserted into a storing hole 632 having a thread groove and formed in the discharge tray 2. Note that the tray support portion 631 may be provided as a columnar member having a thread groove in the protruding portion 130 shown in FIG. 35. By having the thread groove, the tray support portion 631 can be vertically inserted/removed into/from the protruding portion 130. When the abutting position with respect to the discharge tray 2 changes, the angle formed by the discharge tray 2 and the image reading apparatus A increases. For example, a knob portion may be provided in the upper portion of the columnar member. In this case, when the knob portion faces in a direction perpendicular to the conveyance direction, the tray support portion 631 may be stored in the protruding portion 130 not to abut against the discharge tray 2. When the knob portion faces in a direction parallel to the conveyance direction, the tray support portion 631 may protrude from the protruding portion 130 to abut against the discharge tray 2. By making it possible to adjust the protrusion amount of the tray support portion 631 from the protruding portion 130 in accordance with an amount by which the tray support portion 631 is rotated by holding the knob portion with a thread groove, it may be possible to adjust the angle formed by the discharge tray 2 and the image reading apparatus A in multiple stages.

Note that the configuration in which the tray support portion 431, 531, or 631 butts against the protruding portion 130 has been explained. However, if the protruding portion 130 becomes large, the placement area of the apparatus main body also becomes large, and thus this configuration is not preferable. To implement a configuration in which the tray support portion 431, 531, or 631 butts against the protruding portion 130, the tray support portion 431, 531, or 631 naturally needs to be arranged near the hinge of the discharge tray 2, which imposes a restriction on the configuration.

If, however, the tray support portion 431, 531, or 631 is arranged near the hinge, when the tray support portion 431, 531, or 631 slightly moves, the angle of the discharge tray 2 largely changes.

Figure 32:
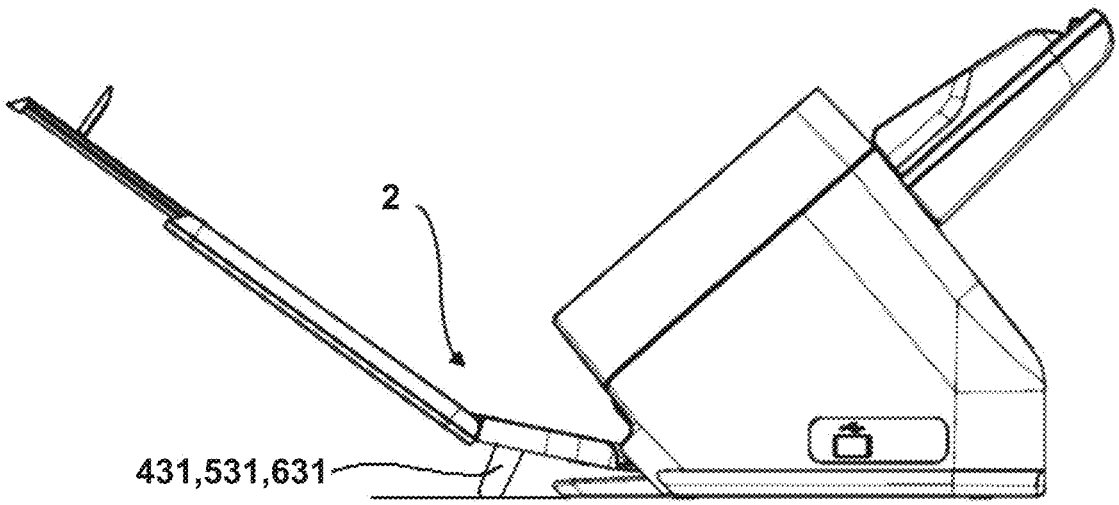
FIG. 32 is a side view showing a tray support portion according to the embodiment.

Therefore, in this embodiment, a configuration in which the tray support portion directly butts against the placement plane, as shown in FIG. 32, is more preferable. With this configuration, the tray support portion 431, 531, or 631 can be arranged in the discharge tray 2 regardless of the size of the protruding portion 130. Thus, the tray support portion 431, 531, or 631 can be arranged at the distal end of the discharge tray, as compared with a case in which the tray support portion 431, 531, or 631 butts against the protruding portion 130. It is, therefore, possible to finely adjust the angle of the discharge tray 2 at high accuracy, and minimize the protruding portion 130, thereby effectively downsizing the apparatus.

[Seventh Embodiment] A discharge tray angle adjustment mechanism of an image reading apparatus A according to the seventh embodiment of the present invention will be described next.

Note that the configurations and functions of the image reading apparatus A according to this embodiment are the same as in the above-described embodiments.

<Discharge Tray Angle Adjustment Mechanism 7>

Figure 37:
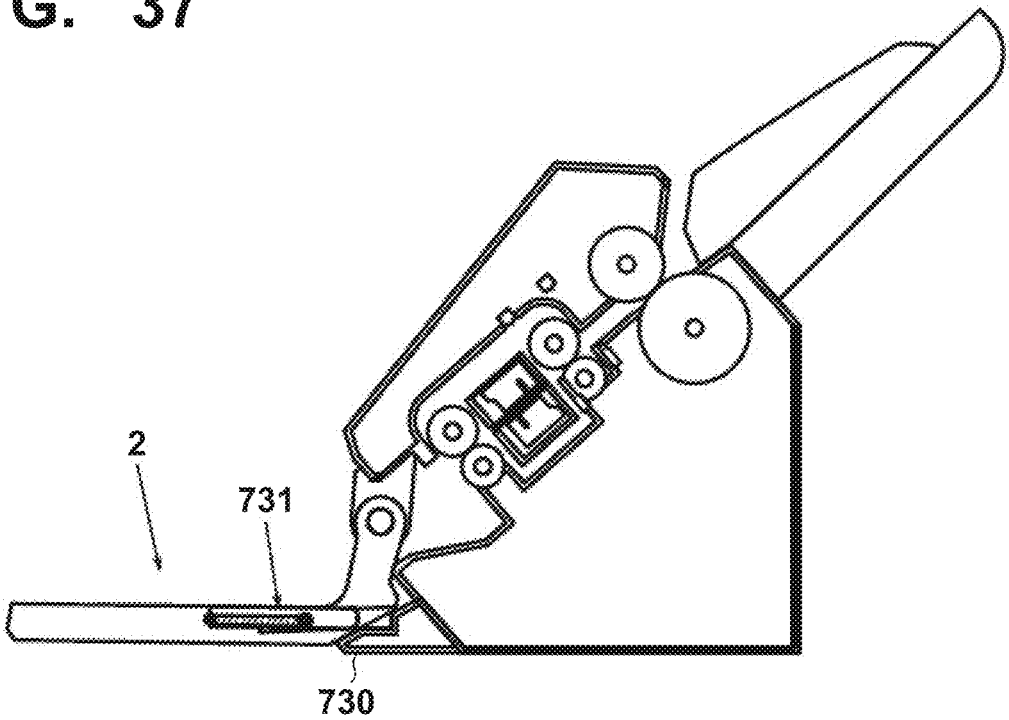
FIG. 37 is a schematic side sectional view showing an image reading apparatus according to the embodiment.
Figure 38:
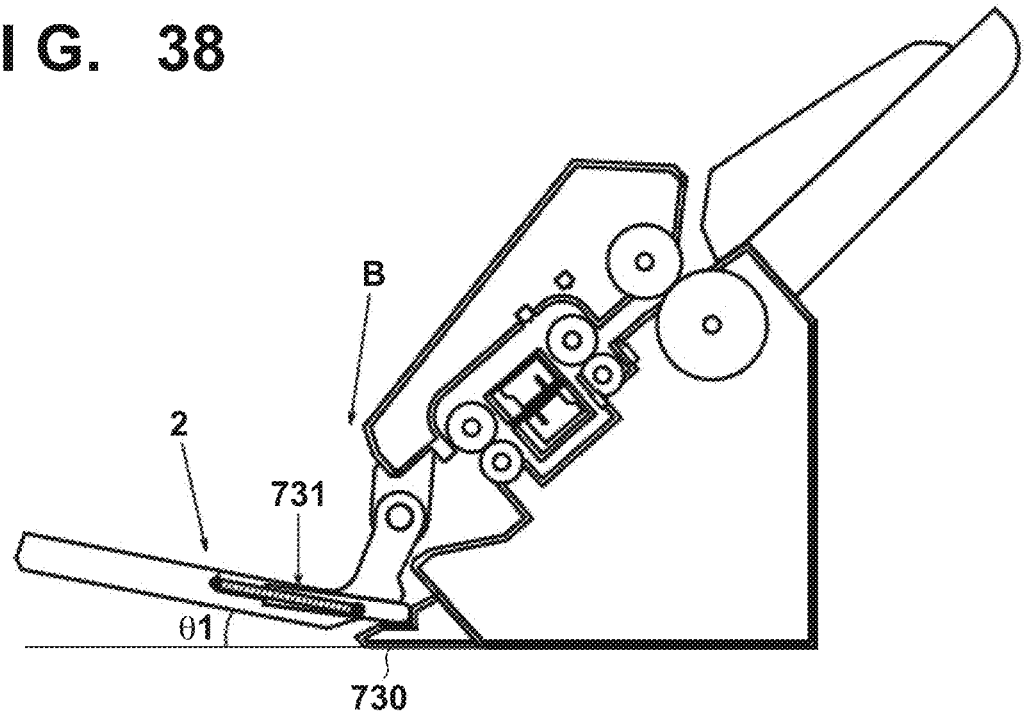
FIG. 38 is a schematic side sectional view showing the image reading apparatus according to the embodiment.

As shown in FIG. 37, a tray support portion 731 that abuts against a protruding portion 730 when a discharge tray 2 is opened is provided at an upstream-side position in a conveyance direction in the discharge tray 2 to be slidable. The discharge tray 2 is supported by the protruding portion 730 in the open state, and configured to receive a discharged conveyance medium S. As shown in FIG. 38, if the tray support portion 731 is made to slide to protrude from the upstream side of the discharge tray 2 in the conveyance direction, a convex portion 751 of the tray support portion 731 abuts against the protruding portion 730 to support the discharge tray. Furthermore, an angle θ1 formed by the discharge tray and the placement plane of the image reading apparatus A can be increased, as compared with a case in which the tray support portion 731 abuts against the protruding portion 730 at a position where the tray support portion 731 is stored in the discharge tray 2.

For example, in the state shown in FIG. 38, the angle θ1 formed by the discharge tray and the placement plane of the image reading apparatus A is large, as compared with the state shown in FIG. 37, and it is possible to change a position where the leading edge of the conveyance medium S lands on a surface of the discharge tray 2 onto which the conveyance medium S is discharged. Thus, in the state shown in FIG. 37, if conveyance media S of different sizes are conveyed at the same time (conveyance of different kinds of media), the leading edge of the conveyance medium S to be discharged abuts against the trailing edge of the already discharged conveyance medium S to push it. In this case, it is possible to make the leading edge of the succeeding conveyance medium S reliably land on the upper surface of the already discharged conveyance medium S in addition to the effect of shifting the trailing edge of the already discharged conveyance medium S toward a lower unit 104 by changing the angle of the discharge tray 2, as shown in FIG. 38. This configuration can significantly improve the aligning property of the discharged conveyance media S on the discharge tray 2.

Figure 39:
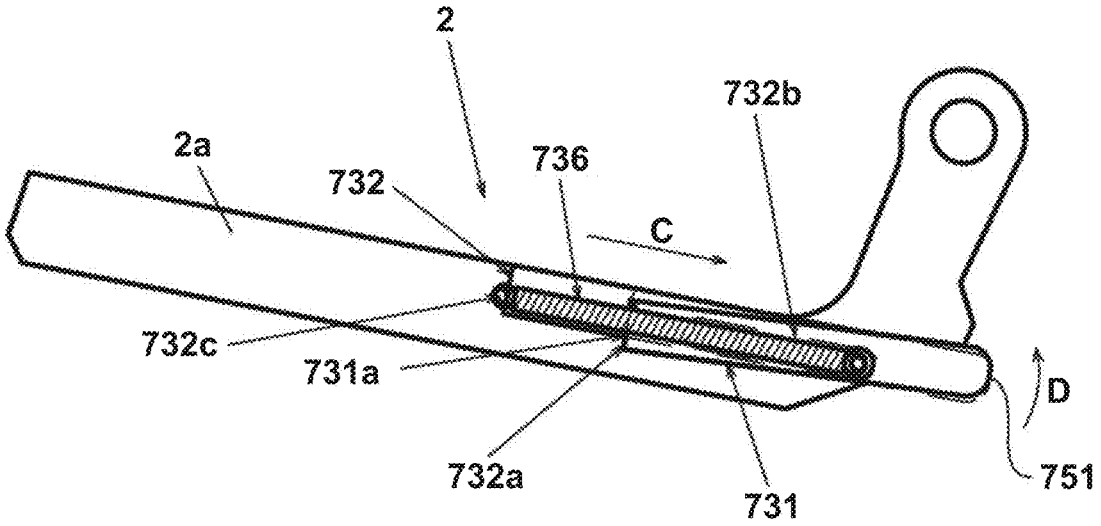
FIG. 39 is a side sectional view showing a tray support portion according to the embodiment.

FIG. 39 is a sectional view showing the discharge tray 2. The tray support portion 731 is arranged on the upstream side of the discharge tray 2 in the conveyance direction, and provided to be slidable between a position where the tray support portion 731 is stored in the discharge tray 2 and a position where the tray support portion 731 protrudes to the upstream side in the conveyance direction. At the protruding position, the convex portion 751 abuts against the protruding portion 730 to support the discharge tray 2 when the discharge tray 2 is opened.

The tray support portion 731 is movable in the direction of an arrow C when rotating shafts 731*b* provided on the left and right sides enter rail portions 732*b* of the discharge tray 2. Furthermore, the tray support portion 731 can pivot about the rotating shafts 731*b* at a predetermined position. A tray support portion storing hole 732 includes abutting portions 732*a*, and the abutting portions 732*a* abut against butting surfaces 731*a* only when the tray support portion 731 pivots in the direction of an arrow D at a predetermined position. The tray support portion 731 drawn out is attached with a biasing member 736 that exerts a force in a direction opposite to that of the arrow C, and the other end of the tray support portion 731 is attached to a projecting portion 732*c* of the first discharge tray 2*a*. If the tray support portion 731 is made to pivot in the same rotation direction as that of the discharge tray 2 at a predetermined position, the butting surfaces 731*a* abut against the abutting portions 732*a*, are pressed by the biasing force of the biasing member 736, and are thus stably supported. When the tray support portion 731 supports the discharge tray 2, the butting surfaces 731*a* abut against the abutting portions 732*a* of the tray support portion storing hole 732, and thus the tray support portion 731 receives a reaction in a direction toward the discharge opening 92, thereby stably supporting the discharge tray 2.

The tray support portion 731 is arranged to be accommodated, as a whole, in the tray support portion storing hole 732 formed in the discharge tray 2. When the tray support portion 731 is provided to be accommodated, as a whole, in the discharge tray 2, the protruding portion 730 can reliably abut against the discharge tray 2 in a state in which the tray support portion 731 is stored in the discharge tray 2.

Figure 40:
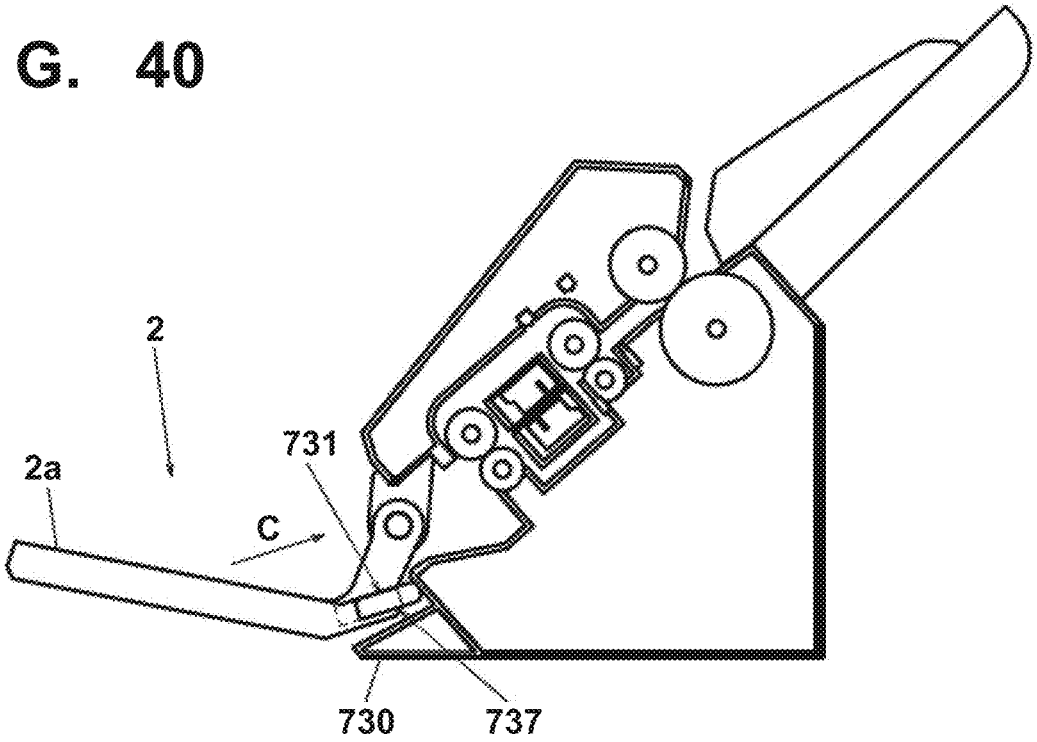
FIG. 40 is a schematic side sectional view showing the image reading apparatus according to the embodiment.

However, if the angle of the discharge tray 2 is changed, a gap is generated between the protruding portion 730 and a first discharge tray rear end portion 737 of the first discharge tray 2*a*. If there is a gap between the protruding portion 730 and the first discharge tray rear end portion 737, the discharged conveyance medium S may enter the gap. To cope with this, as shown in FIG. 40, the tray support portion 731 is arranged to protrude in the direction of the arrow C. In this case, the gap between the protruding portion 730 and the first discharge tray rear end portion 737 can be filled, thereby stably receiving the discharged conveyance medium S.

Figure 41:
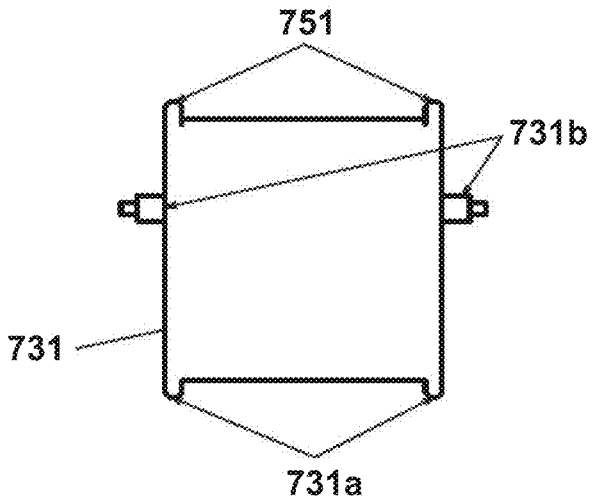
FIG. 41 is a plan sectional view showing the tray support portion according to the embodiment.

FIG. 41 shows the tray support portion 731 when viewed from the direction of an arrow B in FIG. 38. The convex portions 751 provided in the two end portions of the tray support portion 731 abut against the protruding portion 730 at a position where the tray support portion 731 protrudes from the discharge tray 2 to the upstream side in the conveyance direction. The butting surfaces 731*a* provided in the two end portions opposite to the convex portions 751 abut against the abutting portions 732*a*. This can suppress the influence of a tolerance or a variation on the angle of the discharge tray 2. Furthermore, if the width of the tray support portion 731 is made almost equal to that of the first discharge tray 2*a*, it is possible to eliminate a gap generated between the discharge tray 2 and the protruding portion 730 when adjusting the angle of the discharge tray 2.

Figure 42:
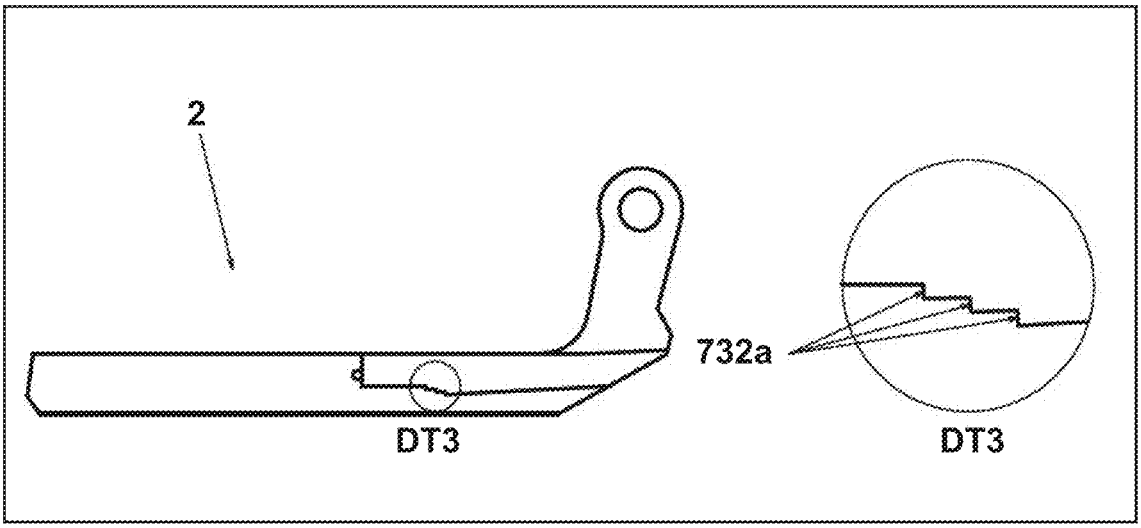
FIG. 42 is a side view showing the tray support portion according to the embodiment.
Figure 43A:
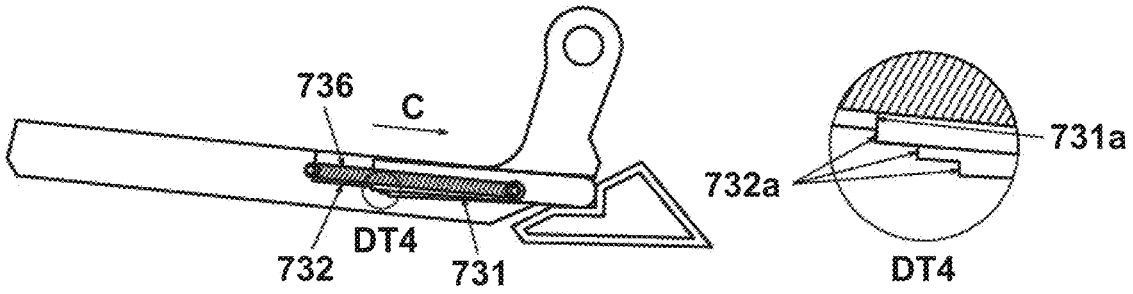
FIG. 43*a* is a side sectional view showing the tray support portion according to the embodiment.
Figure 43B:
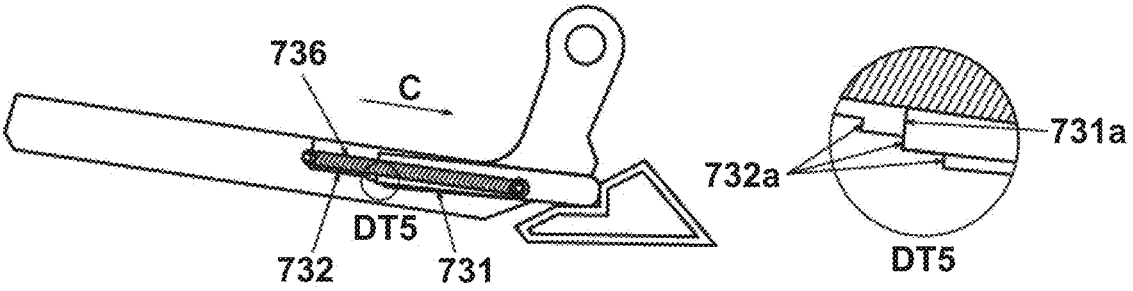
FIG. 43*b* is a side sectional view showing the tray support portion according to the embodiment.
Figure 43C:
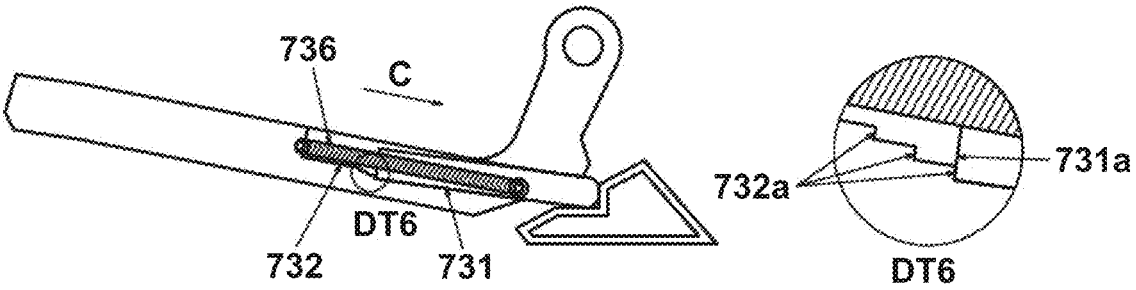
FIG. 43*c* is a side sectional view showing the tray support portion according to the embodiment.

Note that the tray support portion 731 may be configured to support the discharge tray 2 even in the middle of the slide range, thereby adjusting the angle of the discharge tray 2 in a plurality of stages. FIG. 42 shows a side view of the discharge tray 2 and shows an enlarged view of a range DT3 on the right side. As shown in FIG. 42, three stages of abutting portions 732*a* are formed in a staircase pattern in the tray support portion storing hole 732. FIGS. 43*a* to 43*c* each show a state in which the tray support portion 731 is moved to the position of each stage of the abutting portions 732*a*. FIGS. 43*a* to 43*c* respectively show enlarged views of ranges DT4 to DT6 on the right side. The biasing member 736 that exerts a force in the direction opposite to that of the arrow C has one end attached to the tray support portion 731 and the other end attached to the first discharge tray. If the tray support portion 731 pivots in the same rotation direction as that of the discharge tray 2 at the position of one of the stages of the three abutting portions 732*a*, the butting surfaces 731*a* abut against the abutting portion 732*a*, are pressed by the biasing force of the biasing member 736, and are thus stably supported. When the tray support portion 731 supports the discharge tray 2, the butting surfaces 731*a* abut against the abutting portions 732*a* of the tray support portion storing hole 732, and thus the tray support portion 731 receives a reaction in a direction toward the discharge opening 92, thereby stably supporting the discharge tray 2. Furthermore, by making the butting surfaces 731*a* abut against the abutting portions 732*a* of another one of the three stages, the angle θ1 formed by the discharge tray can be changed. In this case, each conveyance medium S can be received at an angle at which the aligning property on the discharge tray 2 is best, thereby improving convenience. Furthermore, in FIGS. 42 and 43, the three stages of the abutting portions 732*a* are provided. The present invention is not limited to this, and a plurality of stages of abutting portions 732*a* such as four or five stages of abutting portions 732*a* can be provided to use each angle depending on the type of conveyance medium S.

Figure 44:
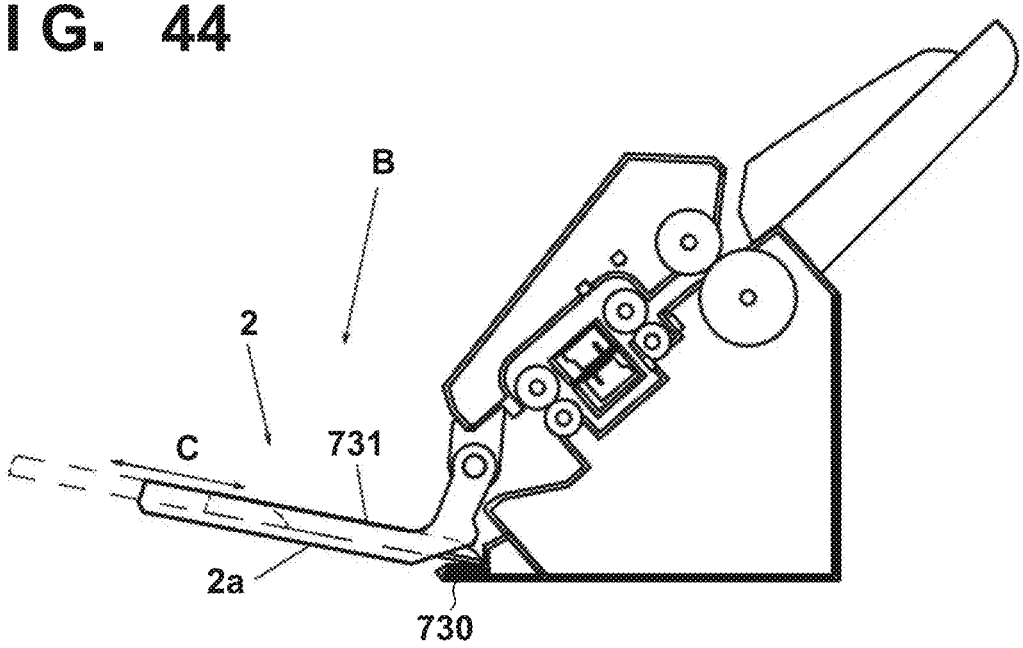
FIG. 44 is a schematic side sectional view showing the image reading apparatus according to the embodiment.
Figure 45:
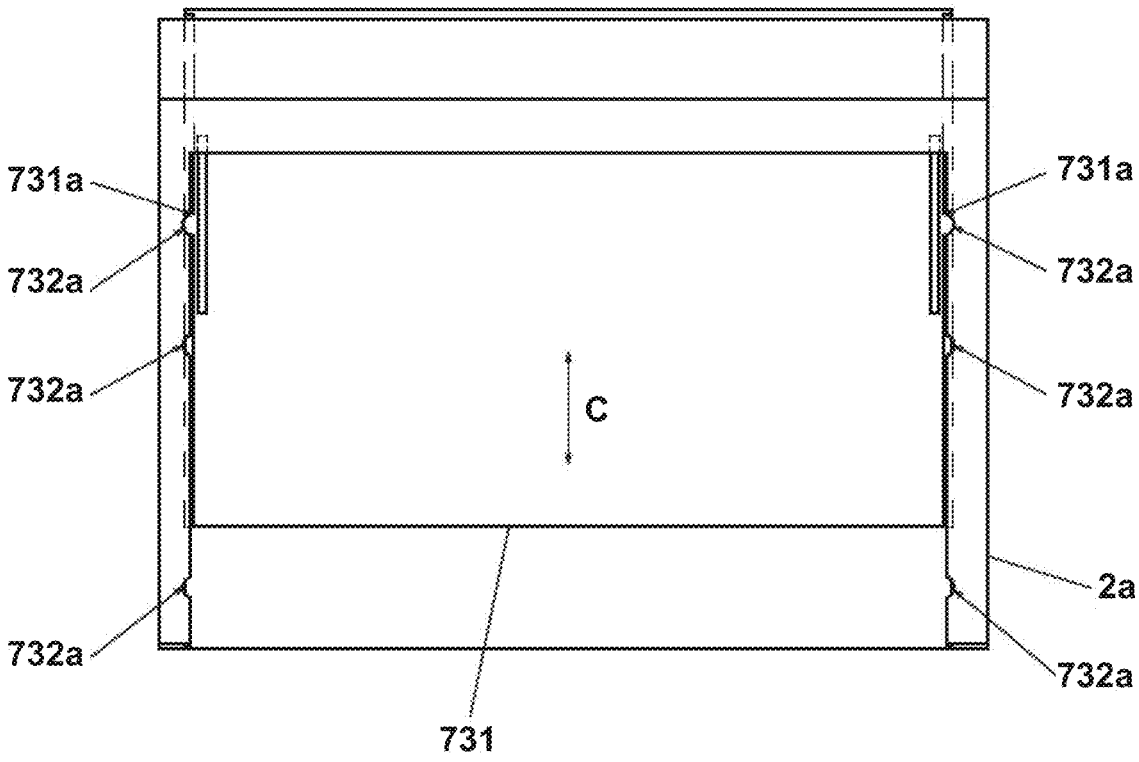
FIG. 45 is a plan view showing the tray support portion according to the embodiment.

FIG. 44 shows a state in which the tray support portion 731 also serves as an extension tray. The tray support portion 731 can also serve as an extension tray by sliding to a position where the tray support portion 731 protrudes from the first discharge tray 2*a* to the downstream side in the conveyance direction. FIG. 45 is a view showing the discharge tray 2 when viewed from the direction of the arrow B. As shown in FIG. 45, when the tray support portion 731 moves to a position where it protrudes from the first discharge tray 2*a*, the butting surfaces 731*a* of the tray support portion 731 mesh with the abutting portions 732*a* of the first discharge tray 2*a*. The first discharge tray 2*a* is also provided with the butting surfaces 731*a* at a position where the tray support portion 731 is stored and a position where the tray support portion 731 is extended to the downstream side in the conveyance direction. This can reliably determine the position of the tray support portion 731, thereby stably adjusting the angle. In addition, the discharge aligning property of the conveyance medium S of a small size such as a business card or check can be improved. Furthermore, since it is unnecessary to provide the second discharge tray 2*b* and the extension tray 301, it is possible to reduce the number of components. If a sheet of a large size that cannot be received only by the first discharge tray 2*a* is discharged, the tray support portion is used as an extension tray without adjusting the angle of the discharge tray 2.

Figure 46:
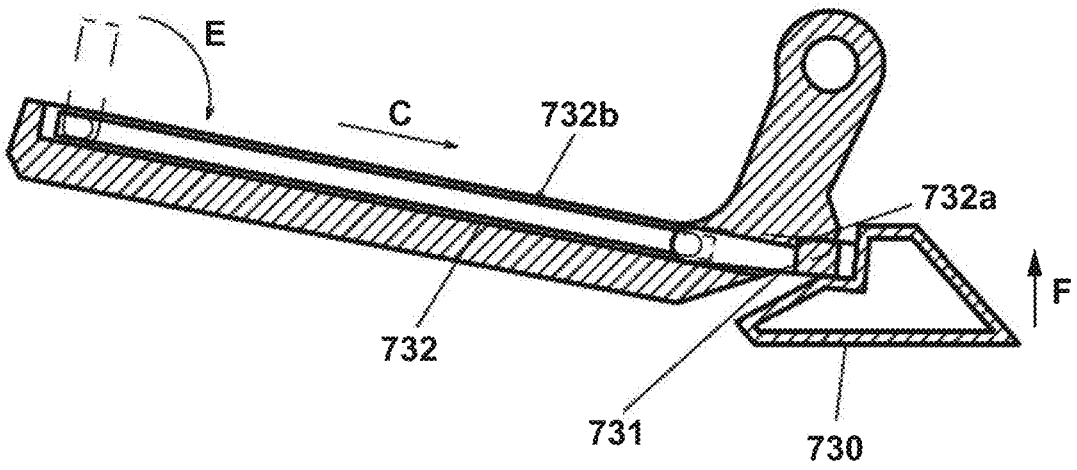
FIG. 46 is a side sectional view showing the tray support portion according to the embodiment.
Figure 47:
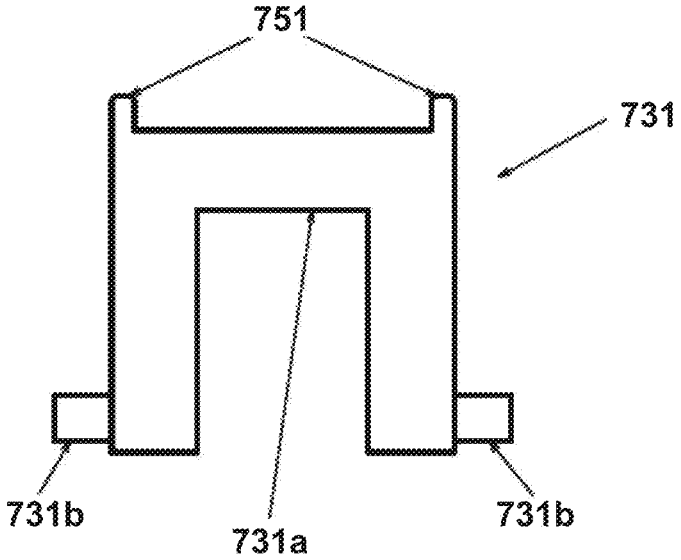
FIG. 47 is a plan view showing the tray support portion according to the embodiment.

FIG. 46 is a sectional view showing the discharge tray 2. As shown in FIG. 46, the tray support portion 731 also serves as a discharge stopper that receives the discharged conveyance medium S. The discharge stopper is a component against which the leading edge of the discharged conveyance medium S butts to be aligned. FIG. 47 is a view showing the tray support portion 731 viewed from the front side. The rotating shafts 731*b* of the tray support portion 731 are supported to be movable along the rail portions 732*b* of the first discharge tray 2*a*. Furthermore, the tray support portion 731 can pivot about the rotating shafts 731*b*, and can be maintained in an upright state by sliding resistances between the rotating shafts 731*b* and the rail portions 732*b*. The tray support portion 731 pivots in the direction of an arrow E from the state in which the tray support portion 731 stands upright as a discharge stopper, and slides in the direction of an arrow C, thereby moving to a position where the tray support portion 731 protrudes from the first discharge tray 2*a*. Furthermore, when the tray support portion 731 pivots in the direction of an arrow F at the position where the tray support portion 731 protrudes from the first discharge tray 2*a*, the abutting portions 732*a* abut against the butting surfaces 731*a*, thereby making it possible to stably support the discharge tray 2 even if the tray support portion 731 abuts against the protruding portion 730. In this way, if it is desirable to align the discharged conveyance medium S at the trailing edge, the tray support portion 731 can be used as a tray support portion, and if it is desirable to align the discharged conveyance medium S at the leading edge, the tray support portion 731 can be used as a discharge stopper. Since one component can serve as two functions without impairing the function, it is possible to further improve the discharge aligning property.

Figure 48:
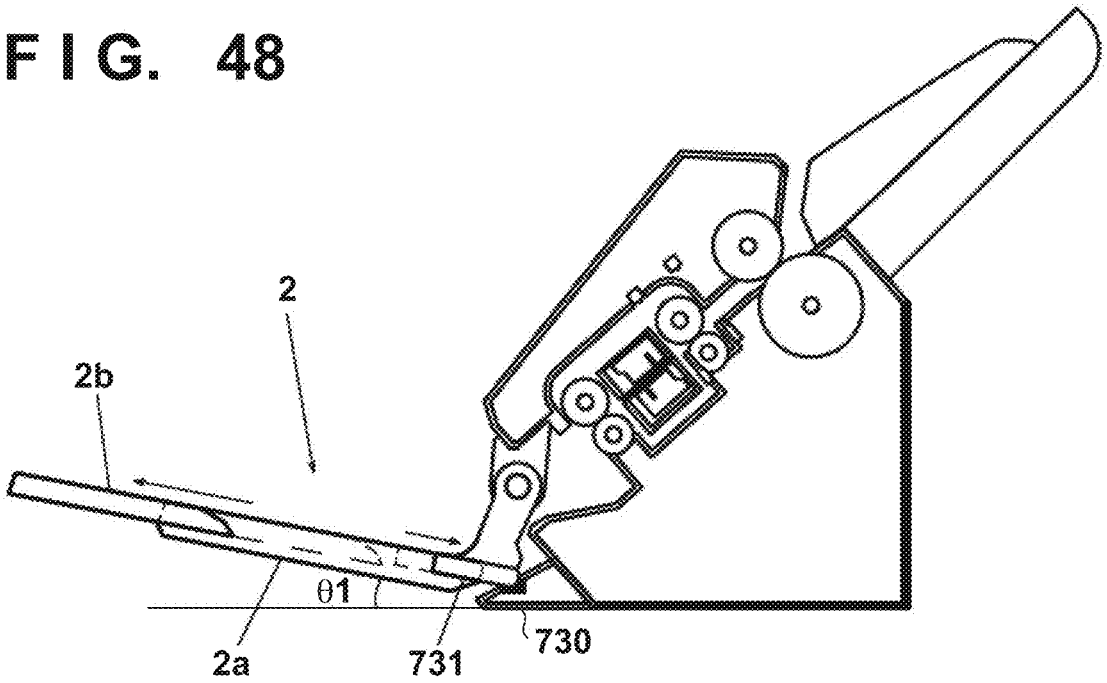
FIG. 48 is a schematic side sectional view showing the image reading apparatus according to the embodiment.
Figure 49:
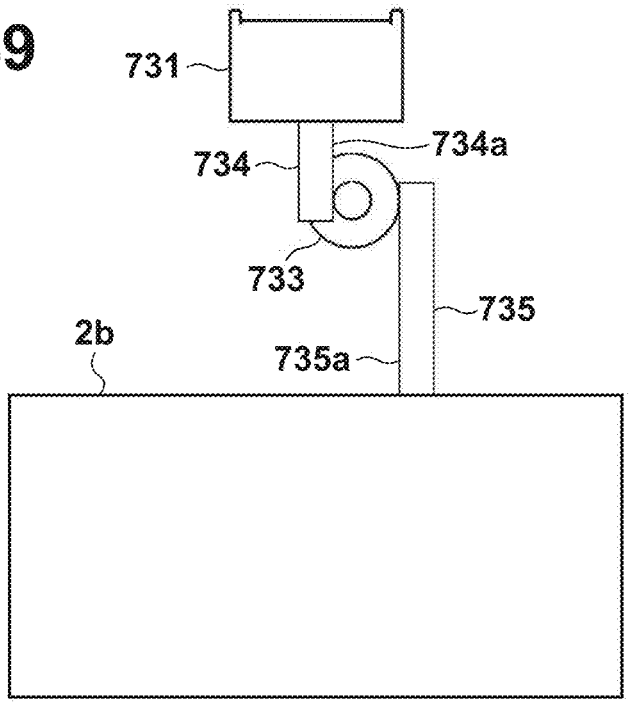
FIG. 49 is a view showing the configuration of the tray support portion according to the embodiment.

As shown in FIG. 48, the tray support portion 731 may move in synchronism with an operation of drawing out a first extension tray (the second discharge tray) 2*b*. Referring to FIG. 48, if the first extension tray 2*b* is drawn out to the downstream side in the conveyance direction, the tray support portion 731 moves to the abutting position in synchronism with the operation. FIG. 49 is a view showing a mechanism for moving the tray support portion 731 and the first extension tray 2*b* in synchronism with each other when viewed from the upper side. A tray support portion rack gear 734 is connected to the tray support portion 731, a first extension tray rack gear 735 is connected to the first extension tray 2*b*, and a tray support portion rack gear flank 734*a* and a first extension tray rack gear flank 735*a* mesh with a pinion gear arranged between the tray support portion 731 and the first extension tray 2*b*. If one of the tray support portion 731 and the first extension tray 2*b* is moved, the other also moves in synchronism with it. In this case, since it is possible to move the tray support portion 731 by an operation of only drawing out the first extension tray 2*b*, it is possible to readily adjust the angle of the discharge tray 2 while the conveyance medium S is discharged. Furthermore, by using, as the first extension tray rack gear 735, a stepped gear formed by two kinds of gears having different numbers of teeth, the tray support portion 731 can be moved by a distance shorter than that by which the first extension tray 2*b* is moved.

Figure 50:
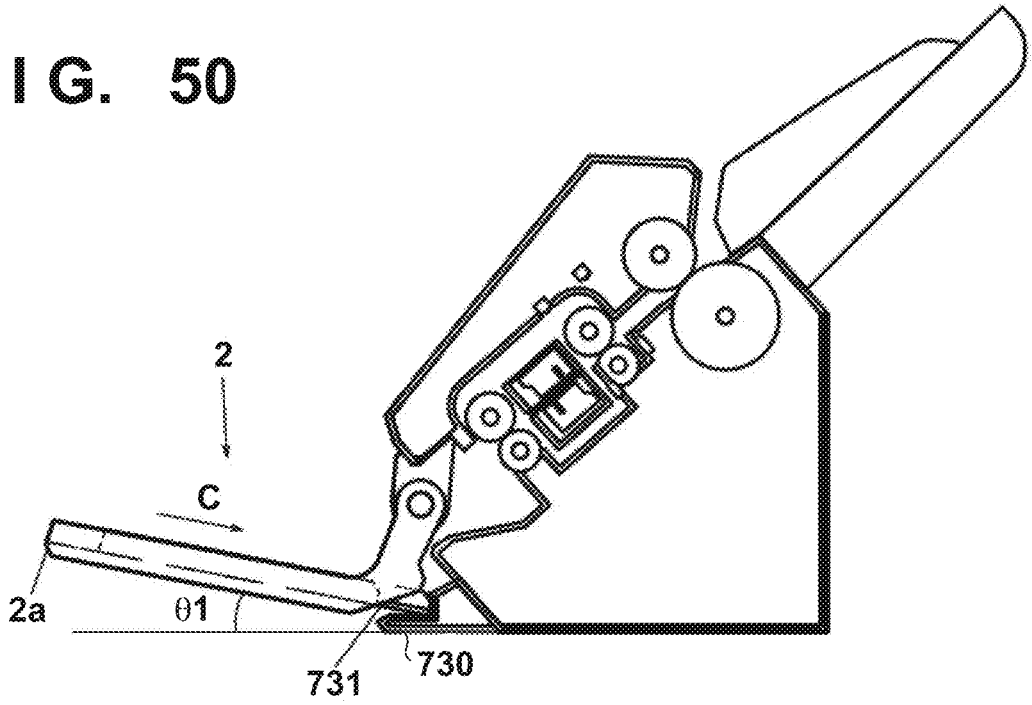
FIG. 50 is a schematic side sectional view showing the image reading apparatus according to the embodiment.
Figure 51:
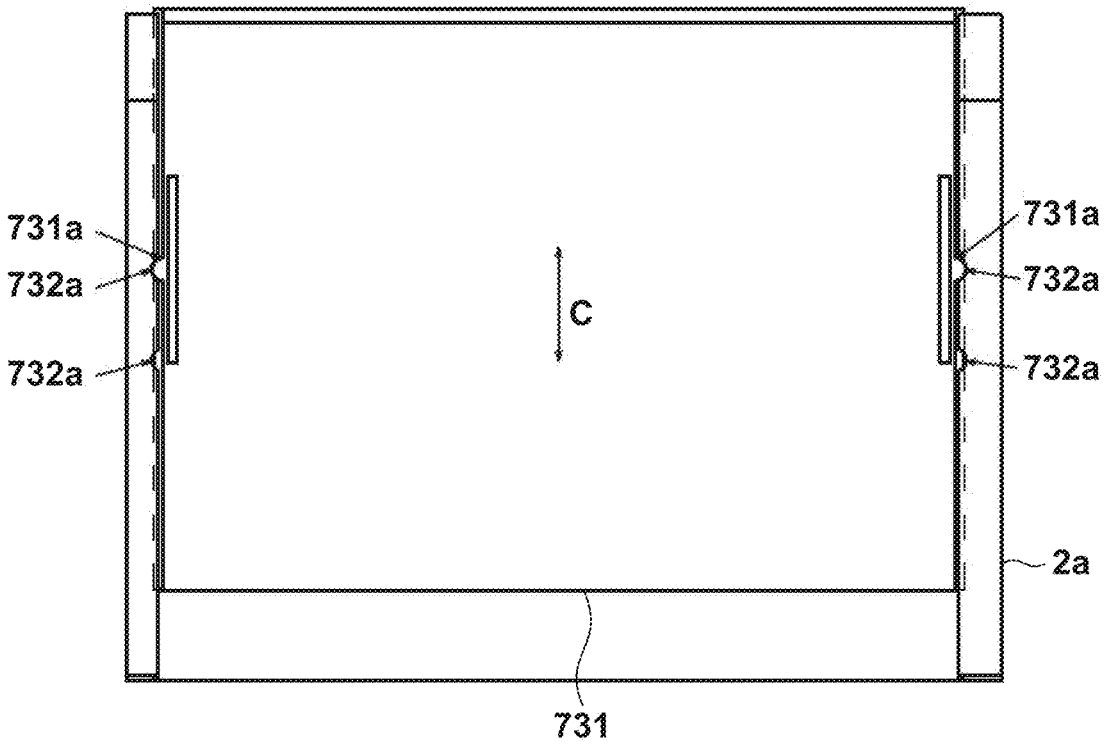
FIG. 51 is a plan view showing the tray support portion according to the embodiment.

As shown in FIG. 50, the tray support portion 731 may also serve as part of the discharge tray 2. In FIG. 50, the tray support portion 731 also serves as a second discharge tray 2*b* that is a surface for receiving the discharged conveyance medium S. Rail portions are provided at the two ends of the second discharge tray 2*b* in the width direction, and the tray support portion 731 can slide in the direction of the arrow C. As shown in FIG. 51, when the tray support portion 731 moves to a position where it protrudes from the first discharge tray 2*a*, the butting surfaces 731*a* of the tray support portion 731 mesh with the abutting portions 732*a* of the first discharge tray 2*a*. This can reliably determine the position of the tray support portion 731, thereby stably adjusting the angle. Furthermore, since the tray support portion 731 also serves as the second discharge tray 2*b* that is the surface for receiving the discharged conveyance medium S, it becomes unnecessary to provide the components separately, thereby reducing the number of components.

This embodiment has explained the structure capable of adjusting the angle of the discharge tray 2 in the plurality of stages, as shown in FIG. 43. However, the present invention is not limited to this. For example, by sufficiently increasing the sliding resistances between the rotating shafts 731*b* and the rail portions 732*b*, it is possible to stably hold the discharge tray even if the tray support portion 731 abuts against the protruding portion 730, and adjust the angle continuously. When the angle of the discharge tray 2 can be adjusted in the plurality of stages, each conveyance medium S can be received at an angle at which the aligning property on the discharge tray 2 is best.

In this embodiment, as shown in FIG. 40, it is possible to fill the gap between the first discharge tray rear end portion 737 and the protruding portion 730. If a gap is generated between the first discharge tray rear end portion 737 and the protruding portion 730, the discharged conveyance medium S may enter the gap. If the position of the discharged conveyance medium S is regulated not to enter the gap, the discharge direction is unwantedly limited. In this configuration, when the tray support portion 731 serving as the surface for receiving the discharged conveyance medium S moves, no gap is generated between the first discharge tray rear end portion 737 and the protruding portion 730, and thus a conveyance path can be arranged without concern for the contact position between the leading edge of the discharged conveyance medium S and the discharge tray 2.

Note that as shown in FIGS. 44, 46, and 50, the tray support portion 731 can also serve as an extension tray, a discharge stopper, or a component forming part of the discharge tray. When the tray support portion 731 also serves as another function, it becomes unnecessary to provide the component, thereby reducing the number of components. Furthermore, if the tray support portion 731 also serves as a discharge stopper, as shown in FIG. 45, it is possible to select leading edge alignment or trailing edge alignment to align the discharged conveyance medium S. In this case, one component can serve as two functions, thereby further improving the discharge aligning property.

[Eighth Embodiment] A discharge tray angle adjustment mechanism of an image reading apparatus A according to the eighth embodiment of the present invention will be described next.

Note that the configurations and functions of the image reading apparatus A according to this embodiment are the same as in the above-described embodiments.

<Discharge Tray Angle Adjustment Mechanism 8>

Figure 52:
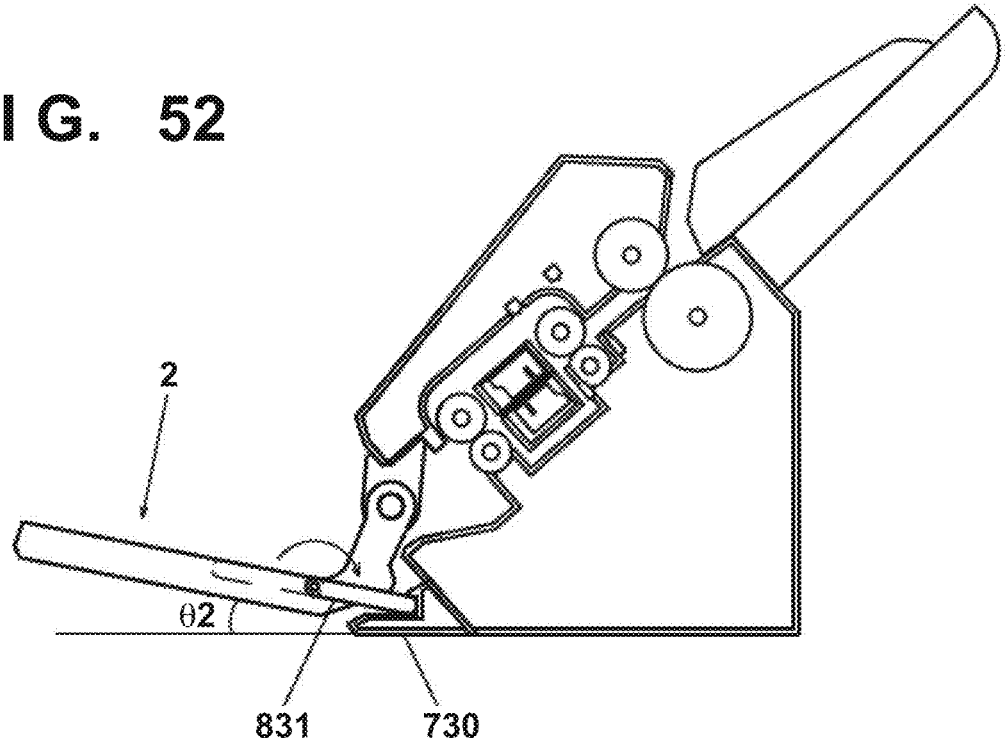
FIG. 52 is a schematic side sectional view showing an image reading apparatus according to the embodiment.

As shown in FIG. 52, a tray support portion 831 that abuts against a protruding portion when a discharge tray 2 is opened is provided at an upstream-side position in a conveyance direction in the discharge tray 2 to be pivotable. The discharge tray 2 is supported by a protruding portion 730 in the open state, and configured to receive a discharged conveyance medium S. If the tray support portion 831 is made to pivot to protrude from the upstream side of the discharge tray 2 in the conveyance direction, the tray support portion 831 abuts against the protruding portion 730 to support the discharge tray. Furthermore, an angle θ2 formed by the discharge tray and the placement plane of the image reading apparatus A can be increased, as compared with a case in which the tray support portion 831 abuts against the protruding portion 730 at a position where the tray support portion 831 is stored in the discharge tray 2.

For example, in the state shown in FIG. 52, the angle θ2 formed by the discharge tray and the placement plane of the image reading apparatus A is large, and it is possible to change a position where the leading edge of the conveyance medium S lands on a surface of the discharge tray 2 onto which the conveyance medium S is discharged. Thus, if the leading edge of the conveyance medium S to be discharged abuts against the trailing edge of the already discharged conveyance medium S to push it, it is possible to make the leading edge of the succeeding conveyance medium S reliably land on the upper surface of the already discharged conveyance medium S in addition to the effect of shifting the trailing edge of the already discharged conveyance medium S toward a lower unit 104 by changing the angle of the discharge tray 2, as shown in FIG. 52. This configuration can significantly improve the aligning property of the discharged conveyance media S on the discharge tray 2.

The protruding portion 730 has a shape that covers the distal end portion of the protruding tray support portion 831 from above. This makes it possible to stably keep the angle of the discharge tray 2 without pushing the tray support portion 831 back to the stored position.

The tray support portion 831 is arranged to be accommodated, as a whole, in a tray support portion storing hole 732 formed in the discharge tray 2. When the tray support portion 831 is provided to be accommodated, as a whole, in the discharge tray 2, the protruding portion 730 can reliably abut against the discharge tray 2 in a state in which the tray support portion 831 is stored in the discharge tray 2.

[Ninth Embodiment] A discharge tray angle adjustment mechanism of an image reading apparatus A according to the ninth embodiment of the present invention will be described next.

Note that the configurations and functions of the image reading apparatus A according to this embodiment are the same as in the above-described embodiments.

<Discharge Tray Angle Adjustment Mechanism 9>

Figure 53:
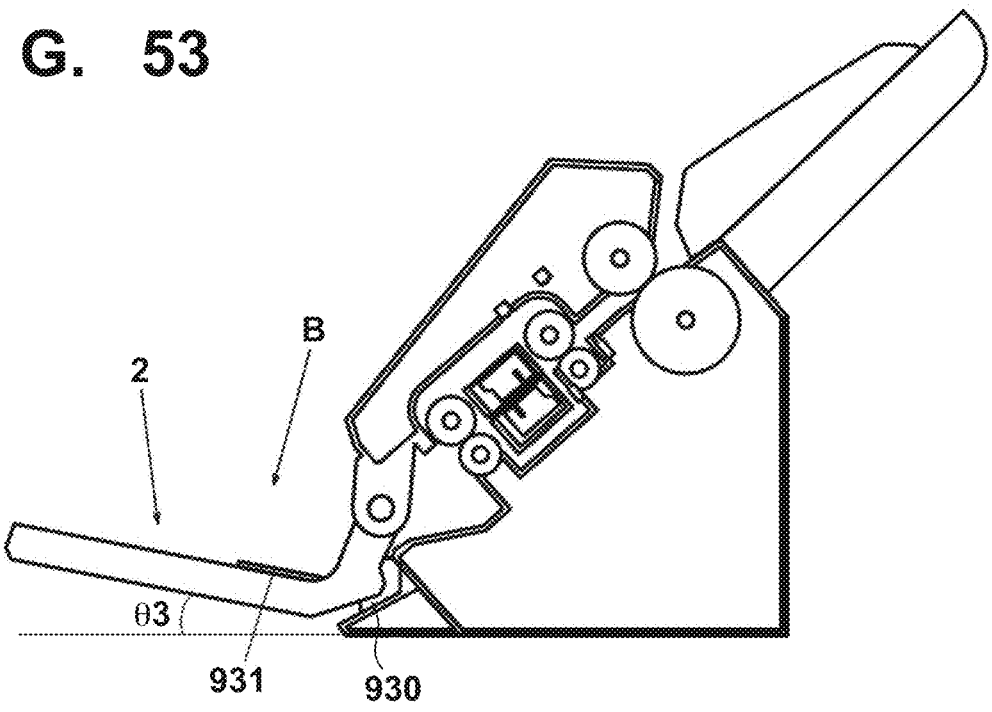
FIG. 53 is a schematic side sectional view showing an image reading apparatus according to the embodiment.
Figure 54:
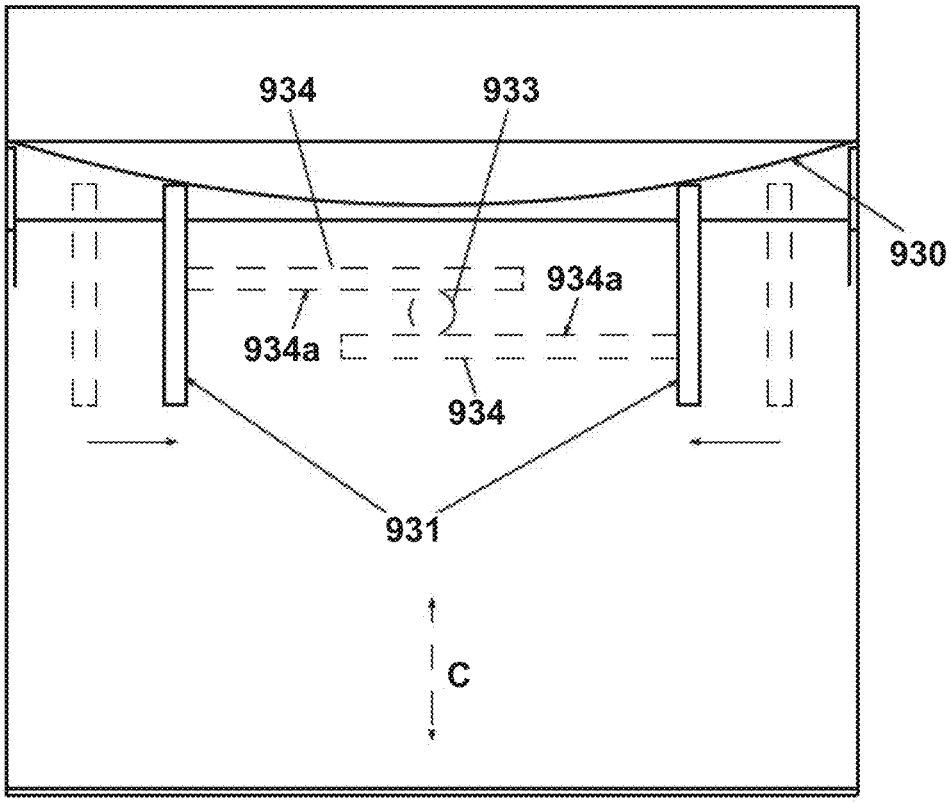
FIG. 54 is a plan view showing a tray support portion according to the embodiment.

As shown in FIG. 53, two tray support portions 931 that abut against a protruding portion 930 when a discharge tray 2 is opened are provided in the discharge tray 2 on the upstream side of the discharge tray 2 in a conveyance direction to be slidable in a width direction perpendicular to the conveyance direction. The discharge tray 2 abuts against the protruding portion 930 to be supported in the open state, and configured to receive a discharged conveyance medium S. FIG. 54 shows this discharge tray 2 viewed from the direction of an arrow B. The protruding portion 930 includes a surface against which the tray support portions 931 abut and which is warped in the downstream direction, as shown in FIG. 28, to form a convex shape that protrudes more at a position closer to the center in the width direction perpendicular to the conveyance direction. If the discharge tray 2 is opened, the discharge tray 2 abuts against the protruding portion 930 to be supported. The tray support portions 931 are at positions where they do not contact the protruding portion 930 on the outer side in the width direction. When the tray support portions 931 are made to slide toward the center, they abut against the protruding portion 930. When the tray support portions 931 are further moved toward the center, the abutting positions change, and it is thus possible to continuously adjust the angle of the discharge tray 2. By moving the tray support portions 931 toward the center, it is possible to continuously increase an angle θ3 formed by the discharged tray and the placement plane of the image reading apparatus A.

For example, in the state shown in FIGS. 53 and 54, the angle θ3 formed by the discharge tray and the placement plane of the image reading apparatus A is large, and it is possible to change a position where the leading edge of the conveyance medium S lands on a surface of the discharge tray 2 onto which the conveyance medium S is discharged. Thus, if the leading edge of the conveyance medium S to be discharged abuts against the trailing edge of the already discharged conveyance medium S to push it, it is possible to make the leading edge of the succeeding conveyance medium S reliably land on the upper surface of the already discharged conveyance medium S in addition to the effect of shifting the trailing edge of the already discharged conveyance medium S toward a lower unit 104 by changing the angle of the discharge tray 2, as shown in FIGS. 53 and 54. Furthermore, it is possible to continuously adjust the angle of the discharge tray 2 by changing the position of the tray support portion 931. This configuration can significantly improve the aligning property of the discharged conveyance media S on the discharge tray 2.

Furthermore, the two, left and right tray support portions 931 can operate symmetrically in synchronism with each other. Each of the left and right tray support portions 931 includes a tray support portion rack gear 934. When tray support portion rack gear flanks 934*a* are made to mesh with a pinion gear 933 arranged at the intermediate position of the tray support portions 931 and one of the tray support portions 931 is moved, the other tray support portion 931 also moves. This can readily move the tray support portions 931 to bilaterally symmetrical positions.

This embodiment has explained the configuration in which the two tray support portions 931 are provided. However, one tray support portion 931 may be provided. When one tray support portion is provided, the pinion gear 933 and the tray support portion rack gears 934 become unnecessary, and it is thus possible to change the angle θ3 formed by the discharge tray 2 with a simpler configuration.

In this embodiment, when the tray support portions 931 are located on the outer side in the width direction, they are located not to abut against the protruding portion 930. However, if the discharge tray 2 is in the open state, the tray support portions 931 may always abut against the protruding portion 930. In this case, the angle θ3 formed by the discharge tray 2 and the placement plane when the tray support portions 931 are located at the ends in the width direction is set to a value close to 0, thereby making it possible to deal with the apparatus in the same way as in this embodiment.

Figure 55:
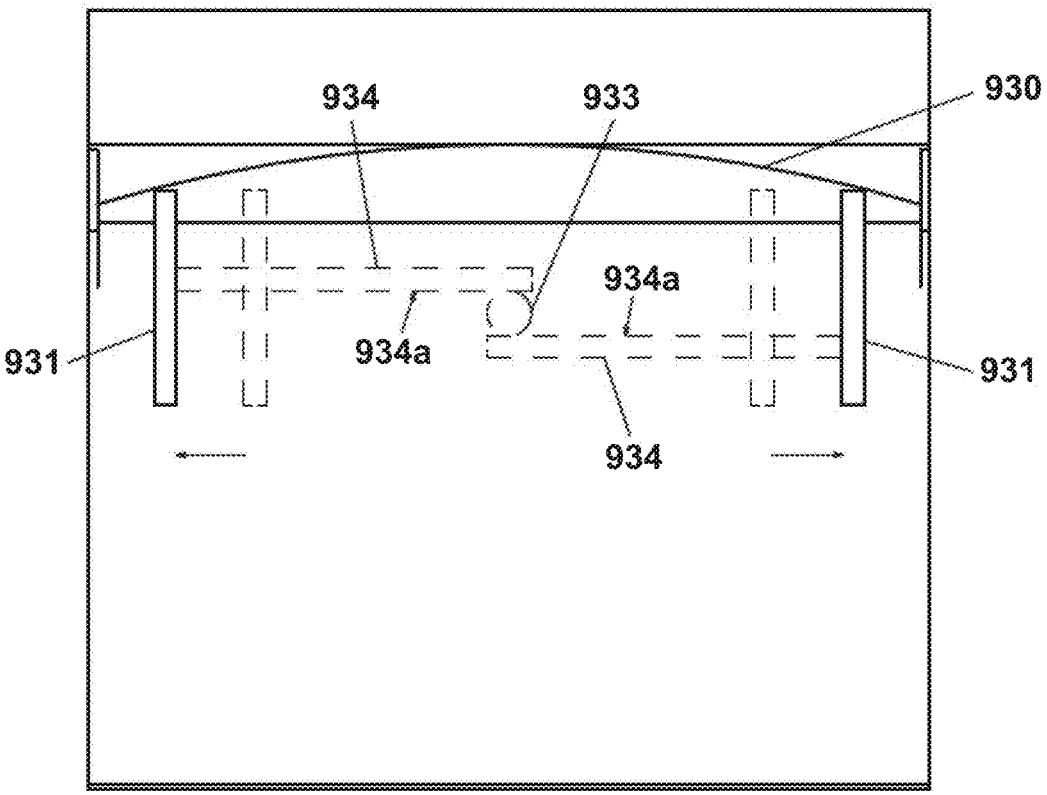
FIG. 55 is a plan view showing the tray support portion according to the embodiment.
Figure 56:
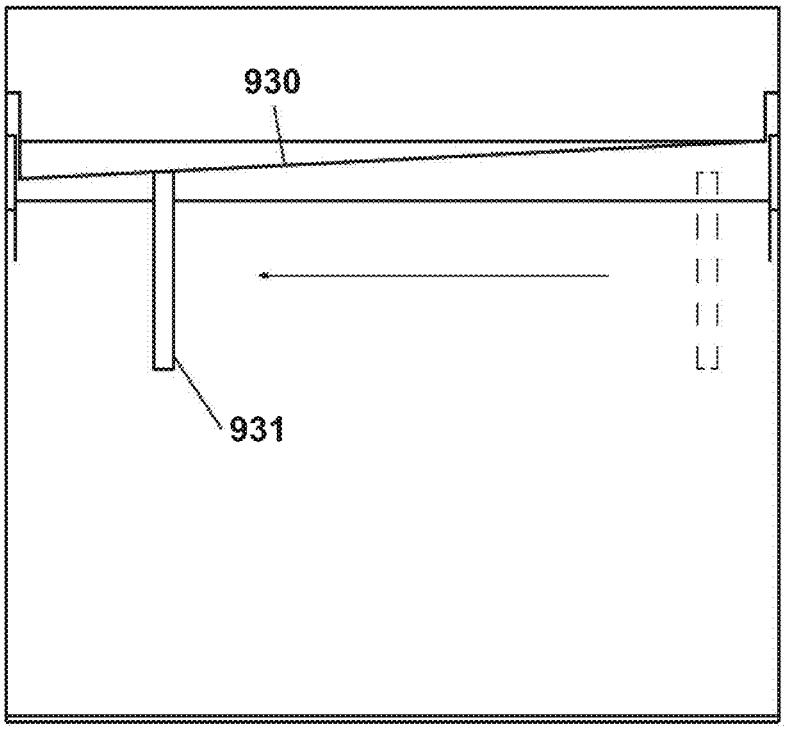
FIG. 56 is a plan view showing the tray support portion according to the embodiment.

Although the protruding portion 930 has the shape that protrudes more at a position closer to the center in this embodiment, the protruding portion 930 may have a shape that is recessed more at a position closer to the center, as shown in FIG. 55. In this case, the angle θ3 is smaller as the tray support portions 931 move closer to the center in the width direction. Furthermore, the shape of the protruding portion 930 is not limited to the warped shape, and may be a slope shape, as shown in FIG. 56. As long as the protruding portion 930 does not have a flat surface parallel to the width direction perpendicular to the conveyance direction, for example, as long as the protruding portion 930 has a stepped shape instead of the slope shape, it is possible to adjust the angle of the discharge tray 2.

This embodiment has explained the structure capable of continuously adjusting the angle of the discharge tray 2, as shown in FIGS. 54 to 56. However, the present invention is not limited to this. This embodiment is advantageous because the angle of the discharge tray 2 can be adjusted in the plurality of stages, and thus each conveyance medium S can be received at an angle at which the aligning property on the discharge tray 2 is best.

[10th Embodiment] A discharge tray angle adjustment mechanism of an image reading apparatus A according to the 10th embodiment of the present invention will be described next.

Note that the configurations and functions of the image reading apparatus A according to this embodiment are the same as in the above-described embodiments.

<Discharge Tray Angle Adjustment Mechanism 10>

Figure 58:
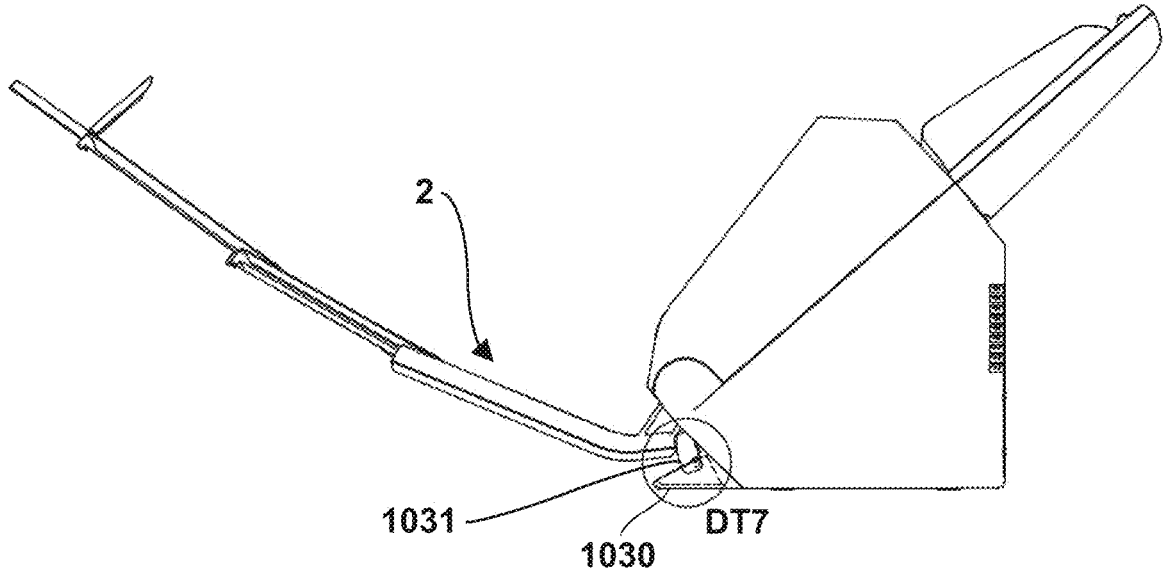
FIG. 58 is a side view showing the image reading apparatus according to the embodiment.
Figure 59:
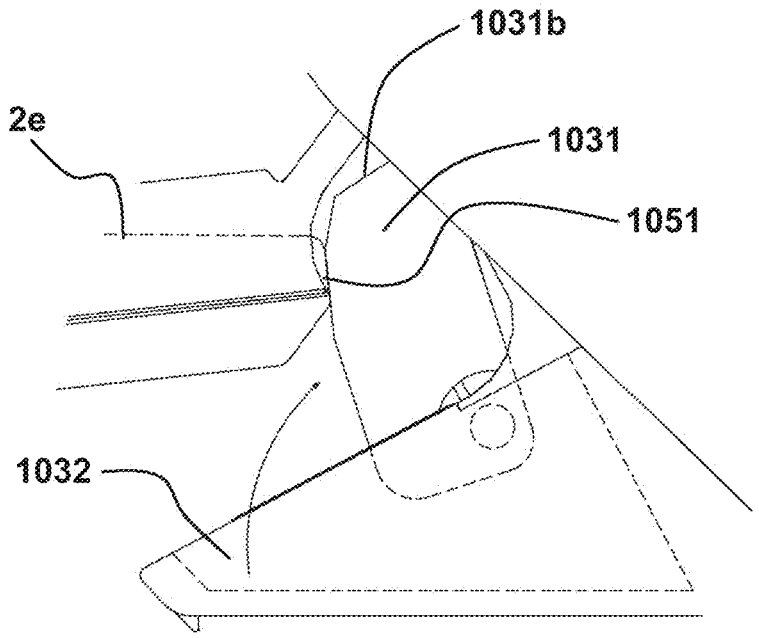
FIG. 59 is a side view showing a tray support portion according to the embodiment.

FIG. 58 is a side view showing the image reading apparatus A. FIG. 59 on the lower side shows a portion surrounded by a circuit DT7 in a view on the upper side.

In a state in which a tray support portion 1031 pivots toward a discharge port to protrude from a protruding portion 1030, convex portions 1051 provided in two end portions abut against the end face of a discharge tray 2 and a surface 1031*a* that opposes the upper portion of a discharge opening 92 when the tray support portion 1031 is stored in a recess 1055 abuts against the lower portion of the discharge opening 92, thereby supporting the discharge tray 2. That is, in the state in which the tray support portion 1031 pivots to protrude from the protruding portion 1030, the tray support portion 1031 is sandwiched and held between the discharge tray 2 and the lower portion of the discharge opening 92. The tray support portion 1031 is arranged so that its pivot shaft is located on the upstream side of the protruding portion 1030 in the conveyance direction in the protruding portion 1030 provided in the lower portion of a main body 100.

In this embodiment, when the tray support portion 1031 is drawn out of the protruding portion 1030, the tray support portion 1031 forms part of a conveyance path to fill a gap between the discharge opening 92 and the discharge tray 2. A conveyance path forming surface 1031*b* of the tray support portion 1031 is located at a position higher than that of a sheet placement surface 2*e* of the discharge tray 2 in the vertical direction.

Figure 60:
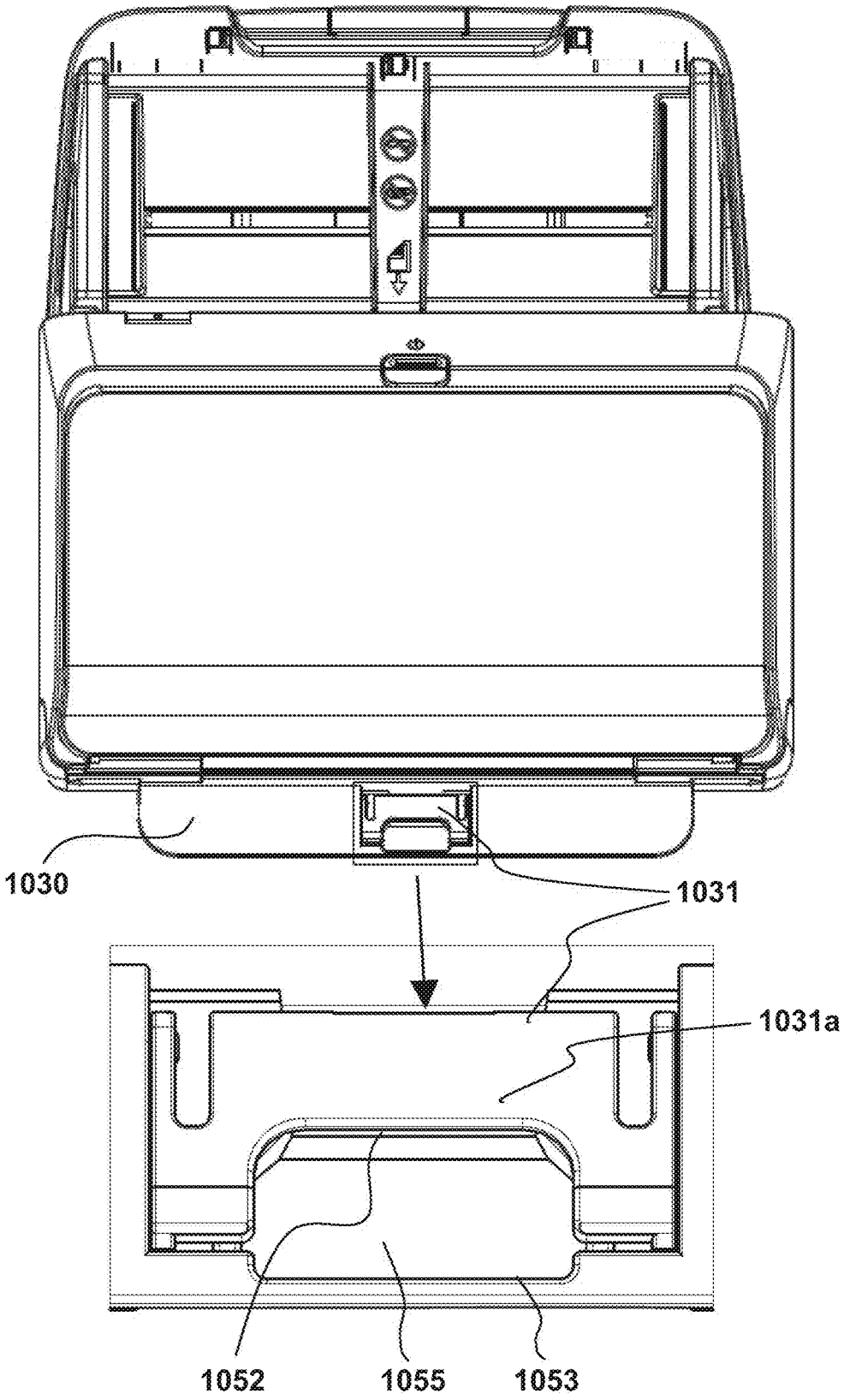
FIG. 60 shows a plan view and an enlarged view of the image reading apparatus according to the embodiment.

FIG. 60 shows a plan view and an enlarged view when viewed from a direction perpendicular to a display panel 90 of the image reading apparatus A according to this embodiment.

The tray support portion 1031 is arranged to be accommodated, as a whole, in the recess 1055 formed in the protruding portion 1030. A concave portion 1052 for hooking a finger is provided at the center on a side opposite to the pivot shaft. In addition, a retraction portion 1053 is provided at a position, in the recess 1055, opposite to the concave portion 1052 of the tray support portion 1031, so that a finger of the user readily touches the concave portion 1052.

Figure 57:
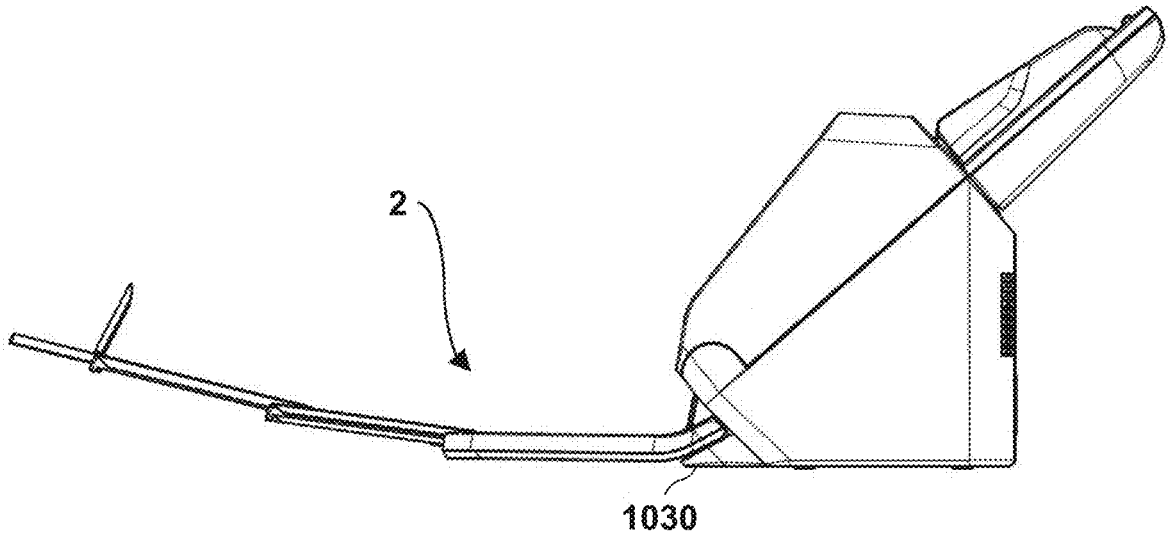
FIG. 57 is a side view showing an image reading apparatus according to the embodiment.

According to this embodiment, in a state in which the discharge tray 2 is supported by the tray support portion 1031, as shown in FIG. 58, it is possible to change the angle of the discharge tray 2, as compared to the state shown in FIG. 57 in which the discharge tray 2 is supported by the protruding portion 1030. That is, since the discharge tray 2 is supported on the upper side in the vertical direction, the angle formed by the discharge tray 2 and the placement plane of the image reading apparatus A can be increased.

Thus, in the state shown in FIG. 57, if the leading edge of a conveyance medium S to be discharged abuts against the trailing edge of an already discharged conveyance medium S to push it, it is possible to make the leading edge of the succeeding conveyance medium S reliably land on the upper surface of the already discharged conveyance medium S in addition to the effect of shifting the trailing edge of the already discharged conveyance medium S toward a lower unit 104 by changing the angle of the discharge tray 2, as shown in FIG. 58.

However, if, as shown in FIG. 58, the discharge tray 2 is configured to be always lifted up in the vertical direction, when, for example, a sheet with low stiffness such as a thin sheet, or a sheet with high friction is conveyed, the following discharge failure may occur. For example, the conveyance medium S may stop in the middle of the discharge tray and the trailing edge of the sheet remains near a driving roller 31 to touch the driving roller 31, or the discharged conveyance medium S curls on the discharge tray 2. To cope with this, by adopting the configuration in which the angle of the discharge tray 2 can be changed depending on the type of the conveyance medium S, it is possible to significantly improve the aligning property of the discharged conveyance media S on the discharge tray 2.

Furthermore, the tray support portion 1031 abuts against a surface facing downward in a state in which the discharge tray 2 is folded to the side of the display panel 90. Thus, even if the surface of the discharge tray 2 is scratched due to friction with the tray support portion 1031, this portion is hardly seen by the user, thereby preventing, from deteriorating, the fine appearance in the state (stored state) in which the discharge tray 2 is folded.

When the tray support portion 1031 is provided to be accommodated, as a whole, in the protruding portion 1030, the protruding portion 1030 can reliably abut against the discharge tray 2 in the state in which the tray support portion 1031 is stored in the protruding portion 1030.

When the tray support portion 1031 is sandwiched between the discharge opening 92 and the discharge tray 2 in the state in which the tray support portion 1031 is drawn out, pivot is regulated in a direction in which the tray support portion 1031 is stored in the protruding portion 1030 and a direction in which the tray support portion 1031 is drawn out of the protruding portion 1030, thereby making it possible to stably support the discharge tray 2.

When the tray support portion 1031 fills the gap between the discharge opening 92 and the discharge tray 2 in the state in which the tray support portion 1031 is drawn out, it is possible to prevent a discharge failure caused when a sheet discharged to the discharge opening 92 is caught in the gap between the discharge opening 92 and the discharge tray 2, thereby improving the discharge property.

[11th Embodiment] A discharge tray angle adjustment mechanism of an image reading apparatus A according to the 11th embodiment of the present invention will be described next.

Note that the configurations and functions of the image reading apparatus A according to this embodiment are the same as in the above-described embodiments.

<Discharge Tray Angle Adjustment Mechanism 11>

Figure 61:
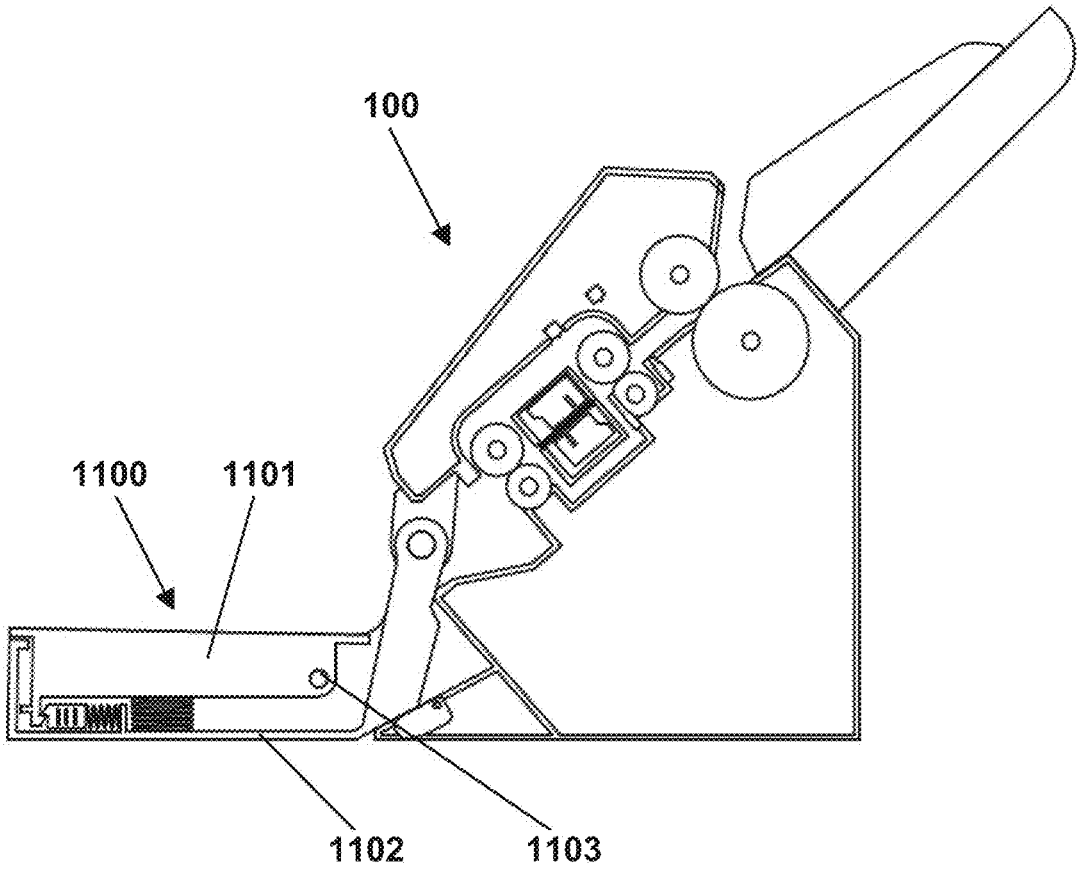
FIG. 61 is a schematic side sectional view showing an image reading apparatus according to the embodiment.
Figure 62:
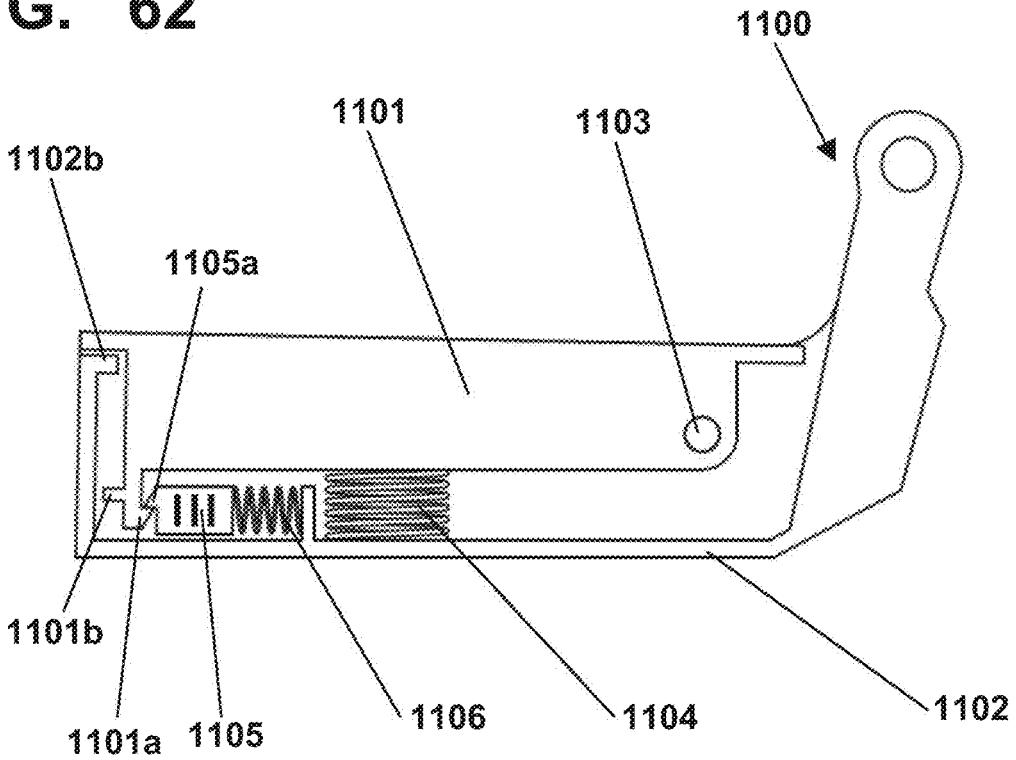
FIG. 62 is a schematic side sectional view when a discharge tray interior of a discharge tray is in a stored state according to the embodiment.

FIGS. 61 and 62 are schematic side sectional views each showing a state in which a discharge tray interior 1101 of a discharge tray 1100 of the image reading apparatus A is stored according to this embodiment.

The discharge tray 1100 is formed by the discharge tray interior 1101 and a discharge tray exterior 1102. The discharge tray interior 1101 forms a stacking surface on which a conveyance medium S discharged via a discharge opening 92 is stacked. The discharge tray exterior 1102 forms an outer surface when a discharge tray 2 is in a stored state. The discharge tray interior 1101 and the discharge tray exterior 1102 are formed in almost equal sizes when viewed from a direction perpendicular to the stacking surface, and axially supported by a pivot support portion 1103 on the upstream side in a conveyance direction to be pivotable. Furthermore, a discharge tray interior biasing member 1104 that biases the downstream end of the discharge tray interior 1101 in a direction to separate it from the discharge tray exterior 1102 is provided between the discharge tray interior 1101 and the discharge tray exterior 1102. In addition, a discharge tray interior lock member 1105 is provided on the end face of the discharge tray exterior 1102 in a sheet width direction. The discharge tray interior lock member 1105 can slide almost in parallel to the conveyance direction, and a lock biasing member 1106 always biases the discharge tray interior lock member 1105 in a lock direction (the left direction in FIG. 62).

In a state in which the discharge tray interior 1101 is locked by the discharge tray interior lock member 1105, that is, a state in which an engaging portion 1101*a* provided in the end portion of the discharge tray interior 1101 in the width direction engages with the discharge tray interior lock member 1105, the pivot of the discharge tray interior 1101 by the discharge tray interior biasing member 1104 is regulated, and the discharge tray interior 1101 is held in a positional relationship in which it is almost parallel to the discharge tray exterior 1102.

Figure 63:
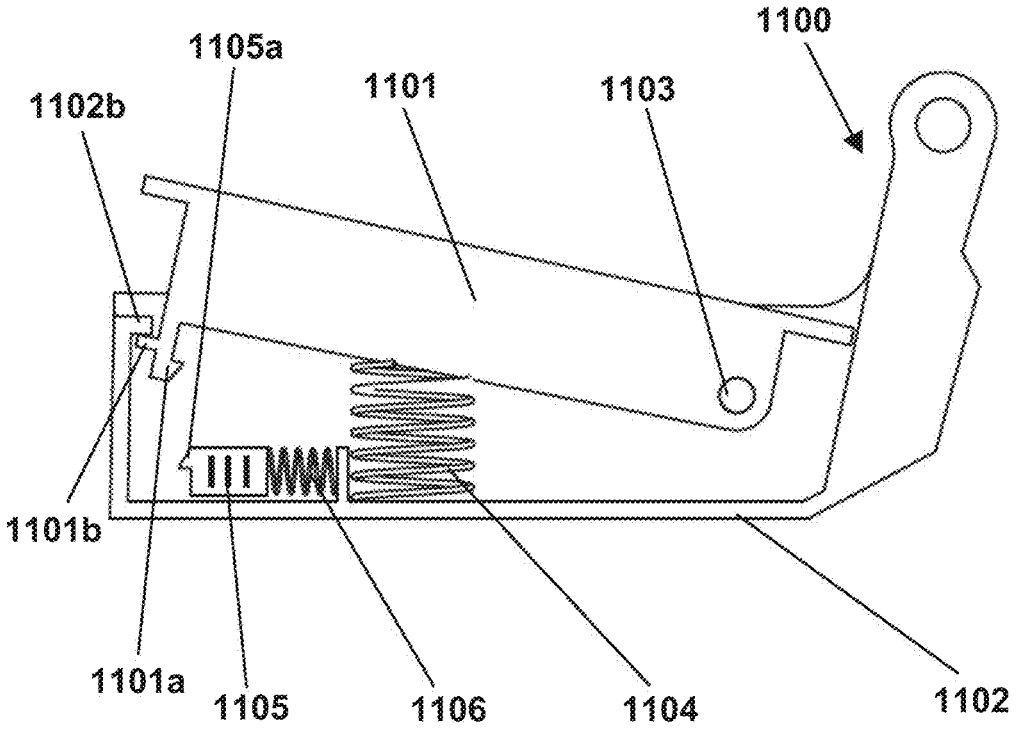
FIG. 63 is a schematic side sectional view when the discharge tray interior of the discharge tray is in an open state according to the embodiment.

If the discharge tray interior lock member 1105 is made to slide in a direction opposite to the biasing direction of the lock biasing member 1106, the engaging portion 1101*a* of the discharge tray interior 1101 is released, the discharge tray interior 1101 pivots about the pivot support portion 1103 by the force of the discharge tray interior biasing member 1104 until a locking portion 1101*b* of the discharge tray interior 1101 is locked by a locking portion 1102*b* of the discharge tray exterior 1102, and thus the discharge tray interior 1101 is opened, as shown in FIG. 63. At this time, the angle formed by the stacking surface on which the discharged conveyance medium S is stacked and the ground surface of the image reading apparatus A is large, as compared with the case in which the discharge tray interior 1101 is locked by the discharge tray interior lock member 1105.

If the discharge tray interior 1101 is pressed in a direction opposite to the biasing direction of the discharge tray interior biasing member 1104 in the state in which the discharge tray interior 1101 is opened, the engaging portion 1101*a* of the discharge tray interior 1101 crosses the discharge tray interior lock member 1105, and can then be engaged with the discharge tray interior lock member 1105 to return to the state in which the discharge tray interior 1101 is stored.

In this embodiment, the state in which the discharge tray interior 1101 is stored is set as the initial state. However, the state in which the discharge tray interior 1101 is opened may be set as the initial state. That is, the discharge tray 2 can be stored in the state in which the discharge tray interior 1101 is opened.

For example, in the state shown in FIG. 63, the downstream end of the discharge tray interior 1101 is lifted up in the vertical direction, as compared with the state shown in FIG. 62, and it is thus possible to change a position where the leading edge of the conveyance medium S lands on the upper surface of the discharge tray 2. Thus, in the state shown in FIG. 62, if the leading edge of the conveyance medium S to be discharged abuts against the trailing edge of the already discharged conveyance medium S to push it, it is possible to make the leading edge of the succeeding conveyance medium S reliably land on the upper surface of the already discharged conveyance medium S in addition to the effect of shifting the trailing edge of the already discharged conveyance medium S toward a lower unit 104 by changing the angle of the discharge tray interior 1101, as shown in FIG. 63. With this configuration, it is possible to significantly improve the aligning property of the discharged conveyance media S on the discharge tray 2.

Furthermore, since the discharge tray interior lock member 1105 is provided on the end face of the discharge tray 2 in the width direction, the discharge tray interior lock member 1105 can be operated even while the image reading apparatus A performs a reading operation, that is, the plurality of conveyance media S are discharged to the discharge tray 2, and the preferable angle of the discharge tray interior 1101 can be adjusted by checking the alignment condition of the discharged conveyance media S, thereby improving convenience.

Figure 64:
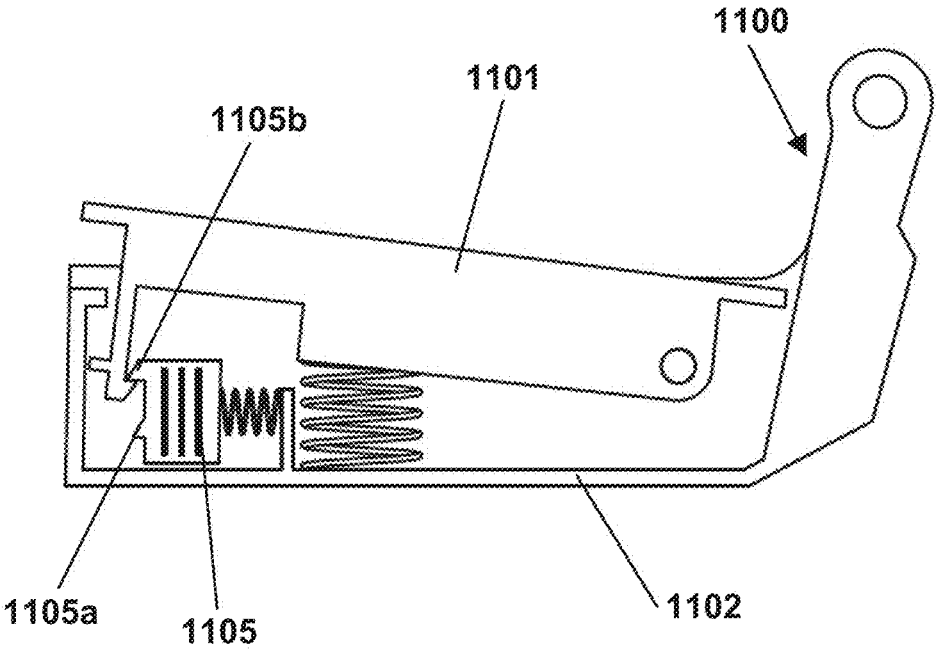
FIG. 64 is a schematic side sectional view when the discharge tray interior of the discharge tray is in an open state at the second position according to the embodiment.

Note that as shown in FIG. 64, a plurality of engaging portions 1105*a* and 1105*b* of the discharge tray interior lock member 1105 may be provided so as to adjust the angle of the discharge tray interior 1101 in a plurality of stages. In this case, each conveyance medium S can be received at an angle at which the aligning property on the discharge tray 2 is best, thereby improving convenience.

Figure 65:
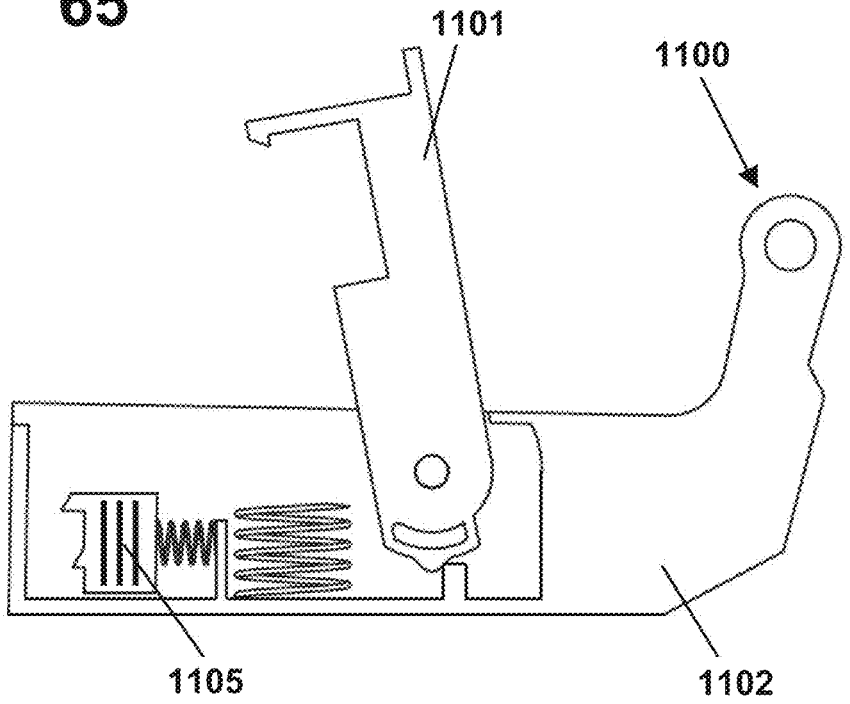
FIG. 65 is a schematic side sectional view when the discharge tray interior of the discharge tray is in an open state at the third position according to the embodiment.

In this embodiment, the discharge tray interior 1101 is used as a tray on which the discharged conveyance medium S is stacked. However, by making the angle of the discharge tray interior 1101 settable to an almost right angle to the conveyance direction of the discharged conveyance medium S, as shown in FIG. 65, the discharge tray interior 1101 may be used as a discharge position adjustment member, that is, a discharge stopper.

Furthermore, in this embodiment, the pivotable discharge tray interior 1101 is provided in a first discharge tray 2*a*. However, a pivotable discharge tray may be provided in a second discharge tray 2*b*.

[12th Embodiment] A discharge tray angle adjustment mechanism of an image reading apparatus A according to the 12th embodiment of the present invention will be described next.

Note that the configurations and functions of the image reading apparatus A according to this embodiment are the same as in the above-described embodiments.

<Discharge Tray Angle Adjustment Mechanism 12>

FIGS. 66*a*, 66*b*, 67*a*, and 67*b* are schematic side sectional views each showing a state in which a discharge tray 2600 of the image reading apparatus A is opened according to this embodiment.

In this embodiment, to improve the discharge aligning property of a sheet on a discharge tray in a sheet conveyance apparatus, the leading edge of the sheet is made to abut against a discharge stopper on the discharge tray to restrict the stacking position of the sheet within a predetermined range. The sheet conveyance apparatus can convey, for example, sheets of the same size, and can be applied to an apparatus that separates and conveys a sheet bundle of sheets of different sizes such as various width dimensions and length dimensions one by one.

In this case, a sheet feeding portion in the sheet conveyance apparatus is provided with a sheet separation portion that separates sheets one by one, and conveys sheets one by one to the downstream side while separating them and finally sequentially discharges the sheets onto the discharge tray. Therefore, the discharge tray is preferably configured to be extended in order to deal with sheets of various length dimensions.

More specifically, as shown in FIGS. 66*a* to 68*d*, a discharge tray 2600 is provided in a main body 2501 of a sheet conveyance apparatus 2500 to be folded at a rotation hinge 2601. The discharge tray 2600 is used as a first-stage tray (first discharge tray) 2610, of which a second-stage extension tray (second discharge tray) 2620 is drawn out.

Figure 66A:
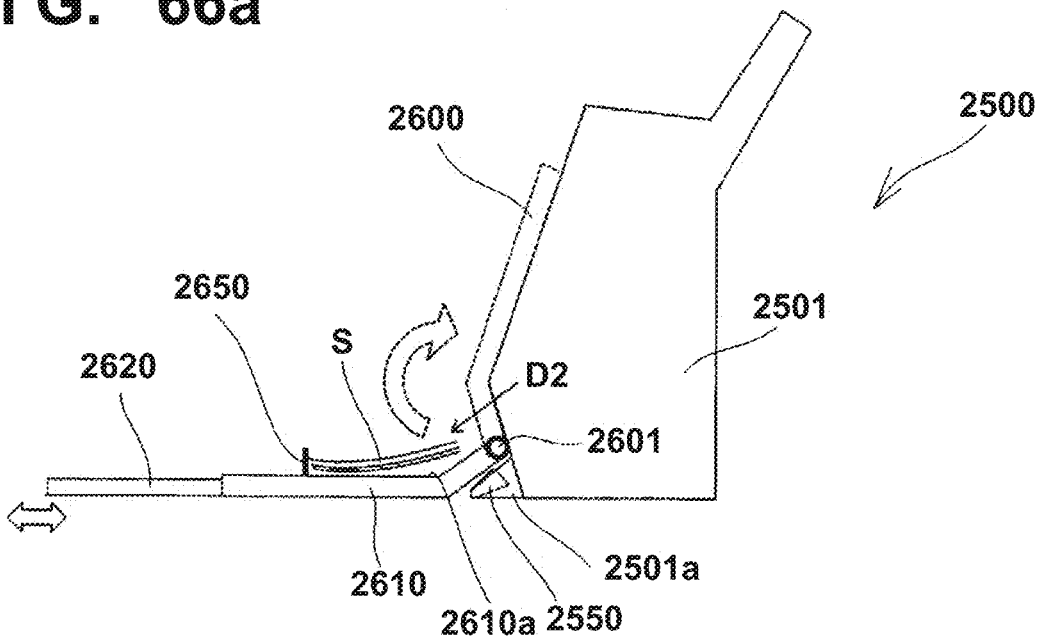
FIG. 66*a* is a schematic side sectional view showing a state in which a discharge tray of an image reading apparatus is opened according to the embodiment.

At this time, for example, as shown in FIG. 66*a*, by making a discharge stopper 2650 pivot to stand upright on the first-stage first discharge tray 2610 pivotably connected to the main body 2501, the leading edge of a sheet S discharged in a sheet discharge direction D2 abuts against the discharge stopper 2650 to restrict the discharge position on the first discharge tray 2610, thereby improving the aligning property of the discharged sheet S.

Note that if the discharge stopper 2650 is stored to be flush with a sheet receiving surface 2610*a* of the first discharge tray 2610, the leading edge of a succeeding sheet may abut against the trailing edge of a preceding sheet discharged onto the sheet receiving surface 2610*a* to push it, thereby degrading the aligning property of the sheets or a succeeding sheet may enter under a preceding sheet on the side of the sheet receiving surface 2610*a*, thereby disturbing the stacking order of the discharged sheets.

Figure 66B:
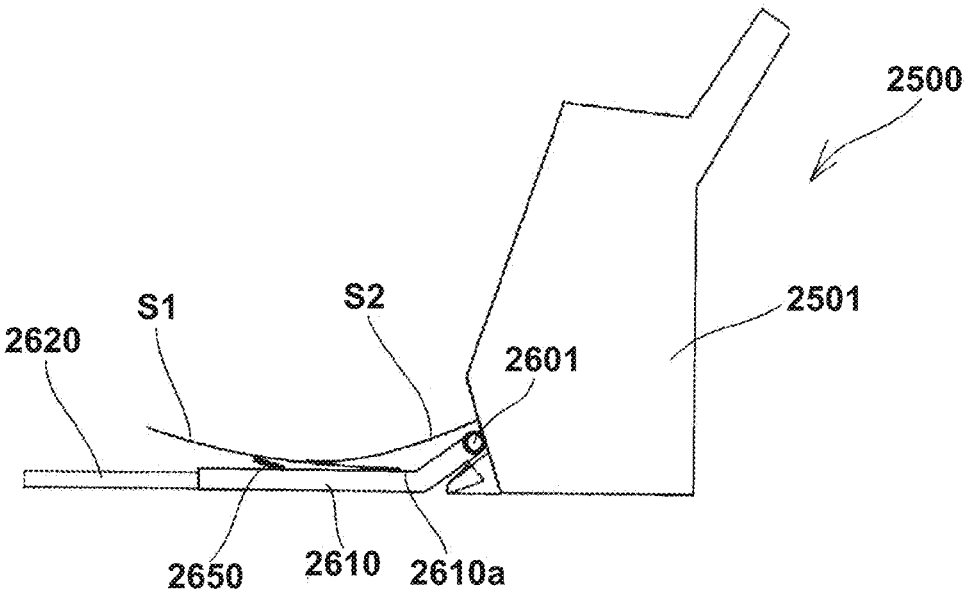
FIG. 66*b* is a schematic side sectional view showing the state in which the discharge tray of the image reading apparatus is opened according to the embodiment.

To prevent disturbance of discharged sheets, the discharge stopper 2650 may be stopped in an attitude inclined to the side opposite to the side of the main body 2501, as shown in FIG. 66*b*.

Thus, as shown in FIG. 66*b*, a discharged preceding sheet S1 runs over the discharge stopper 2650 inclined like a jump stand so as to readily stop on the side of the main body 2501. Therefore, succeeding sheets S2 are sequentially discharged by landing on the preceding sheet S1.

That is, the preceding sheet S1 is never pushed by the succeeding sheet S2 or the succeeding sheet S2 never enters under the preceding sheet S1. Therefore, the sheets can be stacked, with a good aligning property, on the discharge tray 2600 in the same order as that of the sheets before feeding.

Note that when a relatively long sheet is discharged, the discharge stopper 2650 is set in an attitude in which it is inclined and stopped, as shown in FIG. 66*b*. When a relatively short sheet is discharged, the discharge stopper 2650 is raised almost at a right angle on the discharge tray 2600 and used, as shown in FIG. 66*a*.

Figure 67A:
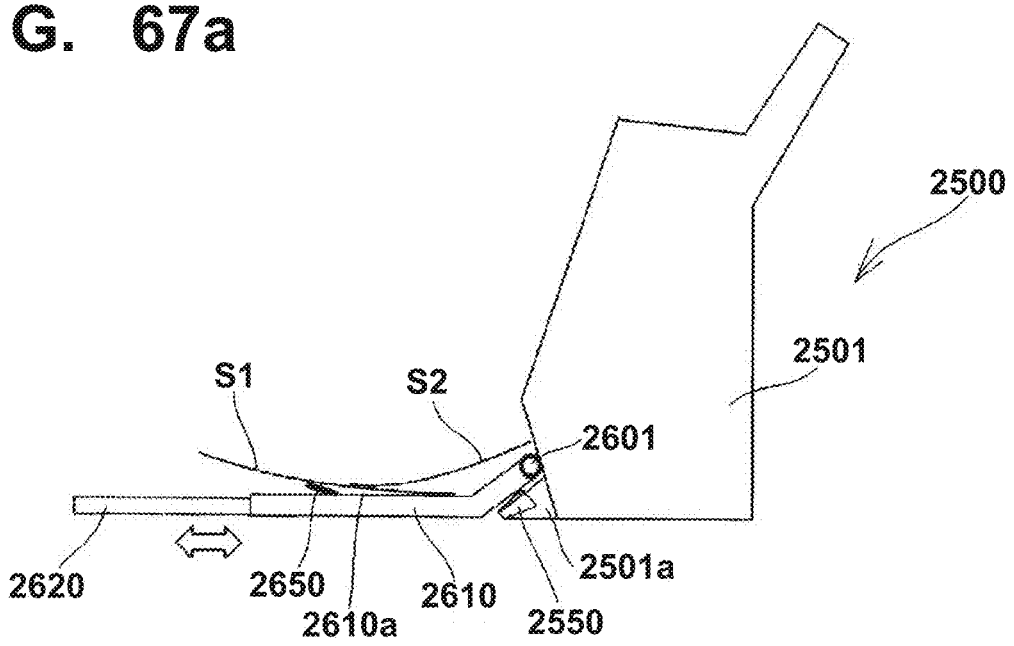
FIG. 67*a* is a schematic side sectional view showing the state in which the discharge tray of the image reading apparatus is opened according to the embodiment.
Figure 67B:
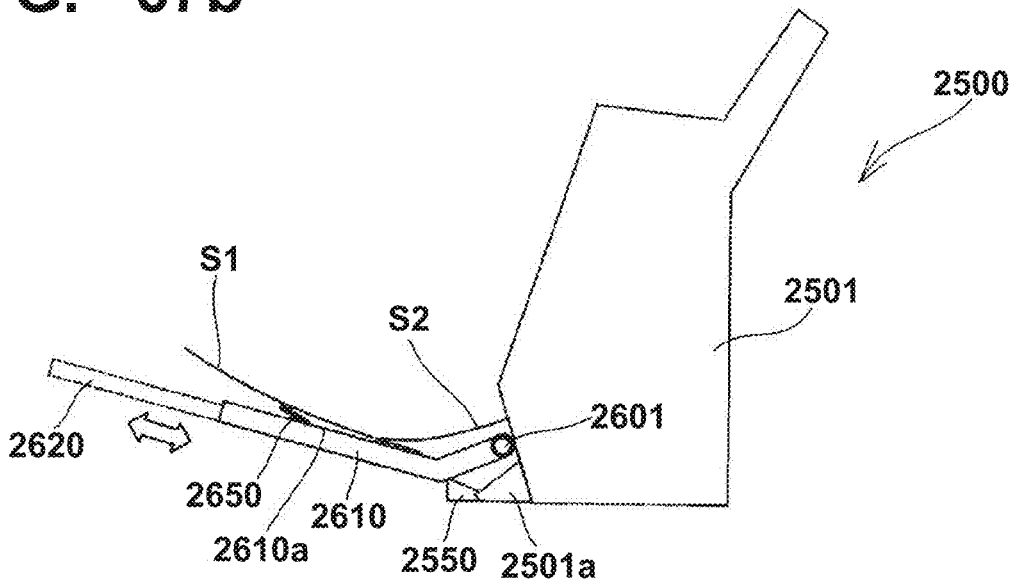
FIG. 67*b* is a schematic side sectional view showing the state in which the discharge tray of the image reading apparatus is opened according to the embodiment.

To further improve the sheet aligning property, the distal end of the discharge tray 2600 is inclined upward while the discharge stopper 2650 is inclined, as shown in FIGS. 67*a* and 67*b*, similarly to the state shown in FIG. 66*b*.

To change the attitude of the discharge tray 2600, a tray support portion 2550 provided in a lower end portion 2501*a* of the main body 2501 may be arranged between the discharge tray 2600 and an apparatus placement plane to change the attitude of the discharge tray 2600 upward with respect to the main body 2501, as shown in, for example, FIGS. 67*a* and 67*b*.

This causes the preceding sheet S1 discharged onto the discharge tray 2600 to stop at a position closer to the apparatus main body, and thus the succeeding sheet S2 readily lands on the preceding sheet S1, thereby making it possible to further improve the discharge aligning property of the sheets.

The example in which the above-described discharge stopper 2650 is provided in the first discharge tray 2610 directly connected to the apparatus main body has been explained. However, the present invention is not limited to this, as a matter of course. For example, as shown in FIG. 68*a*, the discharge stopper 2650 may be provided on the second discharge tray 2620 extended from the first discharge tray 2610.

Figure 68A:
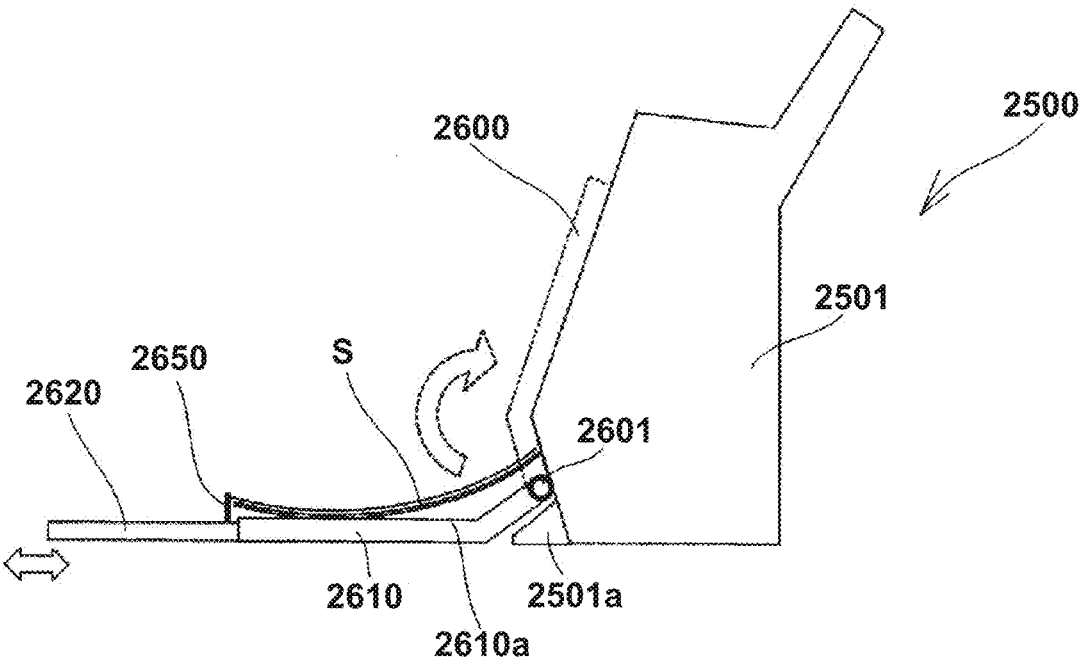
FIG. 68*a* is a schematic side sectional view showing a state in which the discharge tray of the image reading apparatus is extended according to the embodiment.
Figure 68B:
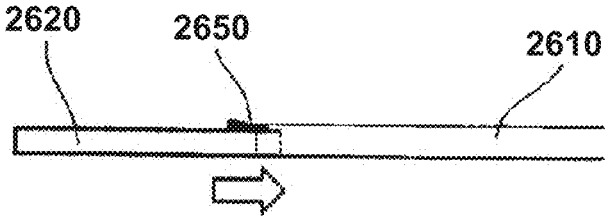
FIG. 68*b* is a schematic side sectional view showing the state in which the discharge tray of the image reading apparatus is extended according to the embodiment.
Figure 68C:
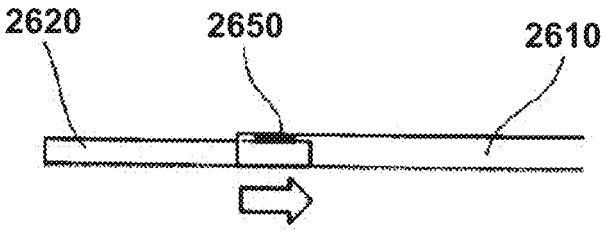
FIG. 68*c* is a schematic side sectional view showing the state in which the discharge tray of the image reading apparatus is extended according to the embodiment.

As shown in FIG. 68*b*, the second discharge tray 2620 may be stored in the first discharge tray 2610 from the state shown in FIG. 68*a* and extended. In this case, as shown in FIG. 68*c*, the second discharge tray 2620 may be stored in a groove or a storage space in the first discharge tray 2610 together with the discharge stopper 2650.

Figure 68D:
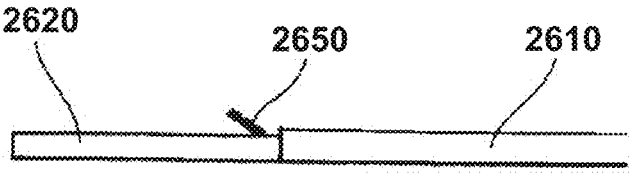
FIG. 68*d* is a schematic side sectional view showing the state in which the discharge tray of the image reading apparatus is extended according to the embodiment.

As shown in FIG. 68*d*, when the second discharge tray 2620 is drawn out of the first discharge tray 2610 to be extended, a biasing unit (not shown) (for example, a leaf spring, a coil spring, or the like) biases the discharge stopper 2650 to an engaging portion in which the discharge stopper 2650 stops at a predetermined angle, thereby making the discharge stopper 2650 automatically protrude up to the predetermined angle. When storing again the second discharge tray 2620 from the state shown in FIG. 68*d*, the discharge stopper 2650 is automatically stored, as shown in FIGS. 68*a* and 68*b*. The discharge stopper 2650 may be manually raised from the state shown in FIG. 68*d* to the state shown in FIG. 68*a*.

In the structure shown in FIGS. 68*a* to 68*d*, with only an operation of extending the second discharge tray 2620, the discharge stopper 2650 is drawn out automatically, thereby improving the operability of the user. Even if a sheet that is so long as to extend the tray is discharged, the sheet runs over the discharge stopper 2650, thereby making the succeeding sheet S2 land on the preceding sheet S1 more reliably. Thus, it is possible to improve the aligning property of the sheets, similarly to the structure shown in FIGS. 66*a* and 66*b*. The configuration of the tray support portion 2550 described with reference to FIGS. 67*a* and 67*b* may be applied to the structure shown in FIGS. 68*a* to 68*d*, thereby further improving the aligning property of the sheets.

Note that the above-described discharge stopper 2650 can improve the discharge aligning property of the sheets by having a structure like a jump stand inclined at a predetermined angle so that the preceding sheet S1 runs over the discharge stopper 2650. For example, the angle is changed in one stage but may be adjusted in multiple stages. This can more finely adjust the discharge aligning property of the sheets, thereby implementing the satisfactory sheet discharge and aligning property desired by the user.

The above-described discharge stopper 2650 shown in FIGS. 66*a*, 66*b*, 67*a*, and 67*b* are provided to be erected to a right angle to the sheet receiving surface 2610*a*. However, the present invention is not limited to this, as a matter of course. The discharge stopper 2650 may pivot until it is inclined at not a right angle but an acute angle with respect to the sheet receiving surface 2610*a*. In this example, since the sheets sequentially run over the portion of the discharge stopper, the discharge stopper serves as a discharge guide that guides discharge of a sheet, instead of simply stopping discharge of a sheet. The discharge stopper 2650 will be described as a discharge stopper below for the sake of convenience, but may serve as a discharge guide.

Figure 69:
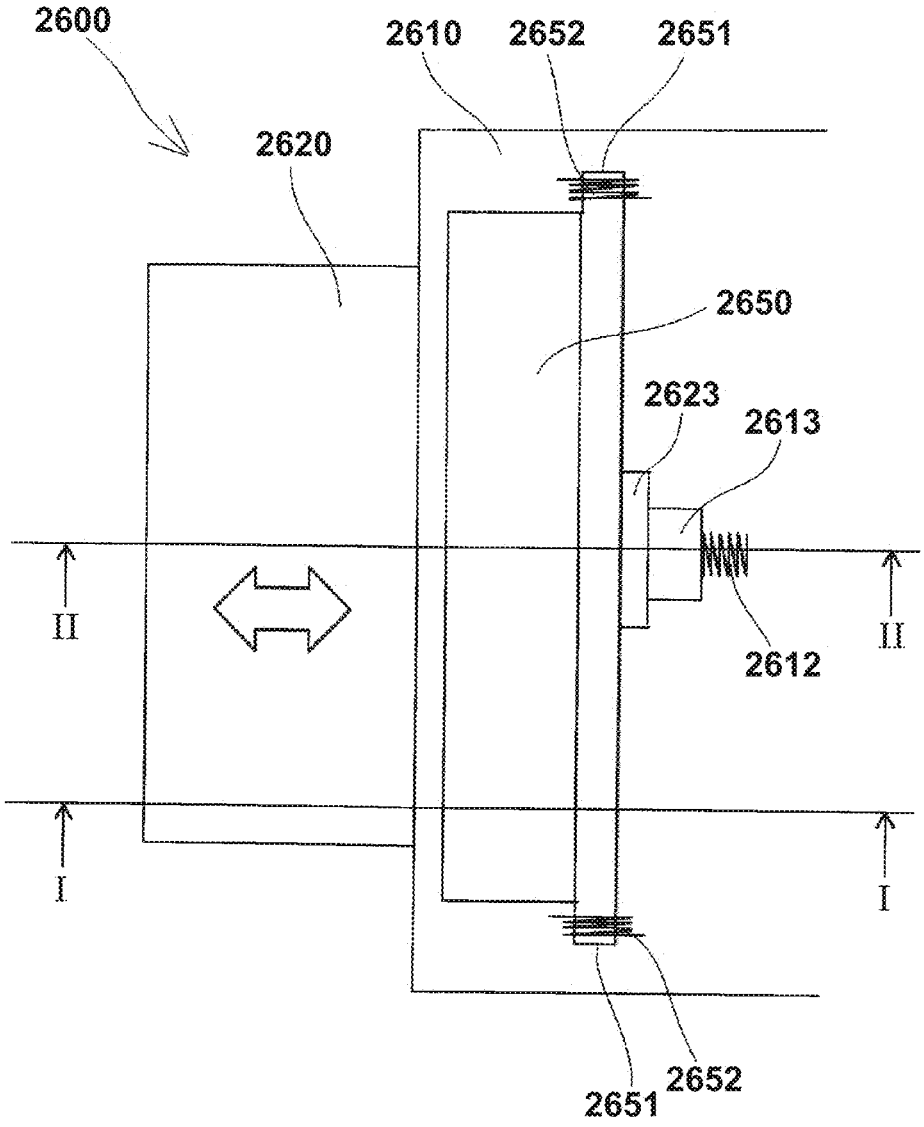
FIG. 69 is a plan view showing the discharge tray according to the embodiment.
Figure 70A:
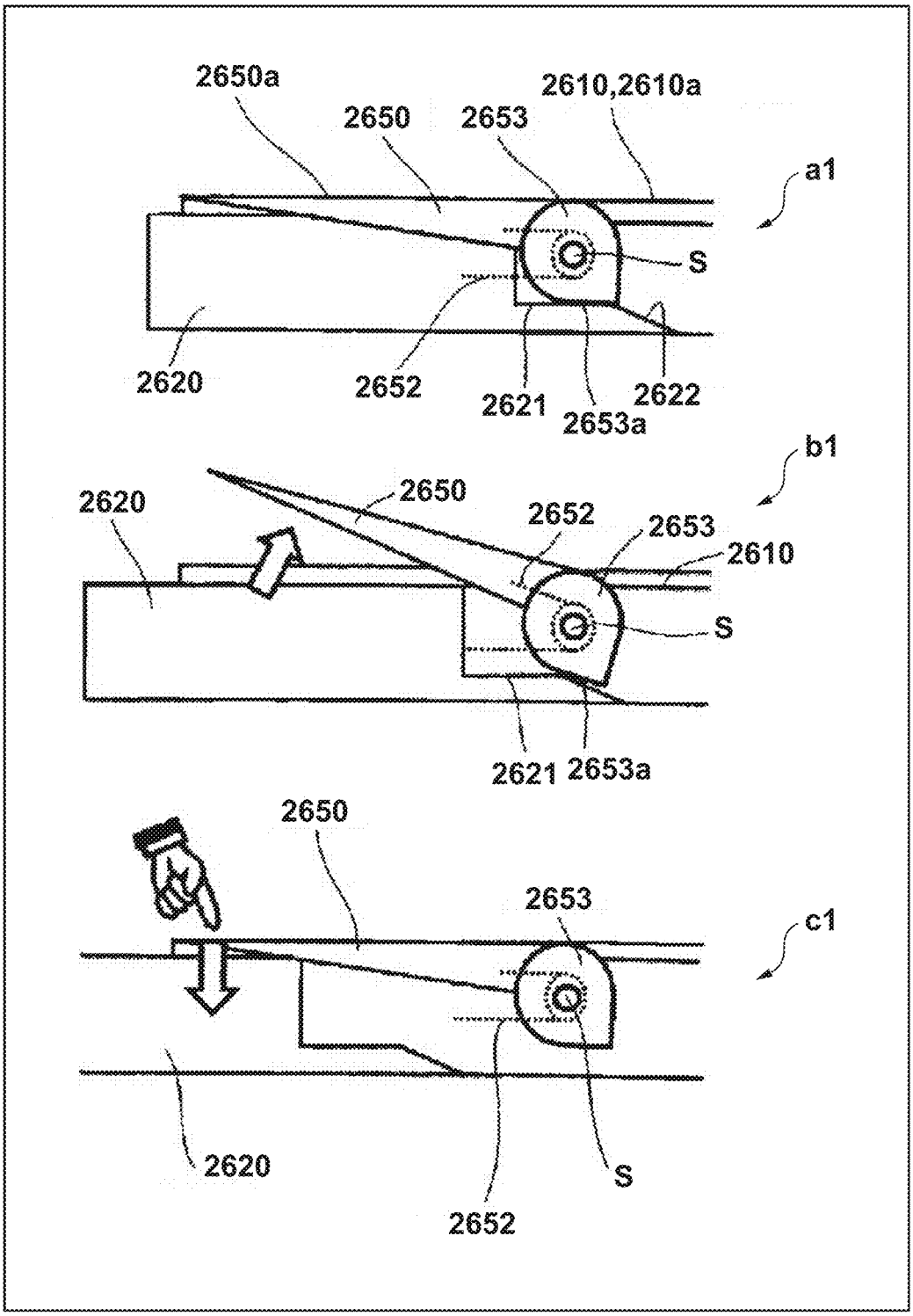
FIG. 70*a* is a sectional view taken along a line I-I in FIG. 69.
Figure 70B:
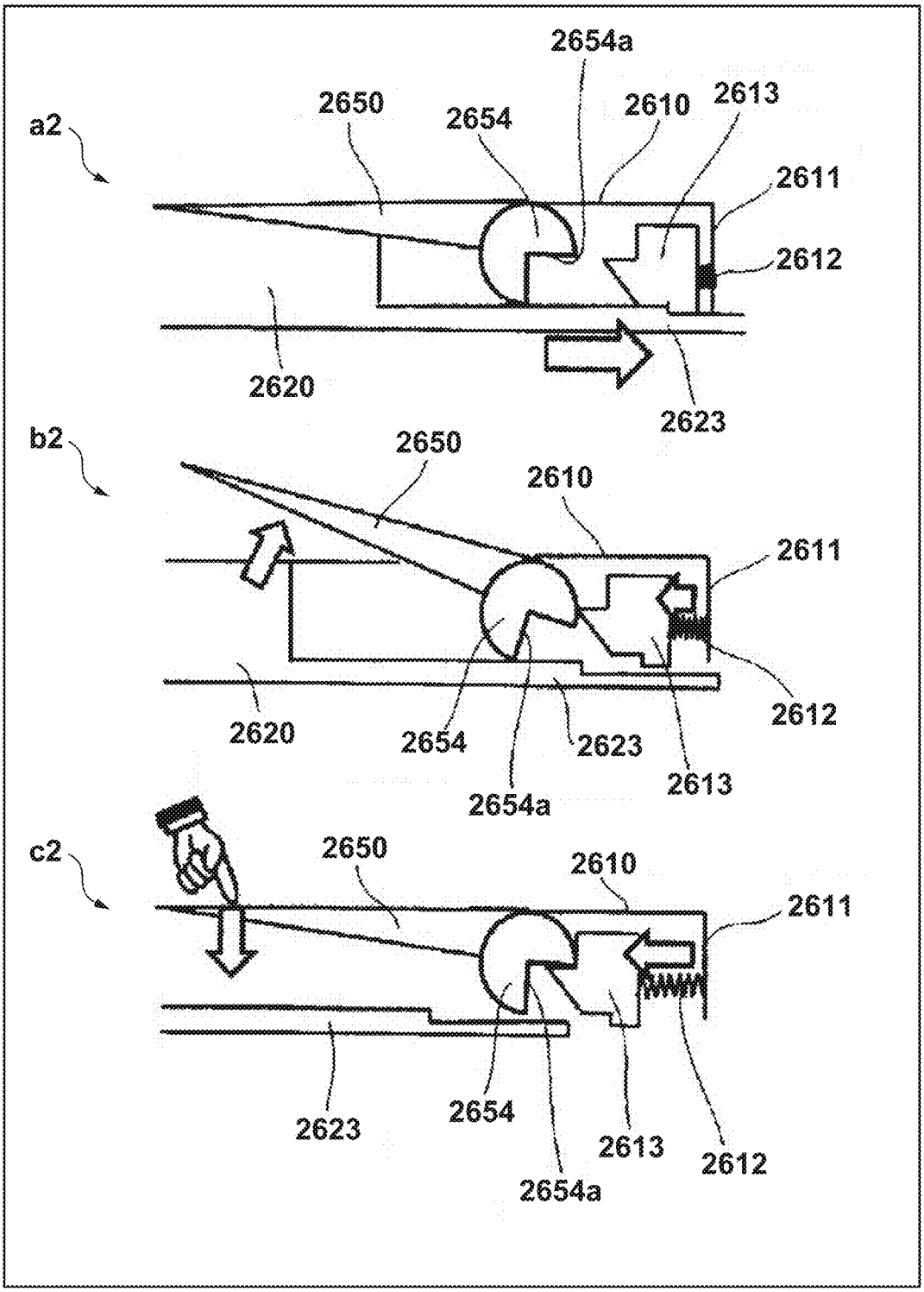
FIG. 70*b* is a sectional view taken along a line II-II in FIG. 69.

As shown in FIGS. 69, 70*a*, and 70*b*, the second discharge tray 2620 is configured to pop up automatically to a predetermined angle when it is drawn out of the first discharge tray 2610, thereby improving user operability. Note that extension of the second discharge tray 2620 assumes reception of a sheet of a large discharge size (for example, an A3-size sheet). Thus, if such sheet is received, it is preferable to improve the discharge aligning property. Therefore, the discharge stopper (discharge guide) 2650 is preferably configured to pop up to the predetermined angle in synchronism with an operation of extending the tray.

FIG. 69 is a schematic view showing the discharge tray 2600 viewed from above. FIG. 70*a* is a sectional view taken along a line I-I in FIG. 69 and showing a change in structure. FIG. 70*b* is a sectional view taken along a line II-II in FIG. 69 and showing a change in structure.

As shown in FIGS. 69, 70*a*, and 70*b*, the discharge stopper 2650 is connected to the first discharge tray 2610 to be rotatable to a predetermined angle by rotating shafts 2651 and coil springs 2652 in two end portions.

An eccentric cam 2653 shown in FIG. 70*a* is partially provided around the rotation axis of the discharge stopper 2650 in each end portion (I-I sectional portion in FIG. 69) of the discharge tray 2600 in the width direction perpendicular to the forward/backward direction (extension/retraction direction) of the second discharge tray 2620.

On the other hand, an engaging portion 2654 including a notch 2654*a* is provided near the central portion of the discharge stopper 2650, that is, the central portion of the discharge tray 2600 in the width direction. An engaged portion 2613 biased by a biasing unit 2612 such as a spring in the forward/backward direction of the second discharge tray 2620 is provided in an inner wall surface 2611 of the first discharge tray 2610 to be engaged with the engaging portion 2654.

In an end portion of the second discharge tray 2620 on the side of the first discharge tray 2610, a flat portion 2621 and a tapered portion 2622 that correspond to the eccentric cam 2653 of the discharge stopper 2650 and a pressing portion 2623 that presses the engaged portion 2613 by a step in correspondence with the engaged portion 2613 are provided.

A configuration in which the discharge stopper 2650 moves in synchronism with forward/backward movement of the second discharge tray 2620 will now be described. As shown in a1 of FIG. 70*a*, when the second discharge tray 2620 is stored in the first discharge tray 2610, a flat surface 2653*a* of each eccentric cam 2653 is in surface contact with the flat portion 2621 of the second discharge tray 2620, thereby restricting the pivot of the discharge stopper 2650. That is, an upper surface 2650*a* of the discharge stopper 2650 is substantially flush with the sheet receiving surface 2610*a* of the first discharge tray 2610, and the discharge stopper 2650 is stored in the groove of the first discharge tray 2610. At this time, as shown in a2 of FIG. 70*b*, the pressing portion 2623 of the second discharge tray 2620 presses the engaged portion 2613 provided in the first discharge tray 2610 in the central portion of the discharge stopper 2650 in the width direction, and thus the engaged portion 2613 and the engaging portion 2654 (notch 2654*a*) of the discharge stopper 2650 are set in a engaged state.

If the second discharge tray 2620 is drawn out of the first discharge tray 2610 and extended, as shown in b1 of FIG. 70*a*, the flat portion 2621 of the second discharge tray 2620 is in slidable contact with the flat surface 2653*a* of each eccentric cam 2653. When the tapered portion 2622 reaches the positions of the eccentric cams 2653, engagement between the eccentric cams 2653 and the second discharge tray 2620 is released, and the discharge stopper 2650 pivots about a pivot shaft S by the coil spring 2652. This causes the discharge stopper 2650 to pop up to the predetermined angle. At this time, in the central portion of the discharge stopper 2650 in the width direction, if the second discharge tray 2620 is drawn out of the first discharge tray 2610, the pressed state of the engaged portion 2613 by the pressing portion 2623 is released. At this time, the discharge stopper 2650 has already pivoted, and thus the engaged portion 2613 abuts against the end portion of the engaging portion 2654.

In a state in which the second discharge tray 2620 is extended, as shown in c1 of FIG. 70*a*, if the user manually stores the discharge stopper 2650 in the first discharge tray 2610, the discharge stopper 2650 is pressed to pivot about the pivot shaft S. Then, as shown in c2 of FIG. 70*b*, the engaged portion 2613 is engaged with the engaging portion 2654 (notch 2654*a*) of the first discharge tray 2610, and the discharge stopper 2650 is set in a rotation stop state. This allows the user to manually store the discharge stopper 2650 when the discharge stopper 2650 is unnecessary. Note that if the second discharge tray 2620 is pressed into the first discharge tray 2610 in this state, the state returns to that shown in a1 of FIG. 70*a* and a2 of FIG. 70*b*.

As described above, the discharge stopper 2650 is configured to automatically pop up along with the forward/backward movement of the second discharge tray 2620, thereby omitting the user's labor for lifting up the discharge stopper 2650. In addition, the user can store the discharge stopper 2650 by pressing it down when it is unnecessary.

Note that the present invention is not limited to the above-described embodiments. For example, the engaging portion 2654, the engaged portion 2613, and the like shown in FIGS. 69, 70*a*, and 70*b* need not be provided. The discharge stopper 2650 can be vertically moved automatically based on the forward/backward movement of the second discharge tray 2620. Furthermore, in the present invention, the above-described discharge stopper 2650 may be raised manually. In either case, it is possible to improve the discharge aligning property by raising the discharge stopper 2650 at an inclination of an arbitrary angle.

As an example in which the sheet aligning property is desirably improved, another embodiment of a configuration in which the distal end of a discharge tray is inclined upward while a discharge stopper is inclined, as described with reference to FIGS. 67*a* and 67*b*, will be described.

Figure 71A:
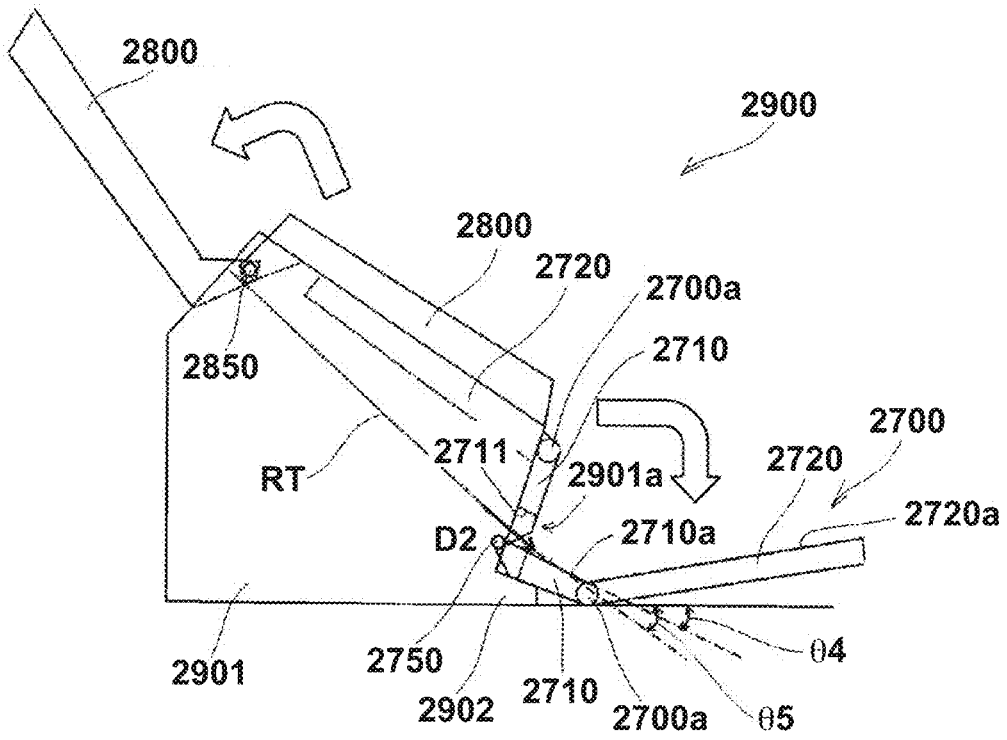
FIG. 71*a* is a schematic side sectional view showing a sheet conveyance apparatus according to another embodiment of the present invention.
Figure 71B:
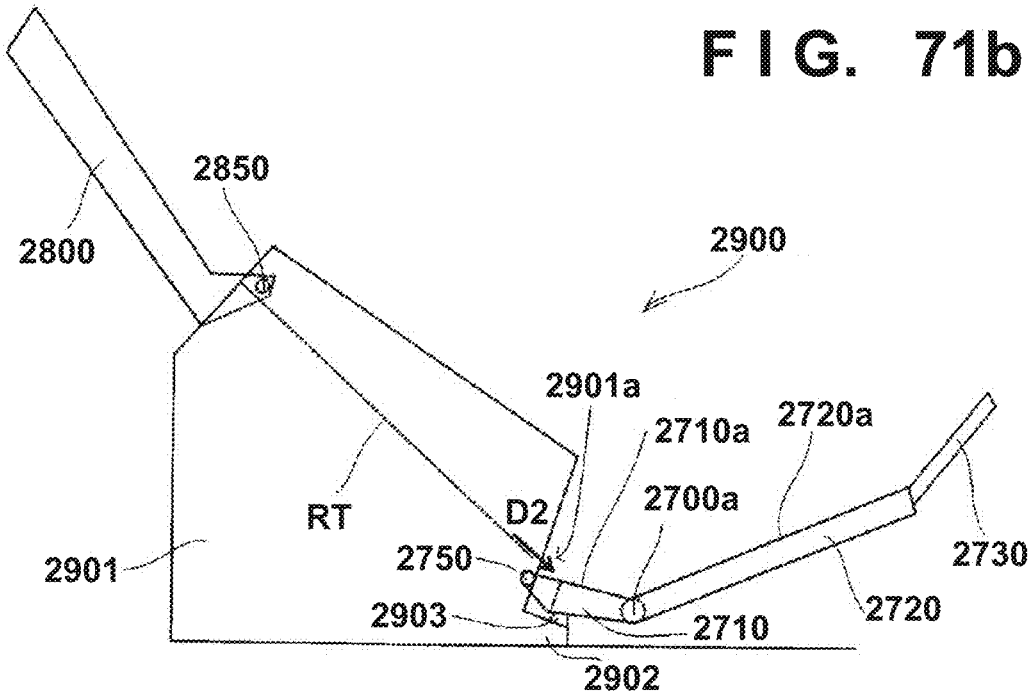
FIG. 71*b* is a schematic side sectional view showing the sheet conveyance apparatus according to the other embodiment of the present invention.

FIGS. 71*a* and 71*b* are schematic side sectional views each showing a sheet conveyance apparatus according to the other embodiment of the present invention. As shown in FIG. 71*a*, in a stored state of a tray, the tray is stored so that a first discharge tray 2710 overlaps a front surface of a main body 2901 serving as a housing of the apparatus and a second discharge tray 2720 overlaps an upper surface (a surface almost parallel to a conveyance path RT) of the apparatus at the first position where a discharge tray unit 2700 is folded to the side of the main body 2901 by pivoting about a rotation hinge (second hinge) 2700*a*. Furthermore, when a feeding tray 2800 pivots about a rotation hinge 2850 and is stored to overlap the second discharge tray 2720, the feeding tray 2800 and the discharge tray unit 2700 are stored. Note that the order in which the discharge tray unit 2700 and the feeding tray 2800 overlap each other is not limited to this. The discharge tray unit 2700 may be folded onto the feeding tray 2800.

When a sheet is conveyed (when a sheet discharged by the discharge tray unit 2700 is received), the feeding tray 2800 and the discharge tray unit 2700 are opened to separate from the main body 2901, and are positioned to be able to receive the discharged sheet (second position).

In this embodiment, in addition to the first discharge tray 2710 and the second discharge tray 2720, the discharge tray unit 2700 folded into the main body 2901 includes, near a first hinge 2750, an opening 2711 communicating with a discharge port 2901*a* as an opening of the main body 2901 that serves as the end portion (exit) of the conveyance path RT. The opening 2711 is formed between the end portion of the first discharge tray 2710 on the apparatus main body side and the lower end portion of the main body 2901.

Thus, it is possible to convey a sheet and discharge it from the main body 2901 by causing only the feeding tray 2800 to pivot from the stored state of the tray so as to feed a sheet and keeping the discharge tray unit 2700 folded to the main body side. In this case as well, when the discharge tray unit 2700 is configured to include the first discharge tray 2710 and the second discharge tray 2720, the leading edge of the discharged sheet lands on a first sheet receiving surface 2710*a* of the first discharge tray 2710, and advances toward a second sheet receiving surface 2720*a* of the second discharge tray 2720 formed at a predetermined angle with respect to the first sheet receiving surface 2710*a*, thereby making it possible to improve the aligning property on the discharge tray unit 2700. Furthermore, since it is possible to discharge the sheet while the discharge tray unit 2700 is stored on the apparatus main body side, it is possible to improve the usability in a situation in which it is determined that the discharge tray unit 2700 need not be opened, that is, a situation in which alignment is unnecessary (when a type of sheet or one sheet is conveyed).

The discharge tray unit 2700 according to this embodiment is provided at a position facing the discharge port 2901*a* while an angle θ4 formed by the first sheet receiving surface 2710*a* as the upper surface of the first discharge tray 2710 for receiving a sheet with the placement plane of the main body 2901 is set to an angle equal to or smaller than an angle θ5 formed by a discharge direction D2 of the discharged sheet with the placement plane of the main body 2901, more preferably, an angle smaller than the angle θ5. Thus, it is possible to implement a configuration in which the leading edge of the discharged sheet lands on the first sheet receiving surface 2710*a* and then the sheet advances toward the second sheet receiving surface 2720*a* of the second discharge tray 2720 provided to have a predetermined inclination with respect to the first sheet receiving surface 2710*a*, thereby reducing the moving amount of the sheet in the discharge direction D2 and the tray surface direction and improving the aligning property of the sheet.

Furthermore, as shown in FIG. 71*b*, the attitude of the discharge tray unit 2700 with respect to the main body 2901 may be changed upward by causing a tray support portion 2903 provided in the lowermost portion of the main body 2901 to abut against the discharge tray unit 2700 of this embodiment from below the first discharge tray 2710.

This can improve the aligning property of the sheet by using the tray support portion 2903 in addition to the effect of improving the aligning property by adopting the above-described bent discharge tray unit 2700. On the other hand, the discharge tray unit 2700 may be used without using the tray support portion 2903, and the discharge tray unit 2700 is used in consideration of the aligning property of the sheet. Although the present invention is not particularly limited, for example, the tray support portion 2903 need not be used when discharging a relatively thin sheet, and is used when discharging a relatively thick sheet. The user can arbitrarily select whether to use the discharge tray unit 2700.

Note that in this embodiment as well, a protruding portion 2902 protruding in the plane direction of the placement plane is provided in the lowermost portion of the main body 2901 on the front end side, and the tray support portion 2903 is provided to be drawn out above the protruding portion 2902. This configuration is preferable because, although not shown, even when only the upper unit is opened to open the conveyance path RT of the main body 2901, the barycenter of the main body 2901 can be stabilized by the protruding portion 2902 and then, the tray support portion 2903 can be made to readily abut against the rear surface of the first discharge tray 2710 of the discharge tray 2700.

Furthermore, the present invention is not limited to the above-described configuration in which the attitude of the discharge tray unit 2700 is changed by the tray support portion 2903. For example, it may be possible to adjust the angle stepwise in the pivot direction of the discharge tray unit 2700 at the first hinge 2750 for connecting the discharge tray unit 2700 and the main body 2901. Alternatively, a tray support portion that can be stored in the rear surface of the first discharge tray 2710 of the discharge tray unit 2700 may be provided, and may be drawn out of the first discharge tray 2710 to change the attitude of the discharge tray unit 2700, as needed. As described above, the present invention can improve the discharge aligning property by adopting the bent discharge tray, and further improve the discharge aligning property by changing the attitude (angle and the like) of the bent discharge tray. The present invention can implement sufficient discharge aligning property not only when sheets of the same size are sequentially discharged at high speed but also when sheets of different sizes are sequentially discharged at high speed, and is thus advantageous in increasing the sheet discharge speed.

There is provided a method of decreasing the conveyance speed near the discharge port in order to improve the discharge aligning property. However, if the above-described configuration is adopted, it is possible to improve the discharge aligning property without decreasing the speed near the discharge port. If the speed is decreased near the discharge port, the throughput of the overall apparatus decreases, and thus it is possible to improve the throughput of conveyance by adopting the configuration according to this embodiment.

The present invention has been described in detail based on various embodiments. However, the discharge aligning property may be improved by combining the above-described embodiments.

<Supplementary Note>

(Claim 1)

There is provided a sheet conveyance apparatus characterized by comprising:

a housing provided with a conveyance path;

conveyance means for conveying a sheet along the conveyance path;

a discharge port from which the sheet conveyed along the conveyance path is discharged;

a discharge tray on which the sheet discharged from the discharge port is stacked; and attitude change means for changing an attitude of the discharge tray, the discharge tray including a first sheet receiving surface which is a portion facing the discharge port in a discharge direction of the sheet and on which a leading edge of the sheet lands, and a second sheet receiving surface which is formed at a predetermined inclination with respect to the first sheet receiving surface, wherein the attitude change means changes the attitude of the discharge tray so that the first sheet receiving surface of the discharge tray is inclined toward the discharge port.

(Claim 2)

There is provided the sheet conveyance apparatus according to claim 1, characterized in that the discharge tray is connected by a rotation hinge portion provided in a lower end portion of the housing on a side on which the discharge port is open, and is pivotable between a first position where the discharge tray falls toward the housing and a second position where the discharge tray receives the discharged sheet, in a state in which the attitude of the discharge tray is not changed by the attitude change means at the second position, the discharge tray is arranged so that an angle formed by the first sheet receiving surface and a placement plane of the housing is not larger than an angle formed by the placement plane of the housing and the discharge direction of the sheet discharged from the discharge port, and in a state in which the attitude of the discharge tray is changed by the attitude change means at the second position, the first sheet receiving surface is inclined toward the housing with respect to the placement plane of the housing.

(Claim 3)

There is provided the sheet conveyance apparatus according to claim 2, characterized in that a protruding portion that protrudes from the lower end portion of the housing in parallel to the placement plane of the housing is provided under the discharge port, the discharge tray is formed by a first discharge tray portion including the first sheet receiving surface, and a second discharge tray portion pivotably connected to the first discharge tray portion and including the second sheet receiving surface, and the attitude change means changes the attitude of the discharge tray by being drawn out upward from the protruding portion and abutting against the first discharge tray portion.

(Claim 4)

There is provided the sheet conveyance apparatus according to claim 2, characterized in that the discharge tray is formed by a first discharge tray portion including the first sheet receiving surface, and a second discharge tray portion pivotably connected to the first discharge tray portion and including the second sheet receiving surface, and the first discharge tray portion covers the discharge port at the first position.

(Claim 5)

There is provided the sheet conveyance apparatus according to claim 2, characterized in that the discharge tray is formed by a first discharge tray portion including the first sheet receiving surface, and a second discharge tray portion pivotably connected to the first discharge tray portion and including the second sheet receiving surface, and forms, at the first position, a sheet discharge opening communicating with the discharge port between an end portion of the first discharge tray portion and the lower end portion of the housing.

Note that the present invention is not limited to the above-described embodiments. For example, another image forming apparatus such as a copying machine or a printer, an image reading apparatus such as a facsimile apparatus or a scanner, or a multi-function type image forming apparatus appropriately having a combination of the above functions may be used. It is possible to obtain the same effect by applying the present invention to a sheet conveyance apparatus in such image forming apparatus or image reading apparatus.

The configuration of the discharge tray 2 described in this embodiment may be applied to a feeding tray on which a fed original is placed. A cover for covering the display panel of an apparatus that does not convey an original or a cover also serving as a keyboard may be adopted. In this embodiment, the upper surface portion and front surface portion of the apparatus are separate surfaces. However, these portions may be implemented by smoothly connected surfaces or one curved surface.

Furthermore, by providing, in the discharge tray, a magnet or an engaging portion that can engage with the apparatus main body, it is possible to reduce the possibility that the discharge tray as an example of a cover floats when stored in the apparatus main body.

The apparatus according to this embodiment has the configuration in which the conveyance path and the display screen are provided on the left side and the operation key is provided on the right side. However, the configuration of these components can freely be changed. In some cases, a configuration in which the operation key is omitted and the display panel is arranged in the central portion of the apparatus may be adopted.

Sheets are sequentially discharged from the discharge port of the sheet conveyance apparatus onto the discharge tray at a predetermined sheet discharge speed. If an attempt is made to improve the conveyance performance of the sheet conveyance apparatus to increase the sheet discharge speed, for example, to discharge A4-size sheets at a speed of 30 sheets/min or higher, a sheet may be difficult to stop within the discharge tray, and may stop when the trailing edge position of the sheet on the discharge tray is separated from the discharge port.

In this case, for example, the leading edge of the succeeding sheet may slide under the trailing edge of the preceding sheet on the discharge tray to reverse the sheet discharge order, or push the preceding sheet, resulting in degradation in sheet aligning property.

The phenomenon in which the sheet aligning property degrades is reduced to some extent by using a bent type discharge tray including the first sheet receiving surface which is a portion facing the discharge port in a discharge direction of the sheet and on which the leading edge of the sheet lands, and the second sheet receiving surface which is formed at a predetermined inclination with respect to the first sheet receiving surface. However, as the sheet discharge speed is increased, the phenomenon may not be prevented effectively.

To cope with this, as in the present invention, if the configuration in which the attitude of the bent type discharge tray is changed is adopted while discharge control is performed at a sheet discharge speed of 30 sheets/min or higher, it is possible to prevent in advance the sheet aligning property from degrading by changing the attitude of the discharge tray so that the first sheet receiving surface of the discharge tray is inclined toward the discharge port. That is, in the sheet conveyance apparatus that can discharge A4-size sheets at a sheet discharge speed of 30 sheets/min or higher, it is particularly preferable to apply the discharge tray angle adjustment structure according to the present invention.

Other Embodiments

The present invention can also be implemented by processing of supplying a program for implementing at least one function of the above-described embodiments to a system or apparatus via a network or a storage medium and reading out and executing the program by at least one processor in the computer of the system or apparatus. The present invention can also be implemented by a circuit (for example, ASIC) for implementing at least one function.

The present invention is not limited to the above-described embodiments, and various changes and modifications can be made within the spirit and scope of the present invention. Therefore, to apprise the public of the scope of the present invention, the following claims are made.

The invention claimed is:

1. A sheet conveyance apparatus comprising:

a housing provided with a conveyance path;

a conveyance unit configured to convey a sheet along the conveyance path;

a discharge port from which the sheet conveyed along the conveyance path is discharged;

a discharge tray on which the sheet discharged from the discharge port is stacked; and an attitude change unit configured to change an attitude of the discharge tray by pivoting to protrude from the housing and abutting against the discharge tray, wherein the discharge tray is pivotable about a hinge arranged in a lower end portion of the housing, and is pivotable between a first position where the discharge tray faces the housing and a second position where the discharge tray can receive the discharged sheet, and the attitude change unit forms part of the conveyance path by the attitude change unit being sandwiched between the discharge tray which is in the second position and a lower portion of the discharge port in a state in which the attitude change unit is pivoted to protrude from the housing and change the attitude of the discharge tray.

2. The sheet conveyance apparatus according to claim 1, further comprising a protruding portion that protrudes from the lower end portion of the housing parallel to a placement plane of the housing and is provided under the discharge port, wherein the attitude change unit is attached to be pivotable between a position where the attitude change unit is drawn out of the protruding portion and a position where the attitude change unit is stored in the protruding portion.

3. The sheet conveyance apparatus according to claim 1, wherein the discharge tray includes a first sheet receiving surface which is a portion adjacent the discharge port with respect to a discharge direction of the sheet and on which a leading edge of the sheet lands, and a second sheet receiving surface which is formed at a predetermined inclination with respect to the first sheet receiving surface, in a state in which the attitude of the discharge tray is not changed by the attitude change unit at the second position, the discharge tray is arranged so that an angle formed by the first sheet receiving surface and a placement plane of the housing is not greater than an angle formed by the placement plane of the housing and the discharge direction of the sheet discharged from the discharge port, and in a state in which the attitude of the discharge tray is changed by the attitude change unit at the second position, the first sheet receiving surface is inclined toward the housing with respect to the placement plane of the housing.

4. The sheet conveyance apparatus according to claim 3, wherein the discharge tray is formed of a first discharge tray portion including the first sheet receiving surface, and a second discharge tray portion pivotably connected to the first discharge tray portion and including the second sheet receiving surface, and the first discharge tray portion covers the discharge port when the discharge tray is at the first position.

5. The sheet conveyance apparatus according to claim 3, wherein the discharge tray is formed of a first discharge tray portion including the first sheet receiving surface, and a second discharge tray portion pivotably connected to the first discharge tray portion and including the second sheet receiving surface, and forms, at the first position, a sheet discharge opening communicating with the discharge port between an end portion of the first discharge tray portion and the lower end portion of the housing.

* * * * *